US012163529B2

(12) United States Patent
Teramoto et al.

(10) Patent No.: US 12,163,529 B2
(45) Date of Patent: Dec. 10, 2024

(54) IMPELLER, MULTI-BLADE AIR-SENDING DEVICE, AND AIR-CONDITIONING APPARATUS

(71) Applicant: Mitsubishi Electric Corporation, Tokyo (JP)

(72) Inventors: Takuya Teramoto, Tokyo (JP); Hiroyasu Hayashi, Tokyo (JP); Ryo Horie, Tokyo (JP); Takashi Yamaguchi, Tokyo (JP); Tomohiro Nagano, Tokyo (JP); Kazuya Michikami, Tokyo (JP); Takahiro Yamatani, Tokyo (JP); Hiroshi Tsutsumi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 97 days.

(21) Appl. No.: 17/794,473

(22) PCT Filed: Mar. 19, 2020

(86) PCT No.: PCT/JP2020/012324
§ 371 (c)(1),
(2) Date: Jul. 21, 2022

(87) PCT Pub. No.: WO2021/186676
PCT Pub. Date: Sep. 23, 2021

(65) Prior Publication Data
US 2023/0135727 A1 May 4, 2023

(51) Int. Cl.
*F04D 29/28* (2006.01)
*F04D 17/16* (2006.01)
(Continued)

(52) U.S. Cl.
CPC ..... *F04D 29/281* (2013.01); *F04D 17/16* (2013.01); *F04D 17/162* (2013.01); *F04D 25/06* (2013.01);
(Continued)

(58) Field of Classification Search
CPC .... F04D 29/424; F04D 29/281; F04D 29/282; F04D 29/4226; F04D 17/162;
(Continued)

(56) References Cited

U.S. PATENT DOCUMENTS 11,242,864 B2 * 2/2022 Anderson ..... F04D 29/282
2012/0207593 A1 8/2012 Ochiai
2020/0072237 A1 * 3/2020 Anderson ..... F04D 25/166

FOREIGN PATENT DOCUMENTS

DE 10 2016 002 832 A1 9/2017
EP 3 718 799 A1 10/2020
(Continued)

OTHER PUBLICATIONS

International Search Report of the International Searching Authority mailed Jun. 9, 2020 for the corresponding International application No. PCT/JP2020/012324 (and English translation).
(Continued)

*Primary Examiner* — Peter J Bertheaud
(74) *Attorney, Agent, or Firm* — Posz Law Group, PLC

(57) ABSTRACT

An impeller connected to a motor having a drive shaft includes a back plate having a boss having a shaft hole through which the drive shaft is inserted, a ring-shaped rim provided to face the back plate, and a plurality of blades connected to the back plate and the rim and arranged along a circumferential direction of the back plate about the rotation shaft. The back plate includes a first surface portion on which the plurality of blades are formed, a second surface portion provided at a region between the boss and the first
(Continued)

surface portion and depressed from the first surface portion in an axial direction of the rotation shaft, and a plurality of projections provided at the second surface portion and extending in the axial direction.

25 Claims, 28 Drawing Sheets

(51) Int. Cl.

| | |
|---|---|
| ***F04D 25/06*** | (2006.01) |
| ***F04D 29/30*** | (2006.01) |
| ***F04D 29/42*** | (2006.01) |
| ***F04D 29/44*** | (2006.01) |
| ***F04D 29/62*** | (2006.01) |
| ***F24F 1/0022*** | (2019.01) |

(52) U.S. Cl.
CPC ..... *F04D 29/282* (2013.01); *F04D 29/283* (2013.01); *F04D 29/30* (2013.01); *F04D 29/4226* (2013.01); *F04D 29/424* (2013.01); *F04D 29/441* (2013.01); *F04D 29/626* (2013.01); *F24F 1/0022* (2013.01)

(58) Field of Classification Search
CPC ..... F04D 29/30; F04D 29/283; F04D 29/441; F04D 29/626; F04D 17/16; F04D 25/06
See application file for complete search history.

(56) References Cited

FOREIGN PATENT DOCUMENTS

| | | | |
|---|---|---|---|
| JP | S53-116804 | U | 9/1978 |
| JP | S54-165804 | U | 11/1979 |
| JP | S59-096397 | U | 6/1984 |
| JP | 2000-240590 | A | 9/2000 |
| JP | 2006-125229 | A | 5/2006 |
| JP | 2012-166658 | A | 9/2012 |
| WO | 2019/188363 | A1 | 10/2019 |

OTHER PUBLICATIONS

Extended European Search Report dated Mar. 22, 2023 issued in corresponding European Patent Application No. 20925898.7.
Office Action dated Apr. 4, 2023 issued in corresponding JP Patent Application No. 2022-507965 (and English translation).

* cited by examiner

IMPELLER, MULTI-BLADE AIR-SENDING DEVICE, AND AIR-CONDITIONING APPARATUS

CROSS REFERENCE TO RELATED APPLICATION

This application is a U.S. national stage application of PCT/JP2020/012324 filed on Mar. 19, 2020, the contents of which are incorporated herein by reference.

TECHNICAL FIELD

The present disclosure relates to an impeller, a multi-blade air-sending device including the impeller, and an air-conditioning apparatus including the multi-blade air-sending device.

BACKGROUND ART

Conventionally, an impeller of a multi-blade air-sending device includes a disk-shaped back plate, radially-arranged blades, and a boss provided in the central part of the back plate and connected to an output shaft of a motor or other devices (see, for example, Patent Literature 1). For an increase in strength, the impeller described in Patent Literature 1 includes a plurality of radially-arranged ribs molded integrally with the back plate.

CITATION LIST

Patent Literature

Patent Literature 1: Japanese Unexamined Utility Model Registration Application Publication No. 59-96397

SUMMARY OF INVENTION

Technical Problem

However, although it is conceivable that the multi-blade air-sending device of Patent Literature 1 may be configured to have high ribs along an axial direction of a rotation shaft of the impeller for an increase in strength of the impeller, having high ribs results in an increased loss during suction, leading to deterioration in air-sending efficiency. Further, since the multi-blade air-sending device of Patent Literature 1 is configured such that a surface of the back plate on which the ribs are mounted and a surface of the back plate on which blades are mounted are flush with each other, outer circumferential portions of the ribs aerodynamically act to cause turbulence in a flow of gas on the inner circumference of the blades, causing deterioration in air-sending efficiency of the impeller.

The present disclosure is intended to solve the aforementioned problem, and has as an object to provide an impeller configured to have improved air-sending efficiency, a multi-blade air-sending device including the impeller, and an air-conditioning apparatus including the multi-blade air-sending device.

Solution to Problem

An impeller according to an embodiment of the present disclosure is an impeller connected to a motor having a drive shaft. The impeller includes a back plate having a boss having a shaft hole through which the drive shaft is inserted, a ring-shaped rim provided to face the back plate, and a plurality of blades connected to the back plate and the rim and arranged along a circumferential direction of the back plate about the rotation shaft. The back plate includes a first surface portion on which the plurality of blades are formed, a second surface portion provided at a region between the boss and the first surface portion and depressed from the first surface portion in an axial direction of the rotation shaft, and a plurality of projections provided at the second surface portion and extending in the axial direction.

A multi-blade air-sending device according to an embodiment of the present disclosure includes the impeller thus configured and a scroll casing housing the impeller and having a peripheral wall formed into a volute shape and a side wall having a bellmouth forming an air inlet communicating with a space formed by the back plate and the plurality of blades.

An air-conditioning apparatus according to an embodiment of the present disclosure includes the multi-blade air-sending device thus configured.

Advantageous Effects of Invention

According to an embodiment of the present disclosure, the back plate includes a first surface portion on which the plurality of blades are formed and a second surface portion provided at a region between the boss and the first surface portion and depressed from the first surface portion in an axial direction of the rotation shaft. Further, the back plate also includes a plurality of projections provided at the second surface portion and extending in the axial direction of the rotation shaft. While the impeller is rotating, the projections draw in a flow of gas by generating negative pressure on a surface of the impeller facing in a direction opposite to a direction of rotation of the impeller, making it possible to increase the amount of air that is suctioned into the impeller. Further, the impeller includes the second surface portion depressed from the first surface portion, on which the plurality of blades are formed, in the axial direction of the rotation shaft, and the projections are provided at the second surface portion. This inhibits a flow of gas produced by the projections from flowing from the second surface portion into the first surface portion. Moreover, the flow of gas produced by the projections has its centrifugally-outward force of wind broken by a step between the first surface portion and the second surface portion, so that the impeller does not suffer from turbulence in the flow of gas on the inner circumference of the blades. This allows the impeller to have higher air-sending efficiency than in a case in which the impeller does not include the projections or the second surface portion.

DESCRIPTION OF EMBODIMENTS

In the following, an impeller 10, a multi-blade air-sending device 100 or other devices, and an air-conditioning apparatus 140 according to embodiments are described, for example, with reference to the drawings. In the following drawings including FIG. 1, relative relationships in dimension between constituent elements, the shapes of the constituent elements, or other features of the constituent elements may be different from actual ones. Further, constituent elements given identical signs in the following drawings are identical or equivalent to each other, and these signs are adhered to throughout the full text of the description. Further, the directive terms (such as "upper", "lower" "right", "left", "front", and "back") used as appropriate for ease of comprehension are merely so written for convenience of explanation, and are not intended to limit the placement or orientation of a device or a component.

Embodiment 1

[Multi-Blade Air-Sending Device 100]

Figure 1:
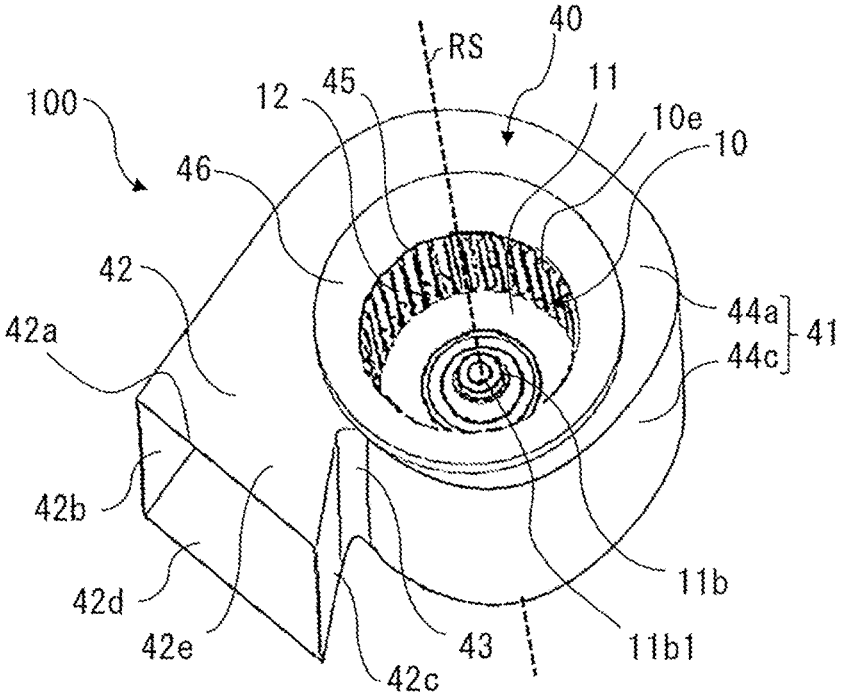
FIG. 1 is a perspective view schematically showing a multi-blade air-sending device according to Embodiment 1.
Figure 2:
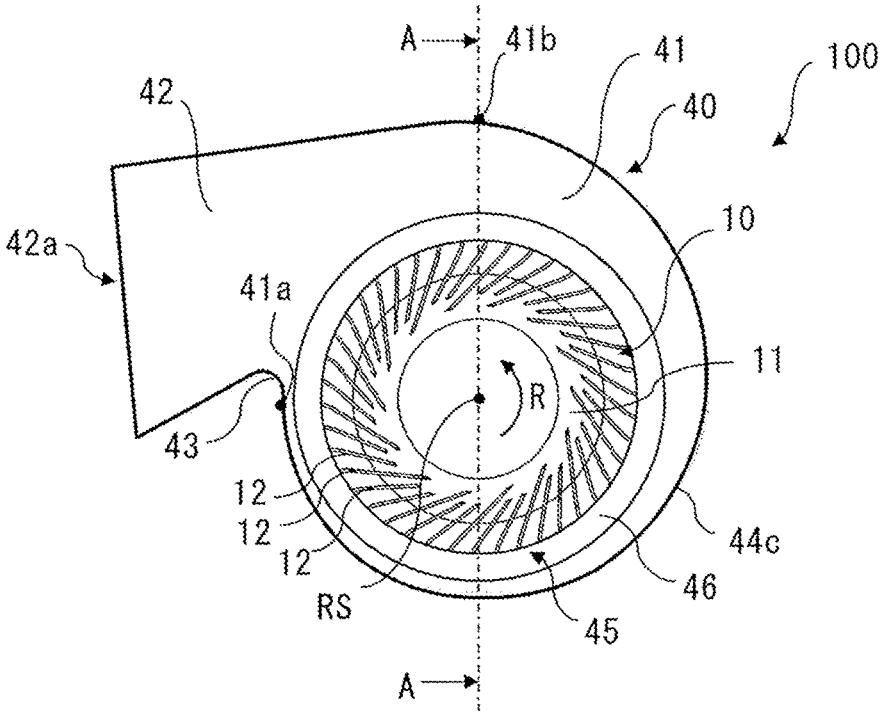
FIG. 2 is an external appearance diagram schematically showing a configuration of the multi-blade air-sending device according to Embodiment 1 as viewed from an angle parallel with a rotation shaft.
Figure 3:
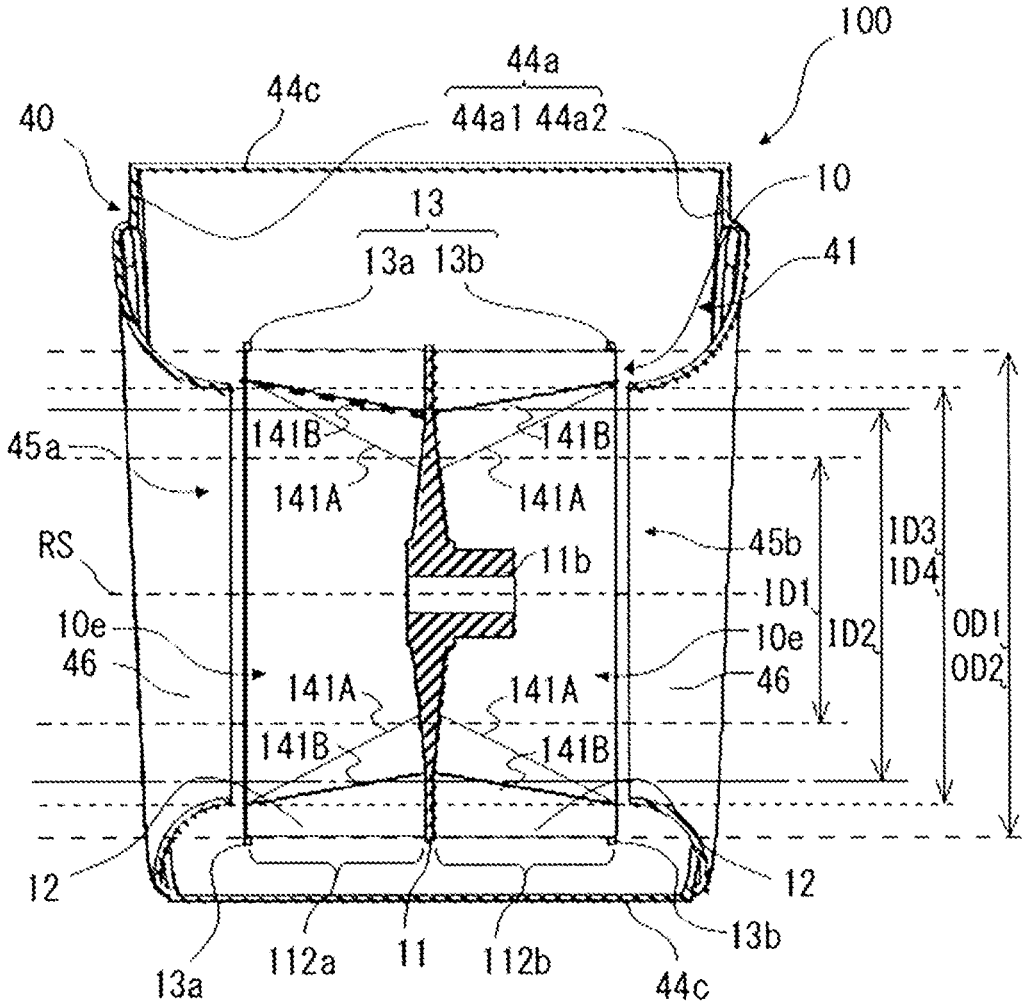
FIG. 3 is a schematic cross-sectional view of the multi-blade air-sending device as taken along line A-A in FIG. 2.

FIG. 1 is a perspective view schematically showing a multi-blade air-sending device 100 according to Embodiment 1. FIG. 2 is an external appearance diagram schematically showing a configuration of the multi-blade air-sending device 100 according to Embodiment 1 as viewed from an angle parallel with a rotation shaft RS. FIG. 3 is a schematic cross-sectional view of the multi-blade air-sending device 100 as taken along line A-A in FIG. 2. A basic structure of the multi-blade air-sending device 100 is described with reference to FIGS. 1 to 3.

The multi-blade air-sending device 100 is a multi-blade centrifugal air-sending device, and has an impeller 10 configured to generate a flow of gas and a scroll casing 40 housing the impeller 10 inside. The multi-blade air-sending device 100 is a double-suction centrifugal air-sending device into which air is suctioned through both sides of the scroll casing 40 in an axial direction of a virtual rotation shaft RS of the impeller 10.

(Scroll Casing 40)

The scroll casing 40 houses the impeller 10 inside for use in the multi-blade air-sending device 100, and rectifies a flow of air blown out from the impeller 10. The scroll casing 40 has a scroll portion 41 and a discharge portion 42.

(Scroll Portion 41)

The scroll portion 41 forms an air trunk through which a dynamic pressure of a flow of gas generated by the impeller 10 is converted into a static pressure. The scroll portion 41 has a side wall 44*a* covering the impeller 10 from an axial direction of a rotation shaft RS of a boss 11*b* of the impeller 10 and having formed therein an air inlet 45 through which air is taken in and a peripheral wall 44*c* surrounding the impeller 10 from a radial direction of the rotation shaft RS of the boss 11*b* of the impeller 10.

Further, the scroll portion 41 has a tongue 43 located between the discharge portion 42 and a scroll start portion 41*a* of the peripheral wall 44*c* to constitute a curved surface and configured to guide the flow of gas generated by the impeller 10 toward a discharge port 42*a* via the scroll portion 41. It should be noted that the radial direction of the rotation shaft RS is a direction perpendicular to the axial direction of the rotation shaft RS. An internal space of the scroll portion 41 constituted by the peripheral wall 44*c* and the side wall 44*a* serves as a space in which the air blown out from the impeller 10 flows along the peripheral wall 44*c*.

(Side Wall 44*a*)

The side wall 44*a* is disposed at both sides of the impeller 10 in the axial direction of the rotation shaft RS of the impeller 10. In the side wall 44*a* of the scroll casing 40, the air inlet 45 is formed so that air can flow between the impeller 10 and the outside of the scroll casing 40.

The inlet port 45 is formed in a circular shape, and is disposed so that the center of the air inlet 45 and the center of the boss 11*b* of the impeller 10 substantially coincide with each other. It should be noted that the shape of the air inlet 45 is not limited to the circular shape but may be another shape such as an elliptical shape.

The scroll casing 40 of the multi-blade air-sending device 100 is a double-suction casing having side walls 44*a* at both sides of a back plate 11 in the axial direction of the rotation shaft RS of the boss 11*b* with air inlets 45 formed in the side walls 44*a*.

The multi-blade air-sending device 100 has two side walls 44*a* in the scroll casing 40. The two side walls 44*a* are formed to face each other via the peripheral wall 44*c*. More specifically, as shown in FIG. 3, the scroll casing 40 has a first side wall 44*a*1 and a second side wall 44*a*2 as the side walls 44*a*. The first side wall 44*a*1 forms a first air inlet 45*a* facing a plate side of the back plate 11 on which the after-mentioned first rim 13*a* is disposed. The second side wall 44*a*2 forms a second air inlet 45*b* facing a plate side of the back plate 11 on which the after-mentioned second rim 13*b* is disposed. It should be noted that the aforementioned air inlet 45 is a generic name for the first air inlet 45*a* and the second air inlet 45*b*.

The air inlet 45 provided in the side wall 44*a* is formed by a bellmouth 46. That is, the bellmouth 46 forms an air inlet 45 communicating with a space formed by the back plate 11 and a plurality of blades 12. The bellmouth 46 rectifies a flow of gas to be suctioned into the impeller 10 and causes the flow of gas to flow into an air inlet 10*e* of the impeller 10.

The bellmouth 46 has an opening having a diameter gradually decreasing from the outside toward the inside of the scroll casing 40. Such a configuration of the side wall 44*a* allows air near the air inlet 45 to smoothly flow along the bellmouth 46 and efficiently flow into the impeller 10 through the air inlet 45.

(Peripheral Wall 44*c*)

The peripheral wall 44*c* guides the flow of gas generated by the impeller 10 toward the discharge port 42*a* along a curved wall surface. The peripheral wall 44*c* is a wall provided between side walls 44*a* facing each other, and constitutes a curved surface in a direction of rotation R of the impeller 10. The peripheral wall 44*c* is for example disposed parallel with the axial direction of the rotation shaft RS of the impeller 10 to cover the impeller 10. It should be noted that the peripheral wall 44*c* may be formed at a slant with respect to the axial direction of the rotation shaft RS of the impeller 10, and is not limited to being formed to be disposed parallel with the axial direction of the rotation shaft RS.

The peripheral wall 44*c* constitutes an inner circumferential surface covering the impeller 10 from the radial direction of the boss 11*b* and facing the after-mentioned plurality of blades 12. The peripheral wall 44*c* faces a side of each of the blades 12 through which air is blown out from the impeller 10. As shown in FIG. 2, the peripheral wall 44*c* is provided along the direction of rotation R of the impeller 10 over an area from the scroll start portion 41*a*, which is located at a boundary with the tongue 43, to a scroll end portion 41*b* located at a boundary between the discharge portion 42 and the scroll portion 41 at a side away from the tongue 43.

The scroll start portion 41*a* is an end portion of the peripheral wall 44*c*, which constitutes a curved surface, situated on an upstream side of a flow of gas generated by rotation of the impeller 10, and the scroll end portion 41*b* is an end portion of the peripheral wall 44*c* situated on a downstream side of the flow of gas generated by rotation of the impeller 10.

The peripheral wall 44*c* is formed in a volute shape. An example of the volute shape is a shape based on a logarithmic spiral, a spiral of Archimedes, or an involute curve. An inner peripheral surface of the peripheral wall 44*c* constitutes a curved surface smoothly curved along a circumferential direction of the impeder 10 from the scroll start portion 41*a*, at which the volute shape starts rolling, to the scroll end portion 41*b*, at which the volute shape finishes rolling. Such a configuration allows air sent out from the impeller 10 to smoothly flow through the space between the impeller 10 and the peripheral wall 44*c* in a direction toward the discharge portion 42. This effects an efficient rise in static pressure of air from the tongue 43 toward the discharge portion 42 in the scroll casing 40.

(Discharge Portion 42)

The discharge portion 42 forms a discharge port 42*a* through which a flow of gas generated by the impeller 10 and having passed through the scroll portion 41 is discharged. The discharge portion 42 is constituted by a hollow pipe having a rectangular cross-section orthogonal to a flow direction of air flowing along the peripheral wall 44*c*. It should be noted that the cross-sectional shape of the discharge portion 42 is not limited to a rectangle. The discharge portion 42 forms a flow passage through which air sent out from the impeller 10 and flowing through a gap between the peripheral wall 44*c* and the impeller 10 is guided to be exhausted out of the scroll casing 40.

As shown in FIG. 1, the discharge portion 42 is constituted by an extension plate 42*b*, a diffuser plate 42*c*, a first side plate portion 42*d*, a second side plate portion 42*e*, or other components. The extension plate 42*b* is formed integrally with the peripheral wall 44*c* to smoothly continue into the scroll end portion 41*b* downstream of the peripheral wall 44*c*. The diffuser plate 42*c* is formed integrally with the tongue 43 of the scroll casing 40 and faces the extension plate 42*b*. The diffuser plate 42*c* is formed at a predetermined angle with respect to the extension plate 42*b* so that the cross-sectional area of the flow passage gradually increases along a flow direction of air in the discharge portion 42.

The first side plate portion 42*d* is formed integrally with the first side wall 44*a*1 of the scroll casing 40, and the second side plate portion 42*e* is formed integrally with the opposite second side wall 44*a*2 of the scroll casing 40. Moreover, the first side plate portion 42*d* and the second side plate portion 42*e* are formed between the extension plate 42*b* and the diffuser plate 42*c*. Thus, the discharge portion 42 has a rectangular cross-section flow passage formed by the extension plate 42*b*, the diffuser plate 42*c*, the first side plate portion 42*d*, and the second side plate portion 42*e*.

(Tongue 43)

In the scroll casing 40, the tongue 43 is formed between the diffuser plate 42*c* of the discharge portion 42 and the scroll start portion 41*a* of the peripheral wall 44*c*. The tongue 43 is formed with a predetermined radius of curvature, and the peripheral wall 44*c* is smoothly connected to the diffuser plate 42*c* via the tongue 43.

The tongue 43 reduces inflow of air from the scroll start to the scroll end of a volute flow passage. The tongue 43 is provided in an upstream part of a ventilation flue, and has a role to effect diversion into a flow of air in the direction of rotation R of the impeller 10 and a flow of air in a discharge direction from a downstream part of the ventilation flue toward the discharge port 42*a*. Further, a flow of air flowing into the discharge portion 42 rises in static pressure during passage through the scroll casing 40 to be higher in pressure than in the scroll casing 40. Therefore, the tongue 43 has a function of separating such different pressures.

[Impeller 10]

Figure 4:
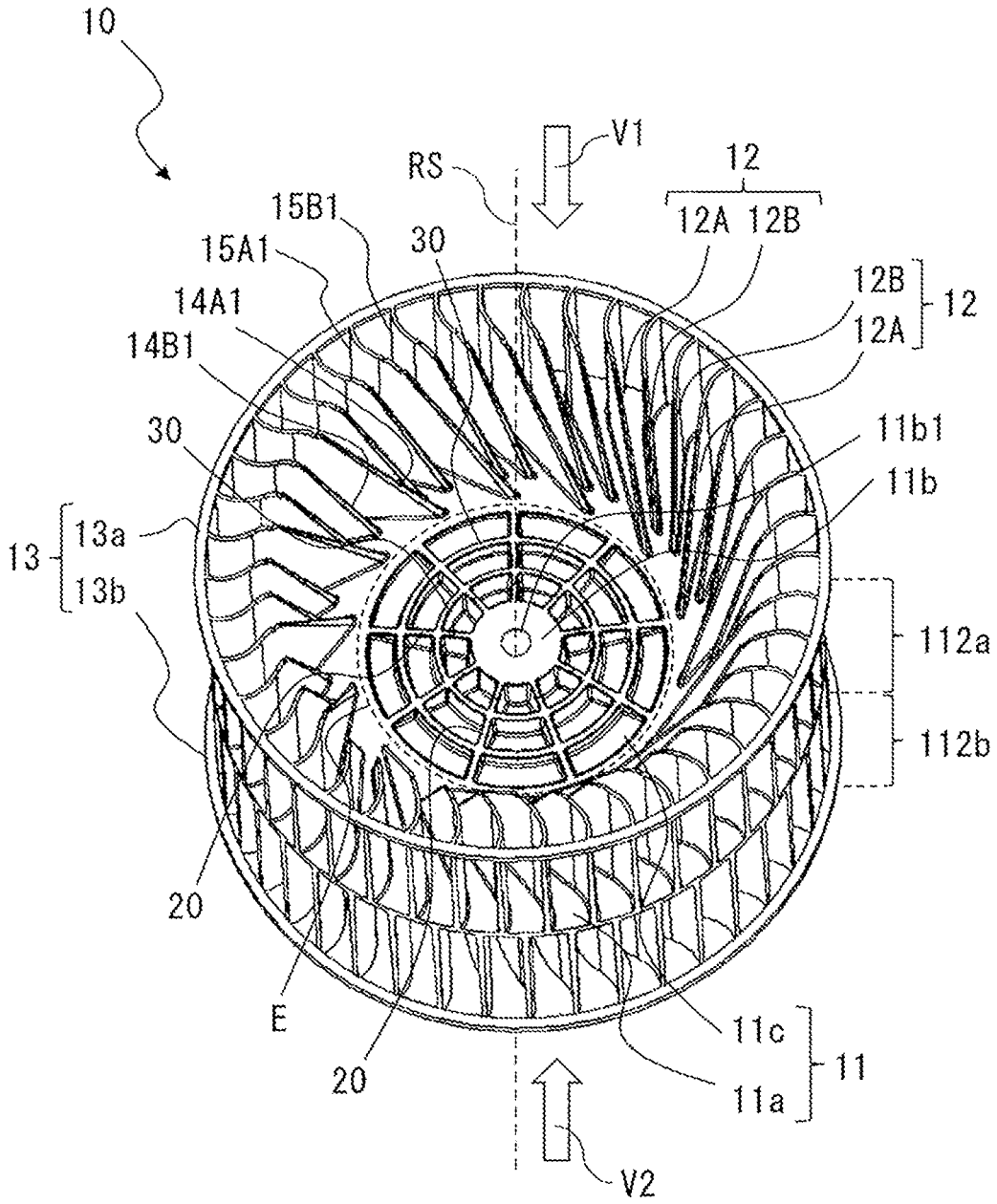
FIG. 4 is a perspective view of an impeller of the multi-blade air-sending device according to Embodiment 1.
Figure 5:
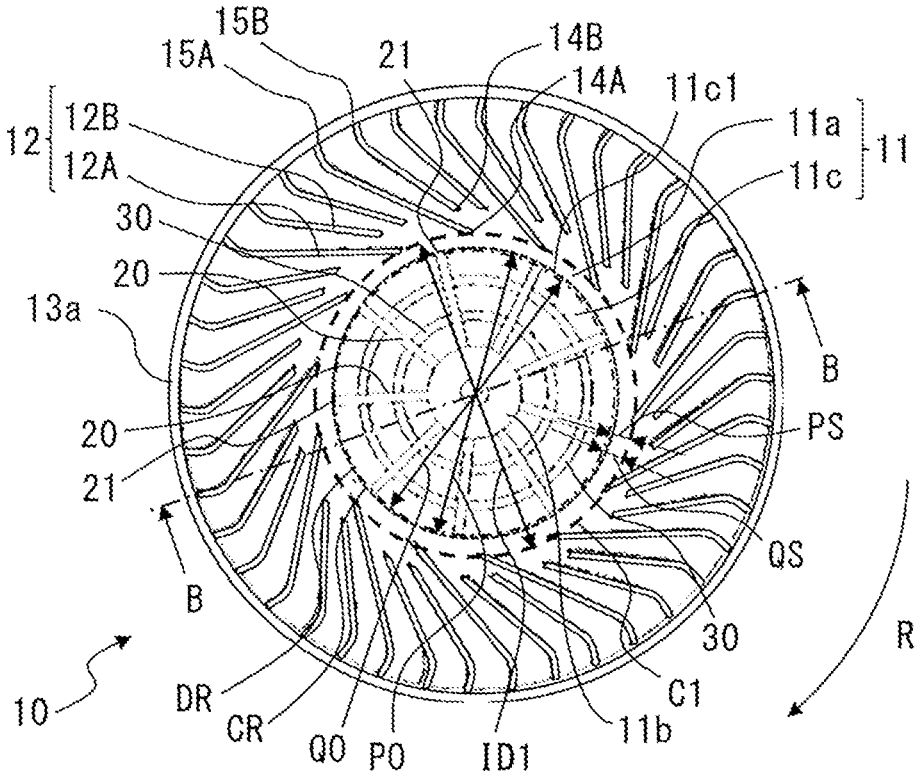
FIG. 5 is a plan view of a back plate of FIG. 4 as seen from one side.
Figure 6:
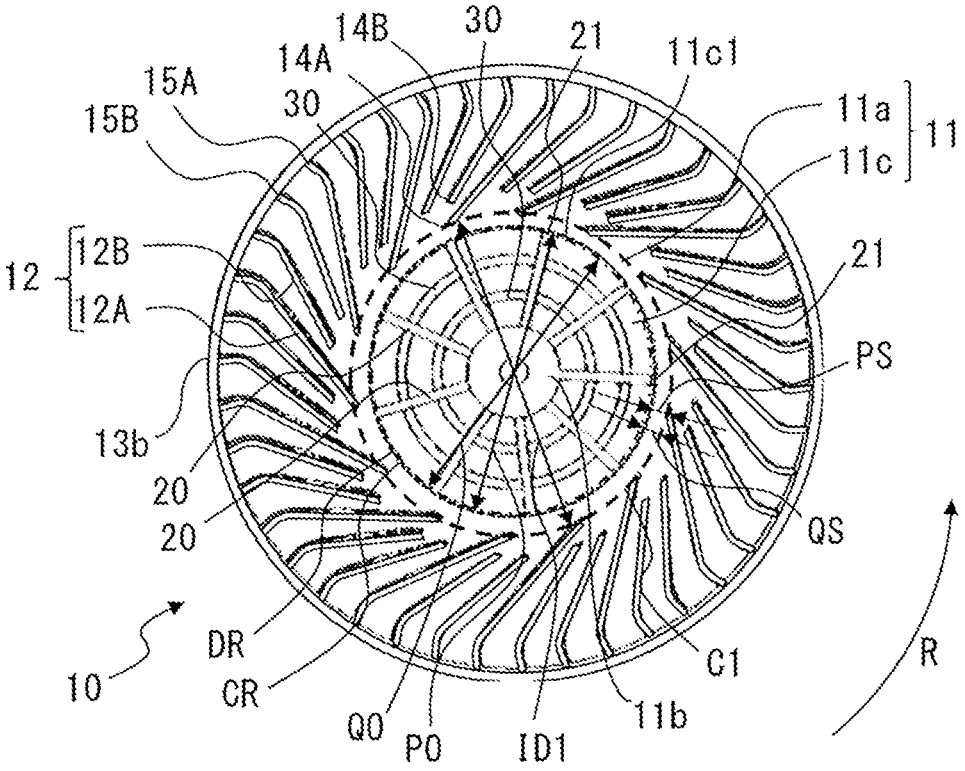
FIG. 6 is a plan view of the back plate of FIG. 4 as seen from the other side.
Figure 7:
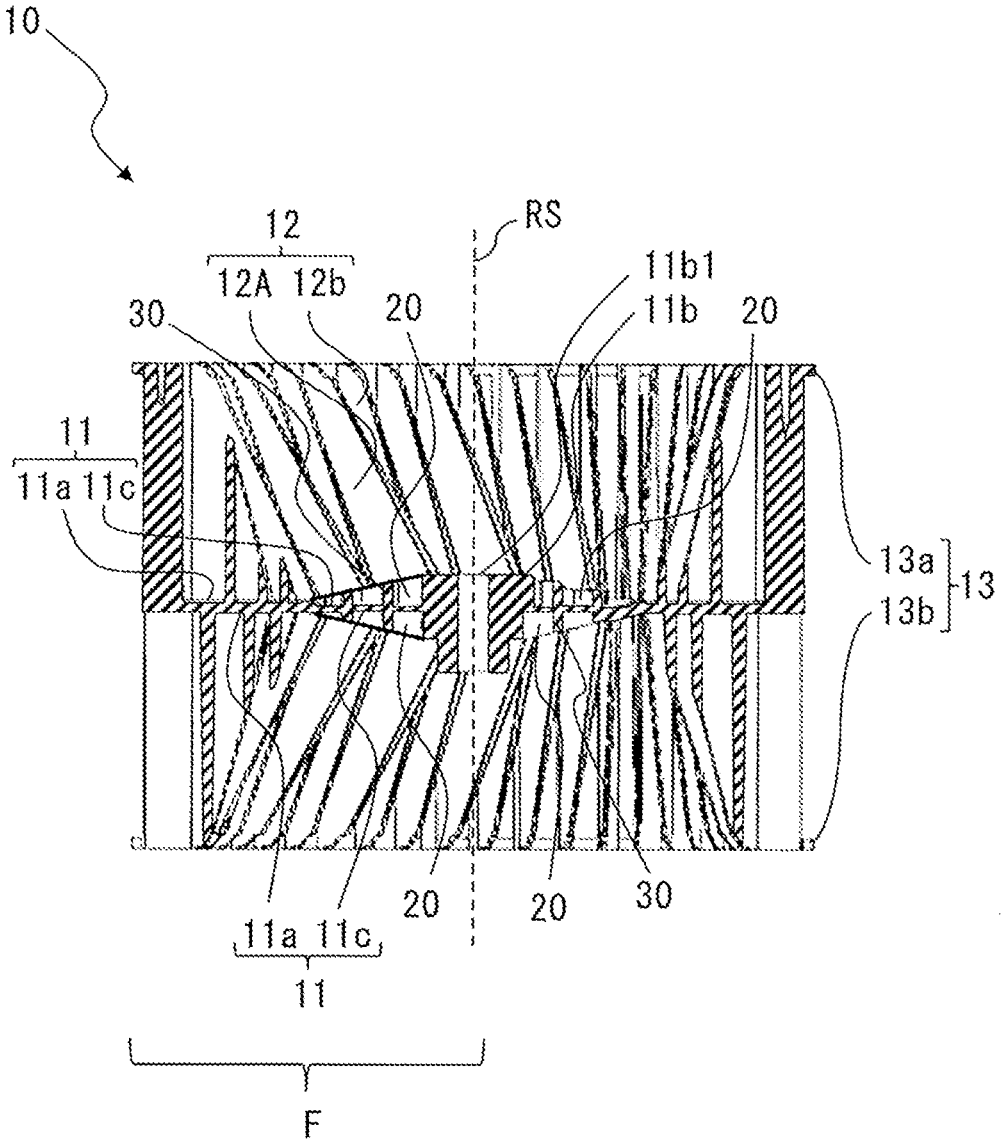
FIG. 7 is a cross-sectional view of the impeller as taken along line B-B in FIG. 5.

FIG. 4 is a perspective view of the impeller 10 of the multi-blade air-sending device 100 according to Embodiment 1. FIG. 5 is a plan view of a back plate 11 of FIG. 4 as seen from one side. FIG. 6 is a plan view of the back plate 11 of FIG. 4 as seen from the other side. FIG. 7 is a cross-sectional view of the impeller 10 as taken along line B-B in FIG. 5. It should be noted that FIG. 5 is a diagram of the impeller 10 as viewed from a point of view V1 indicated by an outline arrow in FIG. 4, and is a plan view as viewed from an angle parallel with the axial direction of the rotation shaft RS. FIG. 6 is a diagram of the impeller 10 as viewed from a point of view V2 indicated by an outline arrow in FIG. 4, and is a plan view as viewed from an angle parallel with the axial direction of the rotation shaft RS. The impeller 10 is described with reference to FIGS. 4 to 7.

The impeller 10 is a centrifugal fan. The impeller 10 is connected to a motor (not illustrated) having a drive shaft. The impeller 10 is driven into rotation, for example, by the motor. The rotation generates a centrifugal force with which the impeller 10 forcibly sends out air outward in a radial direction. The impeller 10 is rotated, for example, by the motor in a direction of rotation R indicated by an arrow. As shown in FIG. 4, the impeller 10 has a disk-shaped back plate 11, a circular-ring-shaped rim 13, and a plurality of blades 12 arranged radially along a circumferential direction of the back plate 11 on a peripheral edge of the back plate 11.

(Back Plate 11)

The back plate 11 needs only be in the shape of a plate, and may for example have a non-disk shape such as a polygonal shape. The back plate 11 has in the central part thereof a boss 11*b* to which the drive shaft of the motor is connected. The boss 11*b* has formed therein a shaft hole 11*b*1 through which the drive shaft of the motor is inserted. The boss 11*b* is formed in a circular cylindrical shape, although the shape of the boss 11*b* is not limited to a circular cylindrical shape. The boss 11*b* needs only be formed in a columnar shape and, as one example, may be formed, for example, in a polygonal columnar shape. The back plate 11 is driven into rotation by the motor via the boss 11*b*. It should be noted that the back plate 11 is not limited to being constituted by one plate-like element but may be constituted by a plurality of plate-like elements fixed in an integrated fashion.

Figure 8:
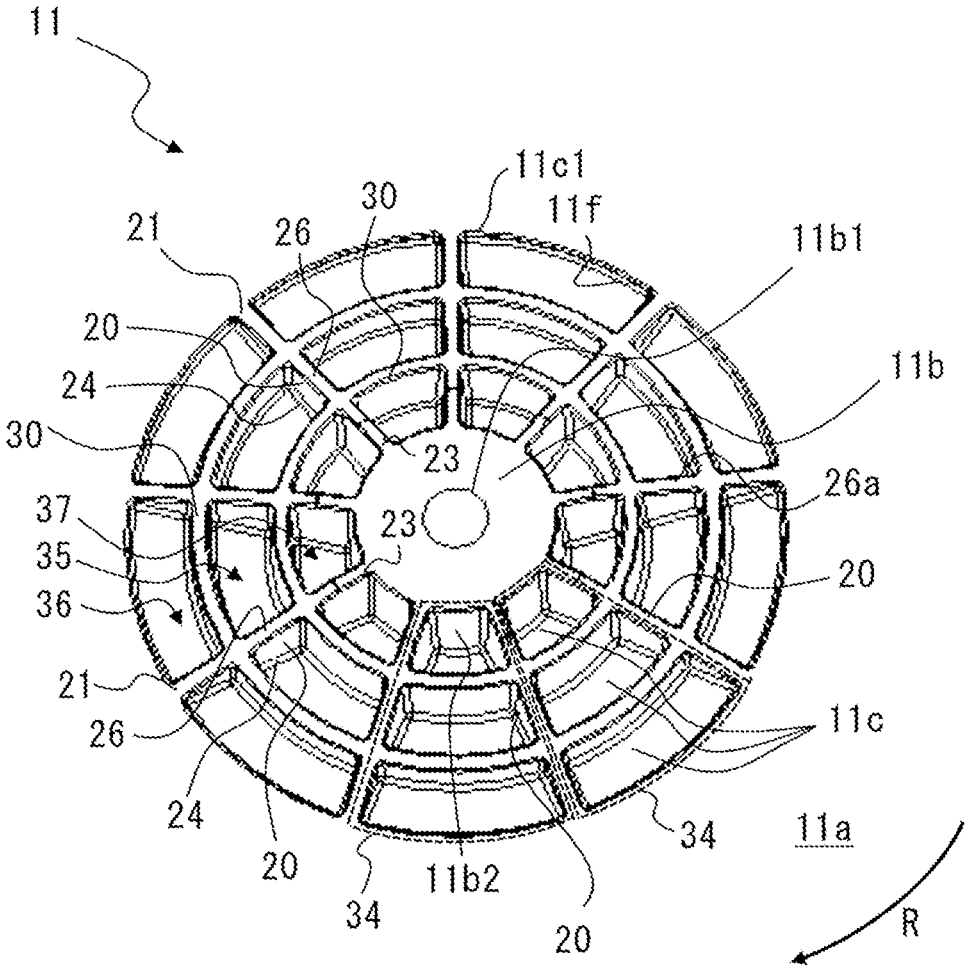
FIG. 8 is a partially-enlarged view of the back plate in a region indicated by part E of FIG. 4.
Figure 9:
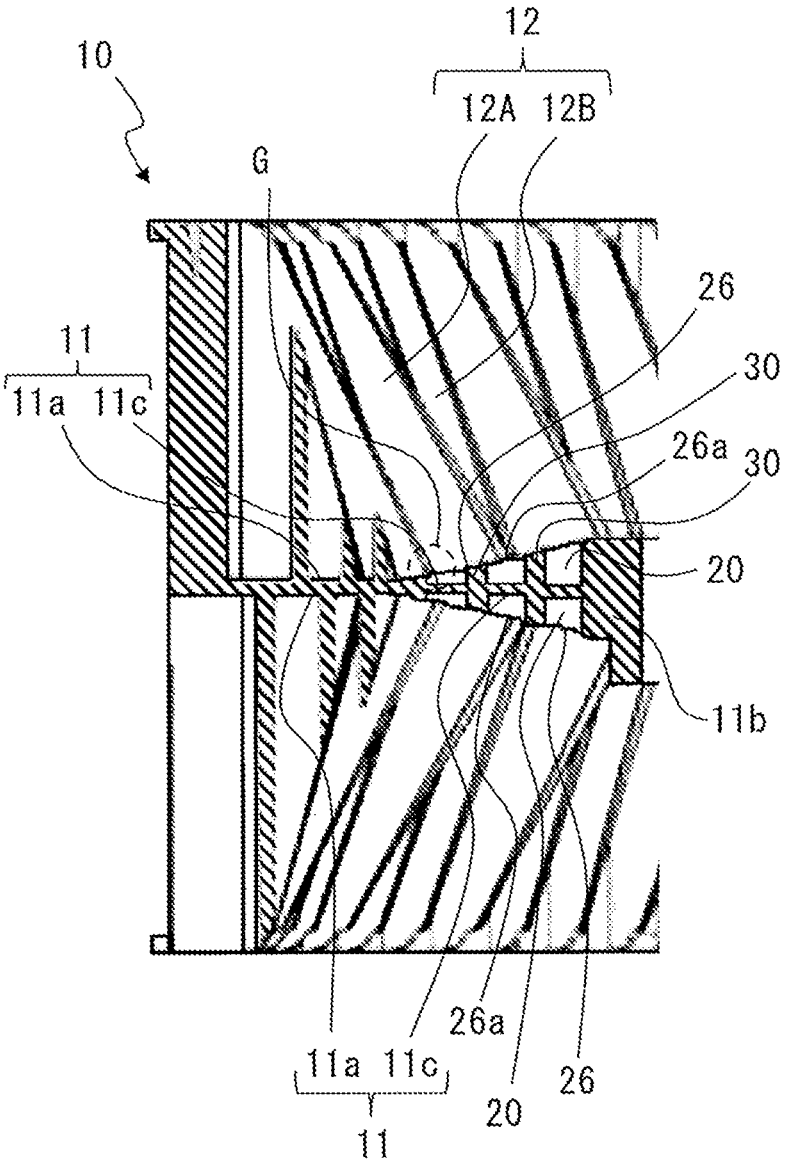
FIG. 9 is a partially-enlarged view of the impeller in a region indicated by part F of FIG. 7.
Figure 10:
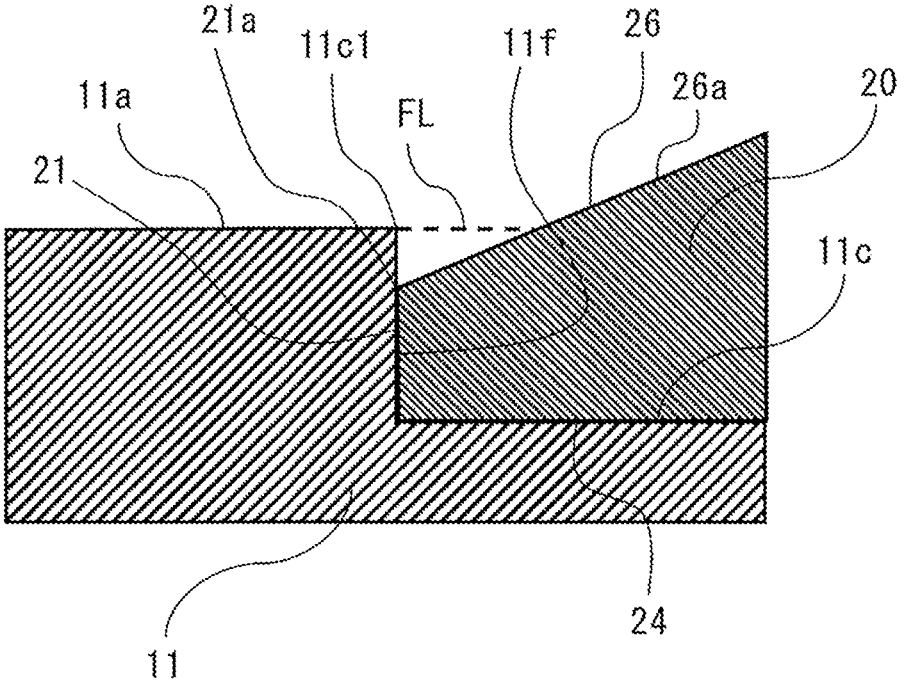
FIG. 10 is a schematic partially-enlarged view of the back plate in a region indicated by part G of FIG. 9.

FIG. 8 is a partially-enlarged view of the back plate 11 in a region indicated by part E of FIG. 4. FIG. 9 is a partially-enlarged view of the impeller 10 in a region indicated by part F of FIG. 7. FIG. 10 is a schematic partially-enlarged view of the back plate 11 in a region indicated by part G of FIG. 9. A configuration of the back plate 11 is described in more detail with reference to FIGS. 8 to 10.

(First Surface Portion 11*a* and Second Surface Portion 11*c*)

The back plate 11 has a first surface portion 11*a* on which the plurality of blades 12 are formed and a second surface portion 11*c* provided at a region between the boss 11*b* and the first surface portion 11*a* and depressed from the first surface portion 11*a* in an axial direction of the rotation shaft RS. The first surface portion 11*a* is located closer to the rim 13 than the second surface portion 11*c*.

The first surface portion 11*a* is formed closer to an outer circumference than the second surface portion 11*c* about the rotation shaft RS. The first surface portion 11*a* is formed in a ring shape in a plan view as viewed in the axial direction of the rotation shaft RS, and the second surface portion 11*c* is formed at an inner circumferential side of the first surface portion 11*a*.

In a plan view as viewed in the axial direction of the rotation shaft RS, the second surface portion 11*c* is provided at a circular-ring-shaped region about the boss 11*b*. That is, the second surface portion 11*c* is depressed in a circular ring shape about the boss 11*b*. It should be noted that when the second surface portion 11*c* is depressed, the second surface portion 11*c* is not limited to being depressed in a circular ring shape about the boss 11*b*. As one example, the second surface portion 11*c* may be depressed in a radial fashion about the boss 11*b*. The back plate 11 needs only include, at the inner circumferential side of the first surface portion 11*a*, a second surface portion 11*c* depressed from the first surface portion 11*a*.

As shown in FIGS. 5 to 7, the back plate 11 has its first and second surface portions 11*a* and 11*c* on both plate sides of the back plate 11 in the axial direction of the rotation shaft RS. In the back plate 11, the second surface portion 11*c* is constituted by a plate whose thickness is thinner than the thickness of a plate constituting the first surface portion 11*a*. As mentioned above, the second surface portion 11*c* is depressed from the first surface portion 11*a*. Therefore, as shown in FIG. 10, the back plate 11 has a step 11*f* formed between the first surface portion 11*a* and the second surface portion 11*c*.

In the back plate 11 of Embodiment 1, the step 11*f* forms an outer circumferential edge 11*c*1 of the second surface portion 11*c*. As shown in FIGS. 5 and 6, the length of a depression outside diameter PO constituted by the outer circumferential edge 11*c*1 of the second surface portion 11*c* is greater than the magnitude of a difference PS between an inside diameter ID1 of the blades 12 constituted by an inner circumferential end 14A of each of the plurality of blades 12 and the depression outside diameter PO. That is, the back plate 11 is configured such that the relationships "Depression Outside Diameter PO>(Inside Diameter ID1−Depression Outside Diameter PO)" and "Depression Outside Diameter PO>Difference PS" hold. Accordingly, the second surface portion 11*c* is formed close to a blade inside diameter of the blades 12 in a radial direction about the rotation shaft RS. It should be noted that the depression outside diameter PO is the diameter of a circle CR constituted by the outer circumferential edge 11*c*1 of the second surface portion 11*c* about the rotation shaft RS. Further, the inside diameter ID1 is the diameter of a circle C1 passing through the inner circumferential ends 14A of the plurality of first blades 12A about the rotation shaft RS.

(Projection 20)

As shown in FIGS. 4 to 10, the back plate 11 includes a plurality of projections 20 provided at the second surface portion 11*c* and extending in the axial direction of the rotation shaft RS. The plurality of projections 20 are provided in a radial fashion about the rotation shaft RS, and each of the plurality of projections 20 extends in the radial direction about the rotation shaft RS. As shown in FIGS. 5 and 6, the back plate 11 has its first and second surface portions 11*a* and 11*c* on both plate sides of the back plate 11, and each of the second surface portions 11*c* formed on both plate sides of the back plate 11 includes the plurality of projections 20. As shown in FIG. 8, the back plate 11 includes nine projections 20. However, the number of projections 20 that are formed is not limited to 9.

As shown in FIG. 8, each of the plurality of projections 20 is a rib formed in the shape of a plate rising from the second surface portion 11*c*. More specifically, the projection 20 is formed in the shape of a four-cornered plate. Note, however, that the projection 20 needs only be a structure projecting from the second surface portion 11*c* and is not limited to the four-cornered plate-like configuration.

As shown in FIG. 8, the projection 20 includes a base 24 connected to the second surface portion 11*c* and serving as a root portion of the projection 20 and a ridge 26 constituting a leading end portion in a direction of projection from the second surface portion 11*c* and forming a ridge line of the projection 20. It should be noted that the ridge line is constituted by leading end portions of the projection 20 in the direction of projection, and refers to a series of leading end portions of the projection 20 opposite the second surface portion 11*c* and a series of highest portions of the projection 20 with the second surface portion 11*c* being a bottom surface portion. The ridge 26 is configured such that a ridge line constituted by the leading end portion in the direction of projection is formed in a linear fashion in a side view as viewed from a direction perpendicular to the axial direction of the rotation shaft RS. It should be noted that ridge 26 is not limited to being configured such that the ridge line is formed in a linear fashion in a side view as viewed from a direction perpendicular to the axial direction of the rotation shaft RS.

Further, the projection 20 includes a projection inner circumferential end 23 serving as an inner circumferential end portion located beside the rotation shaft RS in the radial direction about the rotation shaft RS and a projection outer circumferential end 21 serving as an outer circumferential end portion beside the plurality of blades 12 in the radial direction. The projection inner circumferential end 23 constitutes an inner circumferential end portion of the projection 20, and the projection outer circumferential end 21 constitutes an outer circumferential end portion of the projection 20.

As shown in FIG. 8, each of the plurality of projections 20 is connected to an outer circumferential wall 11*b*2 of the boss 11*b*. That is, the projection inner circumferential end 23 of the projection 20 is connected to the boss 11*b*. Note, however, that the projection 20 is not limited to being configured such that the projection inner circumferential end 23 is connected to the outer circumferential wall 11*b*2 of the boss 11*b*. In the radial direction about the rotation shaft RS, a space may be formed between the projection inner circumferential end 23 of the projection 20 and the outer circumferential wall 11*b*2 of the boss 11*b*.

Each of the plurality of projections 20 is connected to the step 11*f*. That is, the projection outer circumferential end 21 of the projection 20 is connected to the step 11*f*. Note, however, that the projection 20 is not limited to being configured such that the projection outer circumferential end 21 is connected to the step 11*f*. In the radial direction about the rotation shaft RS, a space may be formed between the projection outer circumferential end 21 of the projection 20 and the step 11*f*.

In a case in which a height direction is a direction parallel with the axial direction of the rotation shaft RS and a direction of projection from the second surface portion 11*c*, the plurality of projections 20 have their heights formed at the same height. Note, however, that the back plate 11 is not limited to being configured such that the plurality of projections 20 have their heights formed at the same height. The plurality of projections 20 may be formed at different heights, or may form a group of the same height based on certain regularity.

In a case in which the height direction is the direction parallel with the axial direction of the rotation shaft RS and the direction of projection from the second surface portion 11*c*, the projection outer circumferential end 21, which serves as an outermost circumferential portion of the projection 20, corresponds in height to the first surface portion 11*a*. Alternatively, as shown in FIG. 10, the height of the projection outer circumferential end 21, which serves as the outermost circumferential portion of the projection 20, is lower than the height of the first surface portion 11*a*, and the projection outer circumferential end 21 has an upper end portion 21*a* located closer to the second surface portion 11*c* than the first surface portion 11*a*. In FIG. 10, a virtual surface extension of the first surface portion 11*a* is expressed as a surface of extension FL. As shown in FIG. 10, the upper end portion 21*a* of the projection outer circumferential end 21 is located closer to the second surface portion 11*c* than the surface of extension FL. In other words, the projection outer circumferential end 21, which serves as the outermost circumferential portion of the projection 20, is formed not to project from the first surface portion 11*a* in the direction parallel with the axial direction of the rotation shaft RS.

The height of the projection inner circumferential end 23 of the projection 20 is equal to or lower than the height of a leading end portion of the boss 11*b*. It should be noted that the height of the leading end portion of the boss 11*b* is greater than the height of the first surface portion 11*a*. For example, in the axial direction of the rotation shaft RS, the thickness of a plate constituting the boss 11*b* is greater than the thickness of the plate constituting the first surface portion 11*a*. Note, however, that the height of the leading end portion of the boss 11*b* is not limited to being greater than the height of the first surface portion 11*a* but may be equal to the height of the first surface portion 11*a*.

In a case in which the height of the leading end portion of the boss 11*b* is greater than the height of the first surface portion 11*a*, each of the plurality of projections 20 has an inclined portion 26*a* on the ridge 26. The inclined portion 26*a* is a portion of the ridge 26 whose ridge line is inclined such that the height of the inclined portion 26*a* in the axial direction of the rotation shaft RS decreases from the inner circumference toward the outer circumference. The inclined portion 26*a* of the projection 20 is formed to be higher beside the projection inner circumferential end 23 than beside the projection outer circumferential end 21, and the ridge 26, which constitutes the inclined portion 26*a*, is inclined to increase in distance from the back plate 11 from the projection outer circumferential end 21 toward the projection inner circumferential end 23. It should be noted that the configuration of the inclined portion 26*a* is not limited to this configuration. The inclined portion 26*a* may be a portion of the ridge 26 whose ridge line is inclined such that the inclined portion 26*a* increases in height of projection from the boss 11*b* toward the plurality of blades 12. In this case, the inclined portion 26*a* of the projection 20 is formed to be higher beside the projection outer circumferential end 21 than beside the projection inner circumferential end 23, and the ridge 26, which constitutes the inclined portion 26*a*, is inclined to increase in distance from the back plate 11 from the projection inner circumferential end 23 toward the projection outer circumferential end 21.

As shown in FIGS. 5 and 6, the length of a projection outside diameter QO constituted by the projection outer circumferential end 21 of each of the plurality of projections 20 is greater than the magnitude of a difference QS between the inside diameter ID1 of the blades 12 constituted by the inner circumferential end 14A of each of the plurality of blades 12 and the projection outside diameter 00. That is, the back plate 11 is configured such that the relationship "Projection Outside Diameter QO>(Inside Diameter ID1−Projection Outside Diameter QO)" or "Projection Outside Diameter QO>Difference QS" holds. Accordingly, the projection 20 is formed close to the blade inside diameter of the blades 12 in the radial direction about the rotation shaft RS. It should be noted that the projection outside diameter QO is the diameter of a circle DR passing through the projection outer circumferential ends 21 of the plurality of projections 20 about the rotation shaft RS. In a case in which the projection outer circumferential end 21 of the projection 20 is connected to the step 11*f*, the depression outside diameter PO and the projection outside diameter QO are equal (Depression Outside Diameter PO=Projection Outside Diameter QO), and the difference PS and the difference QS are equal (Difference PS=Difference QS). Further, the circle CR constituted by the outer circumferential edge 11*c*1 of the second surface portion 11*c* about the rotation shaft RS and the circle DR passing through the projection outer circumferential ends 21 of the plurality of projections 20 are equal (Circle CR=Circle DR).

As shown in FIG. 8, the back plate 11 includes a depression 34 in front of and behind a projection 20 along the circumferential direction. In other words, the depression 34 is formed between adjacent projections 20 along the circumferential direction. The depression 34 is formed by the second surface portions 11*c*. More specifically, the depression 34 is formed by the second surface portion 11*c*, adjacent projections 20, the boss 11*b*, and the step 11*f*. The depression 34 is formed in a radial fashion with respect to the boss 11*b*. A plurality of the depressions 34 are formed along the circumferential direction.

(Reinforcing Portion 30)

As shown in FIGS. 8 and 9, the back plate 11 includes a reinforcing portion 30 provided at the second surface portion 11*c* and extending in the axial direction of the rotation shaft RS. The reinforcing portion 30 is a reinforcing rib formed in the shape of a plate rising from the second surface portion 11*c*. The reinforcing portion 30 is formed in a circular arc shape in a plan view as viewed in the direction parallel with the axial direction of the rotation shaft RS, and connects the plurality of projections 20 to each other along the circumferential direction. Accordingly, the reinforcing portion 30 is formed in a circular ring shape in a plan view as viewed in the direction parallel with the axial direction of the rotation shaft RS. The reinforcing portion 30 is connected to the projection 20. The reinforcing portion 30 constitutes a wall that is equal in height to a wall of a projection 20 in a location where the reinforcing portion 30 is connected to the projection 20.

A plurality of the reinforcing portions 30 are provided in the radial direction about the rotation shaft RS. In a case in which the plurality of reinforcing portions 30 are provided in the radial direction, the back plate 11 is formed such that in the radial direction about the rotation shaft RS, a reinforcing portion 30 located beside the inner circumference is higher in wall height than a reinforcing portion 30 located beside the outer circumference. As shown in FIG. 8, the back plate 11 includes reinforcing portions 30 forming two circles. However, the number of reinforcing portions 30 that are formed is not limited to 2.

As shown in FIG. 8, the back plate 11 forms a depression 35 formed in a depressed shape by projections 20, the reinforcing portions 30, and the second surface portion 11*c*. Similarly, the back plate 11 forms a depression 36 formed in a depressed shape by projections 20, a reinforcing portion 30, the step 11*f*, and the second surface portion 11*c*. Similarly, the back plate 11 forms a depression 37 formed in a depressed shape by projections 20, a reinforcing portion 30, the outer circumferential wall 11*b*2 of the boss 11*b*, and the second surface portion 11*c*.

(Blade 12)

As shown in FIG. 4, the plurality of blades 12 are arranged along a circumferential direction about a virtual rotation shaft RS of the back plate 11. One end of each of the plurality of blades 12 is connected to the back plate 11, and the other end of each of the plurality of blades 12 is connected to the rim 13. Each of the plurality of blades 12 is disposed between the back plate 11 and the rim 13. The plurality of blades 12 are provided on both sides of the back plate 11 in the axial direction of the rotation shaft RS of the boss 11*b*. The blades 12 are placed at regular spacings from each other on the peripheral edge of the back plate 11. A configuration of the blades 12 will be described in detail later.

(Rim 13)

The ring-shaped rim 13 of the impeller 10 is attached to ends of the plurality of blades 12 opposite to the back plate 11 in the axial direction of the rotation shaft RS of the boss 11*b*. The rim 13 is provided in the impeller 10 to face the back plate 11. The rim 13 couples the plurality of blades 12 with each other, thereby maintaining a positional relationship between the tip of each blade 12 and the tip of the other blade 12 and reinforcing the plurality of blades 12.

Figure 11:
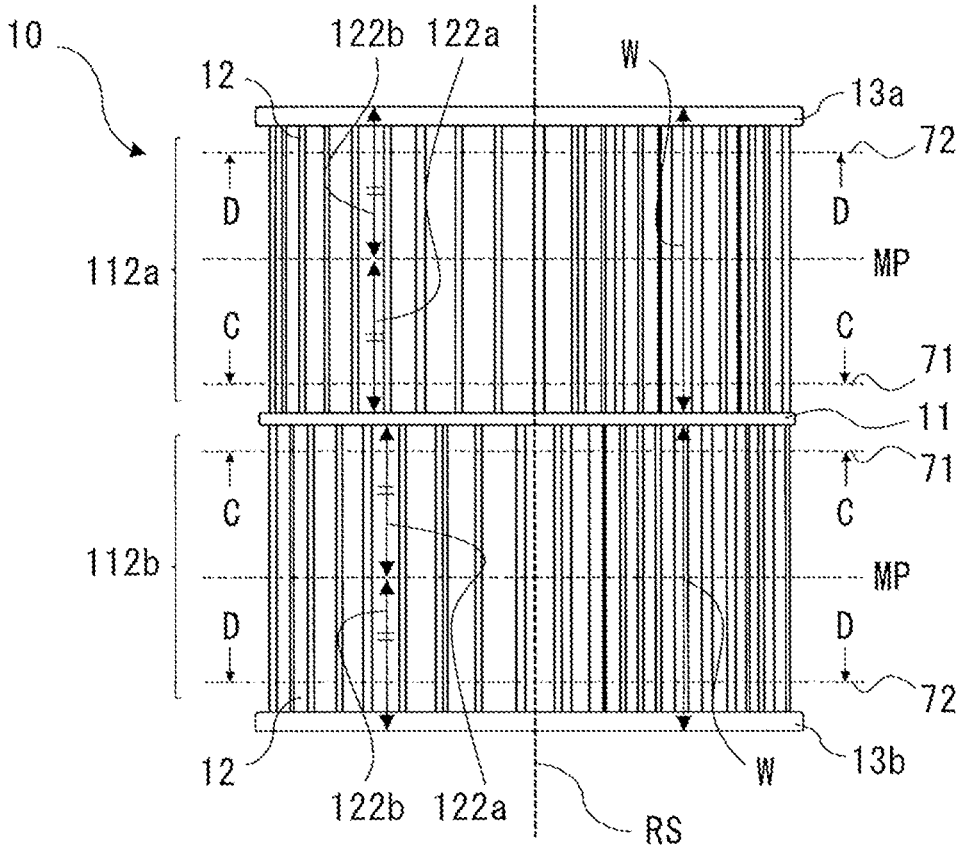
FIG. 11 is a side view of the impeller of FIG. 4.

FIG. 11 is a side view of the impeller 10 of FIG. 4. As shown in FIGS. 4 and 11, the impeller 10 has a first blade group 112*a* and a second blade group 112*b*. The first blade group 112*a* and the second blade group 112*b* are constituted by the plurality of blades 12 and the rim 13. More specifically, the first blade group 112*a* is constituted by a ring-shaped first rim 13*a* disposed to face the back plate 11 and a plurality of blades 12 disposed between the back plate 11 and the first rim 13*a*.

The second blade group 112*b* is constituted by a ring-shaped second rim 13*b* disposed on a side of the back plate 11 opposite to the first rim 13*a* to face the back plate 11 and a plurality of blades 12 disposed between the back plate 11 and the second rim 13*b*. It should be noted that the rim 13 is a generic name for the first rim 13*a* and the second rim 13*b*, and the impeller 10 has the first rim 13*a* on one side of the back plate 11 in the axial direction of the rotation shaft RS, and has the second rim 13*b* on the other side.

The first blade group 112*a* is disposed on one plate side of the back plate 11, and the second blade group 112*b* is disposed on the other plate side of the back plate 11. That is, the plurality of blades 12 are provided on both sides of the back plate 11 in the axial direction of the rotation shaft RS, and the first blade group 112*a* and the second blade group 112*b* are provided back to back with each other via the back plate 11. In FIG. 3, the first blade group 112*a* is disposed on the left side of the back plate 11, and the second blade group 112*b* is disposed on the right side of the back plate 11. However, the first blade group 112*a* and the second blade group 112*b* need only be provided back to back with each other via the back plate 11. The first blade group 112*a* may be disposed on the right side of the back plate 11, and the second blade group 112*b* may be disposed on the left side of the back plate 11. In the following description, those blades 12 which constitute the first blade group 112*a* and those blades 12 which constitute the second blade group 112*b* are collectively referred to as "blades 12" unless otherwise noted.

The impeller 10 is constituted in a tubular shape by the plurality of blades 12 disposed on the back plate 11. Moreover, the impeller 10 has an air inlet 10*e* formed at a side of the rim 13 opposite to the back plate 11 in the axial direction of the rotation shaft RS of the boss 11*b* and configured to cause gas to flow into a space surrounded by the back plate 11 and the plurality of blades 12. The impeller 10 has its blades 12 and rims 13 disposed on both plate sides, respectively, of the back plate 11, and has its air inlets 10*e* formed at both plate sides, respectively, of the back plate 11.

The impeller 10 is driven into rotation about the rotation shaft RS by driving of the motor (not illustrated). The rotation of the impeller 10 causes gas outside the multi-blade air-sending device 100 to be suctioned into the space surrounded by the back plate 11 and the plurality of blades 12 through the air inlet 45 formed in the scroll casing 40 shown in FIG. 1 and the air inlet 10*e* of the impeller 10. Moreover, the rotation of the impeller 10 causes air suctioned into the space surrounded by the back plate 11 and the plurality of blades 12 to be sent out outward in a radial direction of the impeller 10 through a space between a blade 12 and an adjacent blade 12.

(Configuration of Blades 12 in Detail)

Figure 12:
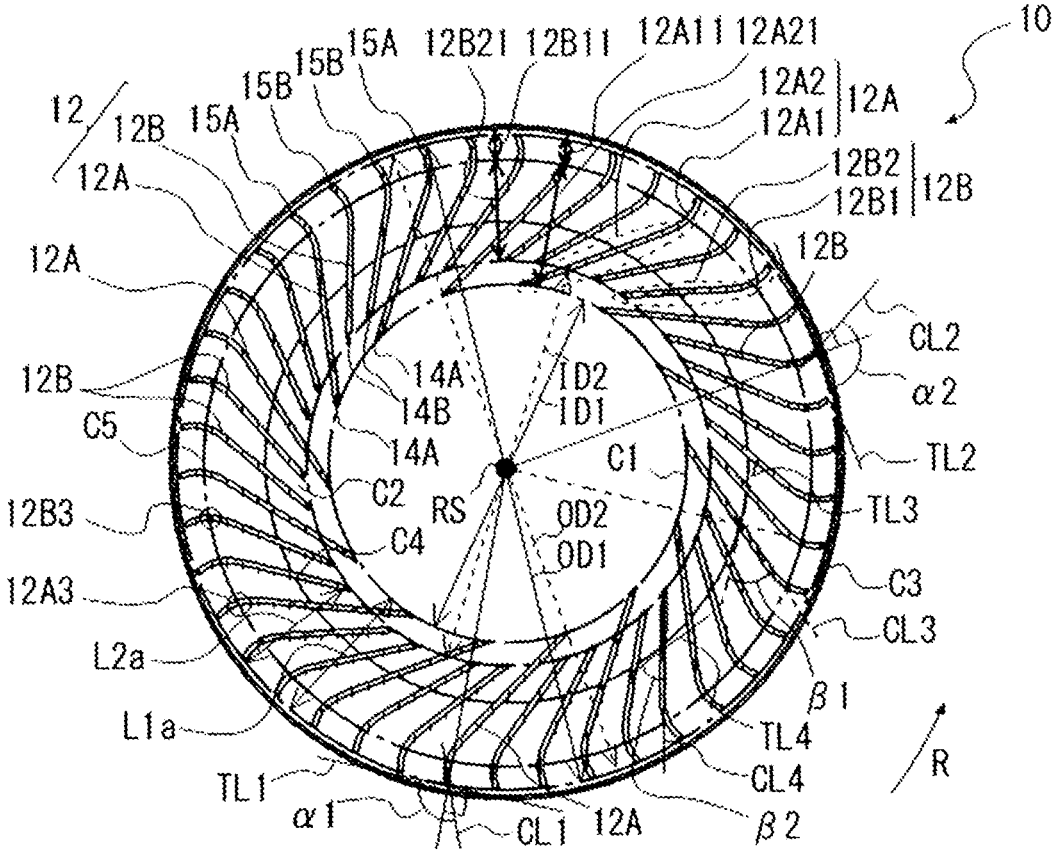
FIG. 12 is a schematic view of blades in a cross-section of the impeller as taken along line C-C in FIG. 11.
Figure 13:
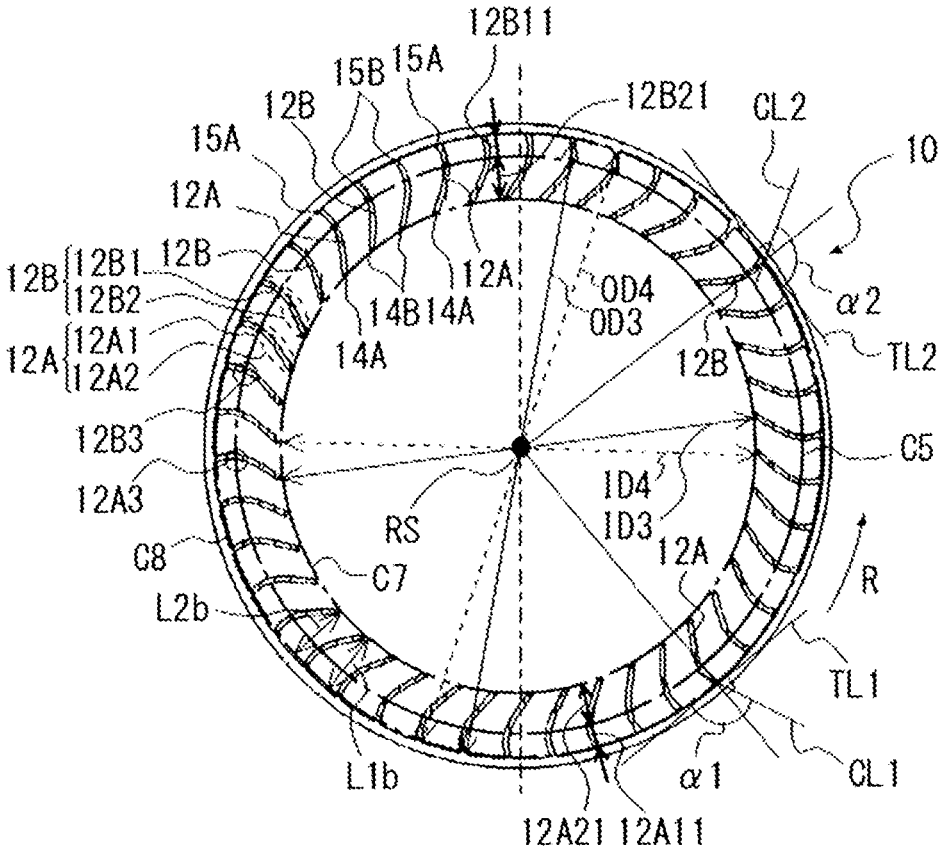
FIG. 13 is a schematic view of the blades in a cross-section of the impeller as taken along line D-D in FIG. 11.

FIG. 12 is a schematic view of the blades 12 in a cross-section of the impeller 10 as taken along line C-C in FIG. 11. FIG. 13 is a schematic view of the blades 12 in a cross-section of the impeller 10 as taken along line D-D in FIG. 11. In FIG. 11, a middle point MP of the impeller 10 indicates a middle point in the axial direction of the rotation shaft RS in the plurality of blades 12 constituting the first blade group 112*a*.

In the plurality of blades 12 constituting the first blade group 112*a*, a region from the middle point MP in the axial direction of the rotation shaft RS to the back plate 11 is a back-plate-side blade region 122*a* serving as a first region of the impeller 10. Further, in the plurality of blades 12 constituting the first blade group 112*a*, a region from the middle point MP in the axial direction of the rotation shaft RS to an end portion of the rim 13 is a rim-side blade region 122*b* serving as a second region of the impeller 10. That is, each of the plurality of blades 12 has a first region located closer to the back plate 11 than the middle point MP in the axial direction of the rotation shaft RS and a second region located closer to the rim 13 than the first region.

As shown in FIG. 12, the cross-section taken along line C-C in FIG. 11 is a cross-section of the plurality of blades 12 beside the back plate 11 of the impeller 10, that is, in the back-plate-side blade region 122*a* serving as the first region. This cross-section of the blades 12 beside the back plate 11 is a first cross-section of the impeller 10 made by cutting through a portion of the impeller 10 close to the back plate 11 along a first plane 71 perpendicular to the rotation shaft RS. Note here that the portion of the impeller 10 close to the back plate 11 is for example a portion of the impeller 10 closer to the back plate 11 than a middle point of the back-plate-side blade region 122*a* in the axial direction of the rotation shaft RS or a portion of the impeller 10 in which end portions of the blades 12 facing the back plate 11 are located in the axial direction of the rotation shaft RS.

As shown in FIG. 13, the cross-section taken along line D-D in FIG. 11 is a cross-section of the plurality of blades 12 beside the rim 13 of the impeller 10, that is, in the rim-side blade region 122*b* serving as the second region. This cross-section of the blades 12 beside the rim 13 is a second cross-section of the impeller 10 made by cutting through a portion of the impeller 10 close to the rim 13 along a second plane 72 perpendicular to the rotation shaft RS. Note here that the portion of the impeller 10 close to the rim 13 is for example a portion of the impeller 10 closer to the rim 13 than a middle point of the rim-side blade region 122*b* in the axial direction of the rotation shaft RS or a portion of the impeller 10 in which end portions of the blades 12 facing the rim 13 are located in the axial direction of the rotation shaft RS.

A basic configuration of the blades 12 in the second blade group 112*b* is similar to a basic configuration of the blades 12 in the first blade group 112*a*. That is, in FIG. 5, a middle point MP of the impeller 10 indicates a middle point in the axial direction of the rotation shaft RS in the plurality of blades 12 constituting the second blade group 112*b*.

In the plurality of blades 12 constituting the second blade group 112*b*, a region from the middle point MP in the axial direction of the rotation shaft RS to the back plate 11 is a back-plate-side blade region 122*a* serving as a first region of the impeller 10. Further, in the plurality of blades 12 constituting the second blade group 112*b*, a region from the middle point MP in the axial direction of the rotation shaft RS to an end portion of the second rim 13*b* is a rim-side blade region 122*b* serving as a second region of the impeller 10.

Although the foregoing description assumes that a basic configuration of the first blade group 112*a* and a basic configuration of the second blade group 112*b* are similar to each other, a configuration of the impeller 10 is not limited to such a configuration but may be a configuration in which the first blade group 112*a* and the second blade group 112*b* are different from each other. Both or either the first blade group 112*a* and/or the second blade group 112*b* may have the configuration of the blades 12 to be described below.

As shown in FIGS. 11 to 13, the plurality of blades 12 include a plurality of first blades 12A and a plurality of second blades 12B. The plurality of blades 12 include an alternate arrangement of a first blade 12A and or more second blades 12B along the circumferential direction of the impeller 10.

As shown in FIGS. 4 and 12, the impeller 10 has two second blades 12B disposed between a first blade 12A and a first blade 12A disposed adjacent to the first blade 12A in the direction of rotation R. Note, however, that the number of second blades 12B that are disposed between a first blade 12A and a first blade 12A disposed adjacent to the first blade 12A in the direction of rotation R is not limited to 2 but may be 1 or larger than or equal to 3. That is, at least one of the plurality of second blades 12B is disposed between two of the plurality of first blades 12A adjacent to each other along the circumferential direction.

As shown in FIG. 12, in the first cross-section of the impeller 10 as taken along the first plane 71 perpendicular to the rotation shaft RS, each of the first blades 12A has an inner circumferential end 14A and an outer circumferential end 15A. The inner circumferential end 14A is located closer to the rotation shaft RS in the radial direction about the rotation shaft RS, and the outer circumferential end 15A is located closer to the outer circumference than the inner circumferential end 14A in the radial direction. In each of the plurality of first blades 12A, the inner circumferential end 14A is disposed in front of the outer circumferential end 15A in the direction of rotation R of the impeller 10.

As shown in FIG. 4, the inner circumferential end 14A serves as a leading edge 14A1 of the first blade 12A, and the outer circumferential end 15A serves as a trailing edge 15A1 of the first blade 12A. As shown in FIG. 12, the impeller 10 has fourteen first blades 12A disposed therein. However, the number of first blades 12A is not limited to 14 but may be smaller or larger than 14.

As shown in FIG. 12, in the first cross-section of the impeller 10 as taken along the first plane 71 perpendicular to the rotation shaft RS, each of the second blades 12B has an inner circumferential end 14B and an outer circumferential end 158. The inner circumferential end 14B is located closer to the rotation shaft RS in the radial direction about the rotation shaft RS, and the outer circumferential end 15B is located closer to the outer circumference than the inner circumferential end 14B in the radial direction. In each of the plurality of second blades 128, the inner circumferential end 14B is disposed in front of the outer circumferential end 15B in the direction of rotation R of the impeller 10.

As shown in FIG. 4, the inner circumferential end 14B serves as a leading edge 1481 of the second blade 12B, and the outer circumferential end 158 serves as a trailing edge 1581 of the second blade 128. As shown in FIG. 12, the impeller 10 has twenty-eight second blades 128 disposed therein. However, the number of second blades 128 is not limited to 28 but may be smaller or larger than 28.

The following describes a relationship between the first blades 12A and the second blades 12B. As shown in FIGS. 4 and 13, the blade length of each of portions of each of the first blades 12A closer to the first rim 13*a* and the second rim 13*b* than the middle points MP in a direction along the rotation shaft RS is equal to the blade length of each of portions of each of the second blades 12B closer to the first rim 13*a* and the second rim 13*b* than the middle points MP in the direction along the rotation shaft RS.

Meanwhile, as shown in FIGS. 4 and 12, the blade length of a portion each of the first blades 12A closer to the back plate 11 than the middle point MP in the direction along the rotation shaft RS is greater than the blade length of a portion of each of the second blades 12B closer to the back plate 11 than the middle point MP in the direction along the rotation shaft RS, and increases toward the back plate 11. Thus, in the present embodiment, the blade length of at least a portion of each of the first blades 12A in the direction along the rotation shaft RS is greater than the blade length of at least a portion of each of the second blades 12B in the direction along the rotation shaft RS. It should be noted that the term "blade length" here means the length of each of the first blades 12A in the radial direction of the impeller 10 and the length of each of the second blades 12B in the radial direction of the impeller 10.

Let it be assumed that as shown in FIG. 12, in the first cross-section closer to the back plate 11 than the middle point MP shown in FIG. 11, the diameter of a circle C1 passing through the inner circumferential ends 14A of the plurality of first blades 12A about the rotation shaft RS, that is, the inside diameter of the first blades 12A, is an inside diameter ID1. Let it be assumed that the diameter of a circle C3 passing through the outer circumferential ends 15A of the plurality of first blades 12A about the rotation shaft RS, that is, the outside diameter of the first blades 12A, is an outside diameter OD1. One-half of the difference between the outside diameter OD1 and the inside diameter ID1 is equal to the blade length L1a of each of the first blades 12A in the first cross-section (Blade Length L1a=(Outside Diameter OD1−Inside Diameter ID1)/2).

Note here that the ratio of the inside diameter to the outside diameter of the first blades 12A is lower than or equal to 0.7. That is, the plurality of first blades 12A are configured such that the ratio of the inside diameter ID1 constituted by the inner circumferential end 14A of each of the plurality of first blades 12A and to the outside diameter OD1 constituted by the outer circumferential end 15A of each of the plurality of first blades 12A is lower than or equal to 0.7.

It should be noted that in a common multi-blade air-sending device, the blade length of a blade in a cross-section perpendicular to a rotation shaft is shorter than the width dimension of a blade in a direction parallel with the rotation shaft. In the present embodiment too, the maximum blade length of each of the first blades 12A, that is, the blade length of an end portion of each of the first blades 12A close to the back plate 11, is shorter than the width dimension W (see FIG. 11) of each of the first blades 12A in the direction parallel with the rotation shaft.

Further, let it also be assumed that in the first cross-section, the diameter of a circle C2 passing through the inner circumferential ends 14B of the plurality of second blades 12B about the rotation shaft RS, that is, the inside diameter of the second blades 12B, is an inside diameter ID2 that is larger than the inside diameter ID1 (Inside Diameter ID2>Inside Diameter ID1). Let it be assumed that the diameter of the circle C3 passing through the outer circumferential ends 15B of the plurality of second blades 12B about the rotation shaft RS, that is, the outside diameter of the second blades 12B, is an outside diameter OD2 that is equal to the outside diameter OD1 (Outside Diameter OD2=Outside Diameter OD1). One-half of the difference between the outside diameter OD2 and the inside diameter ID2 is equal to the blade length L2a of each of the second blades 12B in the first cross-section (Blade Length L2a=(Outside Diameter OD2−Inside Diameter ID2)/2). The blade length L2a of each of the second blades 12B in the first cross-section is shorter than the blade length L1a of each of the first blades 12A in the same cross-section (Blade Length L2a<Blade Length L1a).

Note here that the ratio of the inside diameter to the outside diameter of the second blades 12B is lower than or equal to 0.7. That is, the plurality of second blades 12B are configured such that the ratio of the inside diameter ID2 constituted by the inner circumferential end 14B of each of the plurality of second blades 12B to the outside diameter OD2 constituted by the outer circumferential end 15B of each of the plurality of second blades 12B is lower than or equal to 0.7.

Meanwhile, let it be assumed that as shown in FIG. 13, in the second cross-section closer to the rim 13 than the middle point MP shown in FIG. 11, the diameter of a circle C7 passing through the inner circumferential ends 14A of the first blades 12A about the rotation shaft RS is an inside diameter ID3. The inside diameter ID3 is larger than the inside diameter ID1 of the first cross-section (Inside Diameter ID3>Inside Diameter ID1). Let it be assumed that the diameter of a circle C8 passing through the outer circumferential ends 15A of the first blades 12A about the rotation shaft RS is an outside diameter OD3. One-half of the difference between the outside diameter OD3 and the inside diameter ID1 is equal to the blade length Lib of each of the first blades 12A in the second cross-section (Blade Length L1b=(Outside Diameter OD3−Inside Diameter ID3)/2).

Further, let it be assumed that in the second cross-section, the diameter of the circle C7 passing through the inner circumferential ends 14B of the second blades 12B about the rotation shaft RS is an inside diameter ID4. The inside diameter ID4 is equal to the inside diameter ID3 in the same cross-section (Inside Diameter ID4=Inside Diameter ID3). Let it be assumed that the diameter of the circle C8 passing through the outer circumferential ends 15B of the second blades 12B about the rotation shaft RS is an outside diameter OD4. The outside diameter OD4 is equal to the outside diameter OD3 in the same cross-section (Outside Diameter OD4=Outside Diameter OD3). One-half of the difference between the outside diameter OD4 and the inside diameter ID4 is equal to the blade length L2b of each of the second blades 12B in the second cross-section (Blade Length L2b=(Outside Diameter OD4−Inside Diameter ID4)/2). The blade length L2b of each of the second blades 12B in the second cross-section is equal to the blade length L1b of each of the first blades 12A in the same cross-section (Blade Length L2b=Blade Length L1b).

When viewed from an angle parallel with the rotation shaft RS, the first blades 12A in the second cross-section shown in FIG. 13 overlap the first blades 12A in the first cross-section shown in FIG. 12 so as not to extend off the contours of the first blades 12A. For this reason, the impeller 10 satisfies the relationships "Outside Diameter OD3=Outside Diameter OD1", "Inside Diameter ID3≥Inside Diameter ID1", and "Blade Length L1b≤Blade Length L1a".

Similarly, when viewed from an angle parallel with the rotation shaft RS, the second blades 12B in the second cross-section shown in FIG. 13 overlap the second blades 12B in the first cross-section shown in FIG. 12 so as not to extend off the contours of the second blades 12B. For this reason, the impeller 10 satisfies the relationships "Outside Diameter OD4=Outside Diameter OD2", "Inside Diameter ID4≥Inside Diameter ID2", and "Blade Length L2b≤Blade Length L2a".

Note here that as mentioned above, the ratio of the inside diameter ID1 to the outside diameter OD1 of the first blades 12A is lower than or equal to 0.7. Since the blades 12 are configured such that Inside Diameter ID3≥Inside Diameter ID1, Inside Diameter ID4≥Inside Diameter ID2, and Inside Diameter ID2≥Inside Diameter ID1, the inside diameter of the first blades 12A can be the blade inside diameter of the blades 12. Further, since the blades 12 are configured such that Outside Diameter OD3=Outside Diameter OD1, Outside Diameter OD4=Outside Diameter OD2, and Outside Diameter OD2=Outside Diameter OD1, the outside diameter of the first blades 12A can be the blade outside diameter of the blades 12. Moreover, in a case in which the blades 12 constituting the impeller 10 are seen as a whole, the blades 12 are configured such that the ratio of the blade inside diameter to the blade outside diameter of the blades 12 is lower than or equal to 0.7.

It should be noted that the blade inside diameter of the plurality of blades 12 is constituted by the inner circumferential end of each of the plurality of blades 12. That is, the blade inside diameter of the plurality of blades 12 is constituted by the leading edges 14A1 of the plurality of blades 12. Further, the blade outside diameter of the plurality of blades 12 is constituted by the outer circumferential end of each of the plurality of blade 12. That is, the blade outside diameter of the plurality of blades 12 is constituted by the trailing edges 15A1 and 15B1 of the plurality of blades 12.

(Configuration of First Blades 12A and Second Blades 12B)

In a comparison between the first cross-section shown in FIG. 12 and the second cross-section shown in FIG. 13, each of the first blades 12A has the relationship "Blade Length L1a>Blade Length L1b". That is, each of the plurality of blades 12 is formed such that a blade length in the first region is longer than a blade length in the second region. More specifically, each of the first blades 12A is formed such that its blade length decreases from the back plate 11 toward the rim 13 in the axial direction of the rotation shaft RS.

Similarly, in a comparison between the first cross-section shown in FIG. 12 and the second cross-section shown in FIG. 13, each of the second blades 12B has the relationship "Blade Length L2a>Blade Length L2b". That is, each of the second blades 12B is formed such that the blade length decreases from the back plate 11 toward the rim 13 in the axial direction of the rotation shaft RS.

As shown in FIG. 3, the leading edges of the first blades 12A and the second blades 12B are inclined such that the blade inside diameter increases from the back plate 11 toward the rim 13. That is, the plurality of blades 12 are formed such that the blade inside diameter increases from the back plate 11 toward the rim 13, and form an inclined portion 141A inclined such that the inner circumferential ends 14A constituting the leading edges 14A1 extend away from the rotation shaft RS. Similarly, the plurality of blades 12 are formed such that the blade inside diameter increases from the back plate 11 toward the rim 13, and form an inclined portion 141B inclined such that the inner circumferential ends 14B constituting the leading edges 14B1 extend away from the rotation shaft RS.

(Sirocco Blade Portion and Turbo Blade Portion)

As shown in FIGS. 12 and 13, each of the first blades 12A has a first sirocco blade portion 12A1 being forward-swept and including the outer circumferential end 15A and a first turbo blade portion 12A2 being swept-back and including the inner circumferential end 14A. In the radial direction of the impeller 10, the first sirocco blade portion 12A1 constitutes an outer circumference of the first blade 12A, and the first turbo blade portion 12A2 constitutes an inner circumference of the first blade 12A. That is, each of the first blades 12A is configured such that the first turbo blade portion 12A2 and the first sirocco blade portion 12A1 are arranged in this order from the rotation shaft RS toward the outer circumference in the radial direction of the impeller 10.

In each of the first blades 12A, the first turbo blade portion 12A2 and the first sirocco blade portion 12A1 are integrally formed. The first turbo blade portion 12A2 constitutes the leading edge 14A1 of the first blade 12A, and the first sirocco blade portion 12A1 constitutes the trailing edge 15A1 of the first blade 12A. In the radial direction of the impeller 10, the first turbo blade portion 12A2 linearly extends from the inner circumferential end 14A constituting the leading edge 14A1 toward the outer circumference.

In the radial direction of the impeller 10, a region constituting the first sirocco blade portion 12A1 of each of the first blades 12A is defined as a first sirocco region 12A11, and a region constituting the first turbo blade portion 12A2 of each of the first blades 12A is defined as a first turbo region 12A21. Each of the first blades 12A is configured such that the first turbo region 12A21 is larger than the first sirocco region 12A11 in the radial direction of the impeller 10.

In both the back-plate-side blade region 122*a* serving as the first region and the rim-side blade region 122*b* serving as the second region, the impeller 10 has the relationship "First Sirocco Region 12A11<First Turbo Region 12A21" in the radial direction of the impeller 10. The impeller 10 and each of the first blades 12A are configured such that in both the back-plate-side blade region 122*a* serving as the first region and the rim-side blade region 122*b* serving as the second region, a ratio of the first turbo blade portion 12A2 is larger than a ratio of the first sirocco blade portion 12A1 in the radial direction of the impeller 10.

Similarly, as shown in FIGS. 12 and 13, each of the second blades 12B has a second sirocco blade portion 12B1 being forward-swept and including the outer circumferential end 15B and a second turbo blade portion 12B2 being swept-back and including the inner circumferential end 14B. In the radial direction of the impeller 10, the second sirocco blade portion 12B1 constitutes an outer circumference of the second blade 12B, and the second turbo blade portion 12B2 constitutes an inner circumference of the second blade 12B. That is, each of the second blades 12B is configured such that the second turbo blade portion 12B2 and the second sirocco blade portion 12B1 are arranged in this order from the rotation shaft RS toward the outer circumference in the radial direction of the impeller 10.

In each of the second blades 12B, the second turbo blade portion 12B2 and the second sirocco blade portion 12B1 are integrally formed. The second turbo blade portion 12B2 constitutes the leading edge 14B1 of the second blade 12B, and the second sirocco blade portion 12B1 constitutes the trailing edge 15B1 of the second blade 12B. In the radial direction of the impeller 10, the second turbo blade portion 12B2 linearly extends from the inner circumferential end 14B constituting the leading edge 14B1 toward the outer circumference.

In the radial direction of the impeller 10, a region constituting the second sirocco blade portion 12B1 of each of the second blades 12B is defined as a second sirocco region 12B11, and a region constituting the second turbo blade portion 12B2 of each of the second blades 12B is defined as a second turbo region 12B21. Each of the second blades 12B is configured such that the second turbo region 12B21 is larger than the second sirocco region 12B11 in the radial direction of the impeller 10.

In both the back-plate-side blade region 122*a* serving as the first region and the rim-side blade region 122*b* serving as the second region, the impeller 10 has the relationship "Second Sirocco Region 12B11<Second Turbo Region 12B21" in the radial direction of the impeller 10. The impeller 10 and each of the second blades 12B are configured such that in both the back-plate-side blade region 122*a* serving as the first region and the rim-side blade region 122*b* serving as the second region, a ratio of the second turbo blade portion 12B2 is larger than a ratio of the second sirocco blade portion 12B1 in the radial direction of the impeller 10.

According to the foregoing configuration, the plurality of blades 12 are configured such that in both the back-plate-side blade region 122*a* and the rim-side blade region 122*b*, a region of a turbo blade portion is larger than a region of a sirocco blade portion in the radial direction of the impeller 10. That is, the plurality of blades 12 are configured such that in both the back-plate-side blade region 122*a* and the rim-side blade region 122*b*, a ratio of the turbo blade portion is larger than a ratio of the sirocco blade portion in the radial direction of the impeller 10, and have the relationship "Sirocco Region<Turbo Region". In other words, each of the plurality of blades 12 is configured such that in the first region and the second region, a ratio of the turbo blade portion in the radial direction is larger than a ratio of the sirocco blade portion in the radial direction.

The plurality of blades 12 are not limited to being configured such that in both the back-plate-side blade region 122*a* and the rim-side blade region 122*b*, a ratio of the turbo blade portion is larger than a ratio of the sirocco blade portion in the radial direction of the impeller 10, or to having the relationship "Sirocco Region<Turbo Region". Each of the plurality of blades 12 may be configured such that in the first region and the second region, a ratio of the turbo blade portion in the radial direction is equal to or smaller than a ratio of the sirocco blade portion in the radial direction.

(Blade Outlet Angle)

Let it be assumed that as shown in FIG. 12, a blade outlet angle of the first sirocco blade portion 12A1 of each of the first blades 12A in the first cross-section is a blade outlet angle $\alpha 1$. The blade outlet angle $\alpha 1$ is defined as an angle formed by a tangent line TL1 and a center line CL1 of the first sirocco blade portion 12A1 at the outer circumferential end 15A at an intersection of a segment of the circle C3 about the rotation shaft RS and the outer circumferential end 15A. This blade outlet angle $\alpha 1$ is an angle of larger than 90 degrees.

Let it be assumed that a blade outlet angle of the second sirocco blade portion 12B1 of each of the second blades 12B in the same cross-section is a blade outlet angle $\alpha 2$. The blade outlet angle $\alpha 2$ is defined as an angle formed by a tangent line TL2 and a center line CL2 of the second sirocco blade portion 12B1 at the outer circumferential end 15B at an intersection of a segment of the circle C3 about the rotation shaft RS and the outer circumferential end 15B. The blade outlet angle $\alpha 2$ is an angle of larger than 90 degrees.

The blade outlet angle $\alpha 2$ of the second sirocco blade portion 12B1 is equal to the blade outlet angle $\alpha 1$ of the first sirocco blade portion 12A1 (Blade Outlet Angle $\alpha 2$=Blade Outlet Angle $\alpha 1$). The first sirocco blade portion 12A1 and the second sirocco blade portion 12B1 are formed in arcs to curve out in a direction opposite to the direction of rotation R when viewed from an angle parallel with the rotation shaft RS.

As shown in FIG. 13, the impeller 10 is configured such that in the second cross-section, too, the blade outlet angle $\alpha 1$ of the first sirocco blade portion 12A1 and the blade outlet angle $\alpha 2$ of the second sirocco blade portion 12B1 are equal to each other. That is, each of the plurality of blades 12 has a sirocco blade portion being forward-swept and extending from the back plate 11 to the rim 13 and having a blade outlet angle of larger than 90 degrees.

Further, let it be assumed that as shown in FIG. 12, a blade outlet angle of the first turbo blade portion 12A2 of each of the first blades 12A in the first cross-section is a blade outlet angle $\beta 1$. The blade outlet angle $\beta 1$ is defined as an angle formed by a tangent line TL3 and a center line CL3 of the first turbo blade portion 12A2 at an intersection of a segment of a circle C4 about the rotation shaft RS and the first turbo blade portion 12A2. This blade outlet angle $\beta 1$ is an angle of smaller than 90 degrees.

Let it be assumed that a blade outlet angle of the second turbo blade portion 12B2 of each of the second blades 12B in the same cross-section is a blade outlet angle $\beta 2$. The blade outlet angle $\beta 2$ is defined as an angle formed by a tangent line TL4 and a center line CL4 of the second turbo blade portion 12B2 at an intersection of a segment of the circle C4 about the rotation shaft RS and the second turbo blade portion 12B2. The blade outlet angle $\beta 2$ is an angle of smaller than 90 degrees.

The blade outlet angle $\beta 2$ of the second turbo blade portion 12B2 is equal to the blade outlet angle $\beta 1$ of the first turbo blade portion 12A2 (Blade Outlet Angle $\beta 2$=Blade Outlet Angle $\beta 1$).

Although not illustrated in FIG. 13, the impeller 10 is configured such that in the second cross-section, too, the blade outlet angle $\beta 1$ of the first turbo blade portion 12A2 and the blade outlet angle $\beta 2$ of the second turbo blade portion 12B2 are equal to each other. Further, the blade outlet angle β1 and the blade outlet angle β2 are angles of smaller than 90 degrees.

(Radial Blade Portion)

As shown in FIGS. 12 and 13, each of the first blades 12A has a first radial blade portion 12A3 serving as a portion of connection between the first turbo blade portion 12A2 and the first sirocco blade portion 12A1. The first radial blade portion 12A3 is a portion configured to be a radial blade linearly extending in the radial direction of the impeller 10.

Similarly, each of the second blades 12B has a second radial blade portion 12B3 serving as a portion of connection between the second turbo blade portion 12B2 and the second sirocco blade portion 12B1. The second radial blade portion 12B3 is a portion configured to be a radial blade linearly extending in the radial direction of the impeller 10.

The first radial blade portion 12A3 and the second radial blade portion 12B3 each have a blade angle of 90 degrees. More specifically, an angle formed by a tangent line at an intersection of a center line of the first radial blade portion 12A3 and a circle C5 about the rotation shaft RS and the center line of the first radial blade portion 12A3 is 90 degrees. Further, an angle formed by a tangent line at an intersection of a center line of the second radial blade portion 12B3 and the circle C5 about the rotation shaft RS and the center line of the second radial blade portion 12B3 is 90 degrees.

(Inter-Blade Distance)

When a spacing between two of the plurality of blades 12 adjacent to each other along the circumferential direction is defined as an inter-blade distance, the inter-blade distance between a plurality of blades 12 widens from the leading edges 14A1 toward the trailing edges 15A1 as shown in FIGS. 12 and 13. Similarly, the inter-blade distance between a plurality of blades 12 widens from the leading edges 14B1 toward the trailing edges 15B1.

Specifically, an inter-blade distance in the turbo blade portion constituted by the first turbo blade portion 12A2 and the second turbo blade portion 12B2 widens from the inner circumference toward the outer circumference. Moreover, an inter-blade distance in a sirocco blade portion constituted by a first sirocco blade portion 12A1 and a second sirocco blade portion 12B1 is wider than the inter-blade distance in the turbo blade portion and widens from the inner circumference toward the outer circumference.

That is, an inter-blade distance between a first turbo blade portion 12A2 and a second turbo blade portion 12B2 or an inter-blade distance between adjacent second turbo blade portions 12B2 widens from the inner circumference toward the outer circumference. Further, an inter-blade distance between a first sirocco blade portion 12A1 and a second sirocco blade portion 12B1 or an inter-blade distance between adjacent second sirocco blade portions 12B1 is wider than the inter-blade distance in the turbo blade portion and widens from the inner circumference toward the outer circumference.

(Relationship Between Impeller 10 and Scroll Casing 40)

Figure 14:
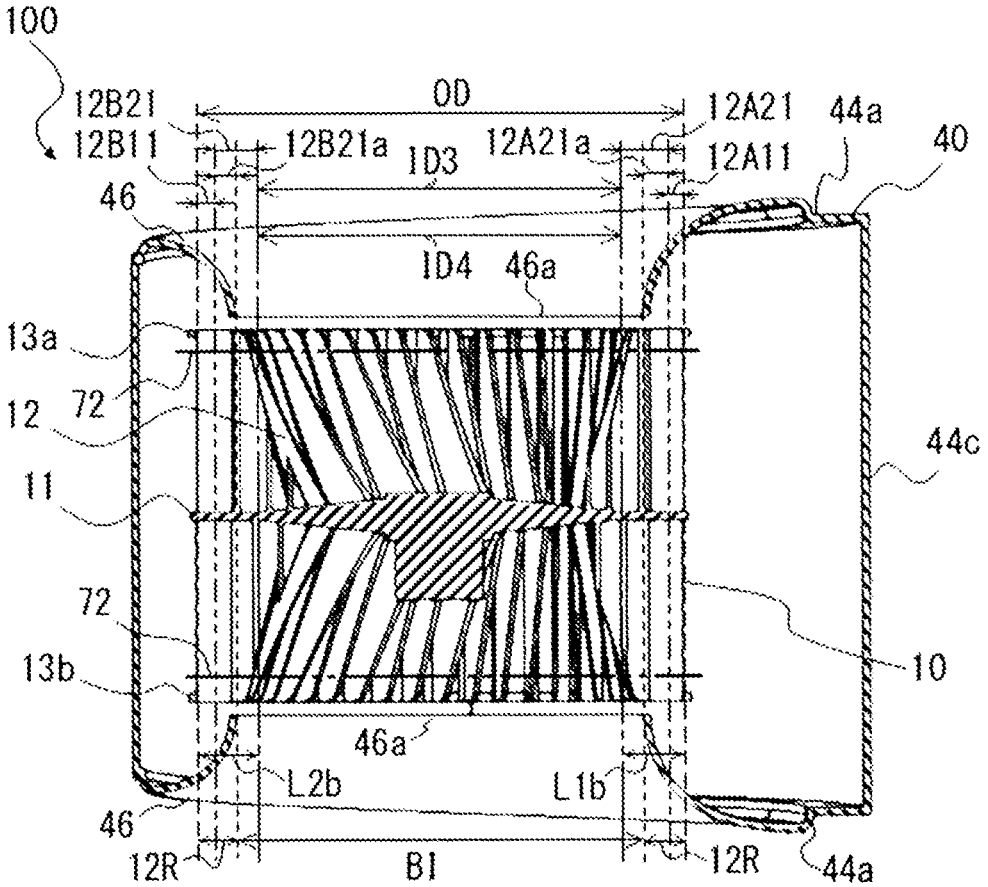
FIG. 14 is a schematic view showing a relationship between the impeller and bellmouths in a cross-section of the multi-blade air-sending device as taken along line A-A in FIG. 2.
Figure 15:
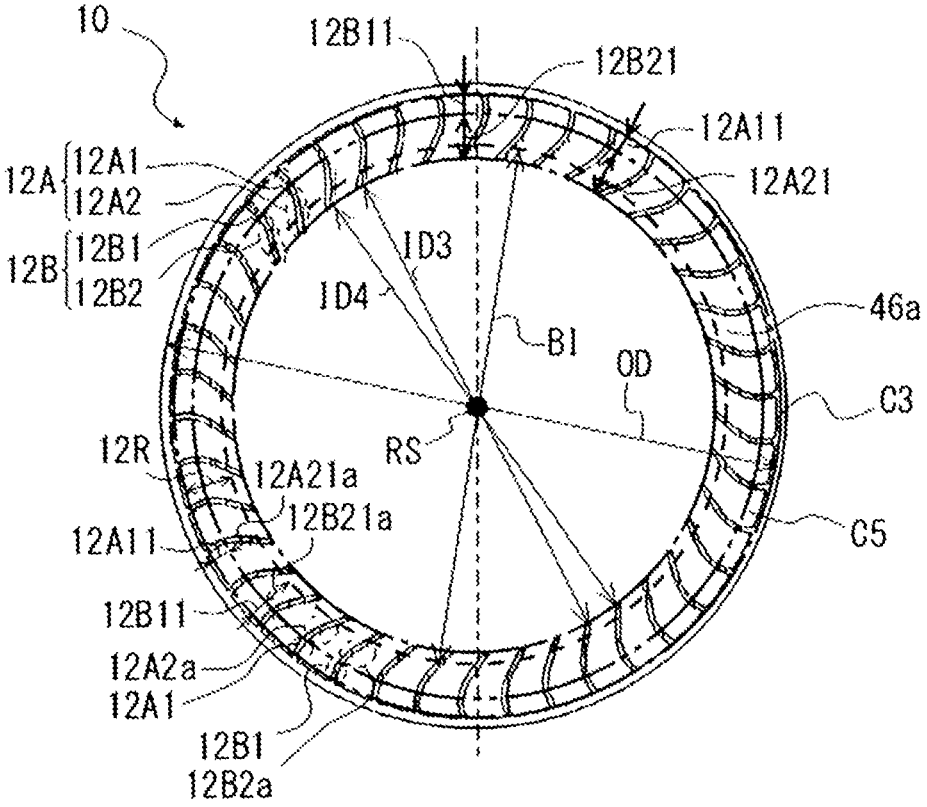
FIG. 15 is a schematic view showing a relationship between the blades and a bellmouth in a second cross-section of the impeller as viewed from an angle parallel with the rotation shaft in the impeller in FIG. 14.

FIG. 14 is a schematic view showing a relationship between the impeller 10 and bellmouths 46 in a cross-section of the multi-blade air-sending device 100 as taken along line A-A in FIG. 2. FIG. 15 is a schematic view showing a relationship between blades 12 and a bellmouth 46 as viewed from an angle parallel with the rotation shaft RS in a second cross-section of the impeller 10 in FIG. 14.

As shown in FIGS. 14 and 15, a blade outside diameter OD constituted by the outer circumferential end of each of the plurality of blades 12 is larger than the inside diameter BI of a bellmouth 46 constituting the scroll casing 40. It should be noted that the blade outside diameter OD of the plurality of blades 12 is equal to the outside diameters OD1 and OD2 of the first blades 12A and the outside diameter OD3 and OD4 of the second blades 12B (Blade Outside Diameter OD=Outside Diameter OD1=Outside Diameter OD2=Outside Diameter OD3=Outside Diameter OD4).

The impeller 10 is configured such that the first turbo region 12A21 is larger than the first sirocco region 12A11 in the radial direction with respect to the rotation shaft RS. That is, the impeller 10 and each of the first blades 12A are configured such that the ratio of the first turbo blade portion 12A2 is larger than the ratio of the first sirocco blade portion 12A1 in the radial direction with respect to the rotation shaft RS, and have the relationship "First Sirocco Blade Portion 12A1<First Turbo Blade Portion 12A2". The relationship between the ratio of the first sirocco blade portion 12A1 and the ratio of the first turbo blade portion 12A2 in the radial direction of the rotation shaft RS holds in both the back-plate-side blade region 122*a* serving as the first region and the rim-side blade region 122*b* serving as the second region.

It should be noted that the impeller 10 and each of the first blades 12A are not limited to being configured such that the ratio of the first turbo blade portion 12A2 is larger than the ratio of the first sirocco blade portion 12A1 in the radial direction with respect to the rotation shaft RS, or to having the relationship "First Sirocco Blade Portion 12A1<First Turbo Blade Portion 12A2". The impeller 10 and each of the first blades 12A may be formed such that the ratio of the first turbo blade portion 12A2 is equal to or smaller than the ratio of the first sirocco blade portion 12A1 in the radial direction with respect to the rotation shaft RS.

Furthermore, a region of portions of the plurality of blades 12 situated closer to the outer circumference than the inside diameter BI of the bellmouth 46 in the radial direction with respect to the rotation shaft RS when viewed from an angle parallel with the rotation shaft RS is defined as an outer circumferential region 12R. It is desirable that the impeller 10 be configured such that in the outer circumferential region 12R, too, the ratio of the first turbo blade portion 12A2 is larger than the ratio of the first sirocco blade portion 12A1. That is, in the outer circumferential region 12R of the impeller 10 situated closer to the outer circumference than the inside diameter BI of the bellmouth 46 when viewed from an angle parallel with the rotation shaft RS, a first turbo region 12A21*a* is larger than the first sirocco region 12A11 in the radial direction with respect to the rotation shaft RS.

The first turbo region 12A21*a* is a region of the first turbo region 12A21 situated closer to the outer circumference than the inside diameter BI of the bellmouth 46 when viewed from an angle parallel with the rotation shaft RS. Moreover, in a case in which a first turbo blade portion 12A2 constituting the first turbo region 12A21*a* is a first turbo blade portion 12A2*a*, it is desirable that the outer circumferential region 12R of the impeller 10 be configured such that a ratio of the first turbo blade portion 12A2*a* is larger than the ratio of the first sirocco blade portion 12A1. The relationship between the ratio of the first sirocco blade portion 12A1 and the ratio of the first turbo blade portion 12A2*a* in the outer circumferential region 12R holds in both the back-plate-side blade region 122*a* serving as the first region and the rim-side blade region 122*b* serving as the second region.

Similarly, the impeller 10 is configured such that the second turbo region 12B21 is larger than the second sirocco region 12B11 in the radial direction with respect to the rotation shaft RS. That is, the impeller 10 and each of the second blades 12B are configured such that the ratio of the second turbo blade portion 12B2 is larger than the ratio of the second sirocco blade portion 12B1 in the radial direction with respect to the rotation shaft RS, and have the relationship "Second Sirocco Blade Portion 12B1<Second Turbo Blade Portion 12B2". The relationship between the ratio of the second sirocco blade portion 12B1 and the ratio of the second turbo blade portion 12B2 in the radial direction of the rotation shaft RS holds in both the back-plate-side blade region 122*a* serving as the first region and the rim-side blade region 122*b* serving as the second region.

It should be noted that the impeller 10 and each of the second blades 12B are not limited to being configured such that the ratio of the second turbo blade portion 12B2 is larger than the ratio of the second sirocco blade portion 12B1 in the radial direction with respect to the rotation shaft RS, or to having the relationship "Second Sirocco Blade Portion 12B1<Second Turbo Blade Portion 12B2". The impeller 10 and each of the second blades 12B may be formed such that the ratio of the second turbo blade portion 12B2 is equal to or smaller than the ratio of the second sirocco blade portion 12B1 in the radial direction with respect to the rotation shaft RS.

Furthermore, it is desirable that the impeller 10 be configured such that in the outer circumferential region 12R, too, the ratio of the second turbo blade portion 12B2 is larger than the ratio of the second sirocco blade portion 12B1. That is, in the outer circumferential region 12R of the impeller 10 situated closer to the outer circumference than the inside diameter BI of the bellmouth 46 when viewed from an angle parallel with the rotation shaft RS, a second turbo region 12B21*a* is larger than the second sirocco region 12B11 in the radial direction with respect to the rotation shaft RS.

The second turbo region 12B21*a* is a region of the second turbo region 12B21 situated closer to the outer circumference than the inside diameter BI of the bellmouth 46 when viewed from an angle parallel with the rotation shaft RS. Moreover, in a case in which a second turbo blade portion 12B2 constituting the second turbo region 12B21*a* is a second turbo blade portion 12B2*a*, it is desirable that the outer circumferential region 12R of the impeller 10 be configured such that a ratio of the second turbo blade portion 12B2*a* is larger than the ratio of the second sirocco blade portion 12B1. The relationship between the ratio of the second sirocco blade portion 12B1 and the ratio of the second turbo blade portion 12B2*a* in the outer circumferential region 12R holds in both the back-plate-side blade region 122*a* serving as the first region and the rim-side blade region 122*b* serving as the second region.

Figure 16:
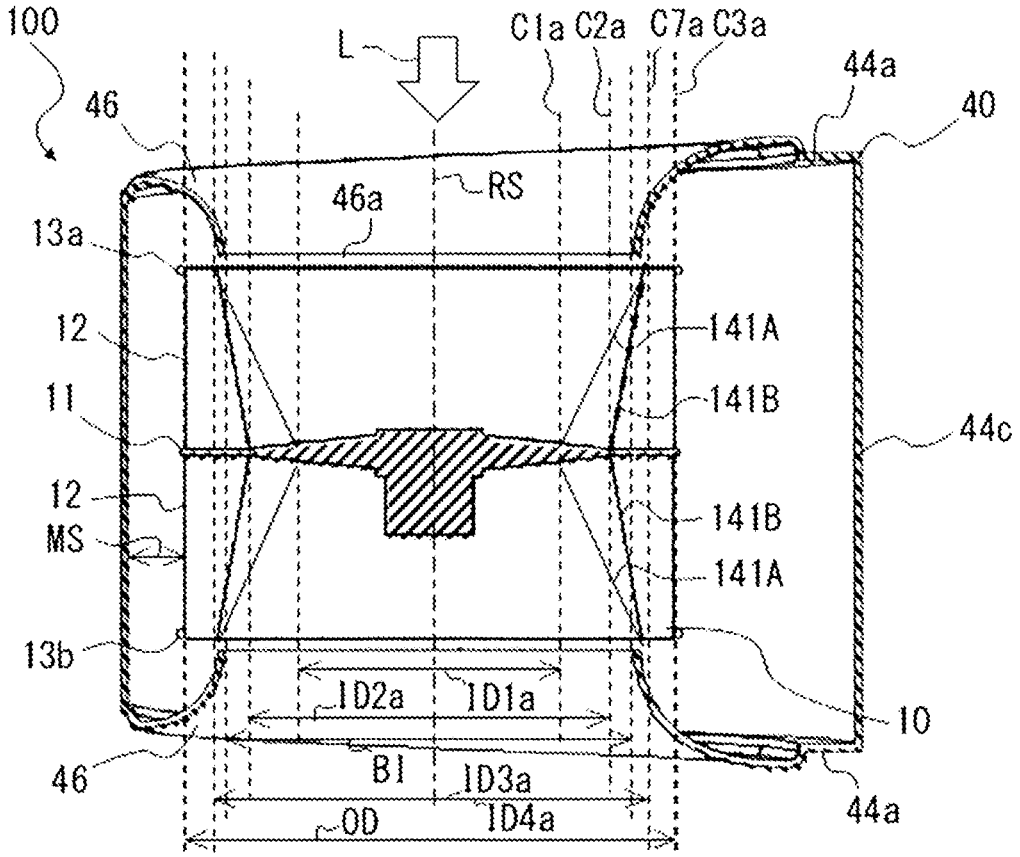
FIG. 16 is a schematic view showing a relationship between the impeller and the bellmouths in the cross-section of the multi-blade air-sending device as taken along line A-A in FIG. 2.
Figure 17:
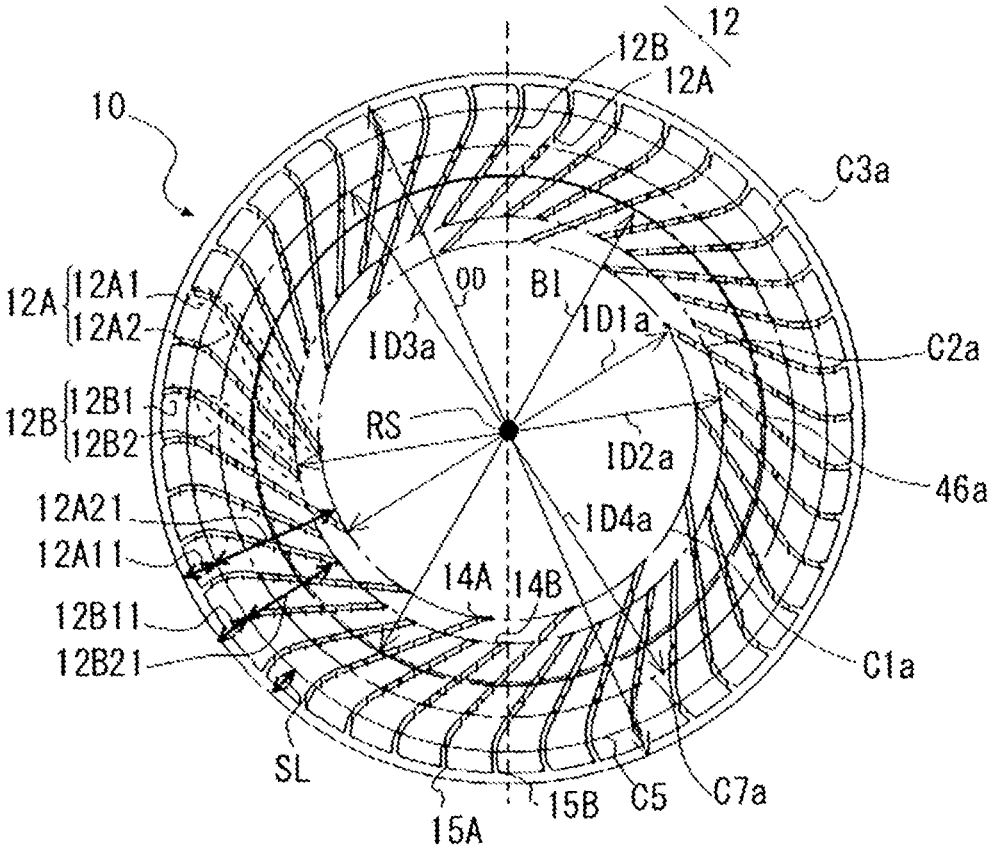
FIG. 17 is a schematic view showing a relationship between the blades and a bellmouth as viewed from an angle parallel with the rotation shaft in the impeller in FIG. 16.

FIG. 16 is a schematic view showing a relationship between the impeller 10 and the bellmouths 46 in the cross-section of the multi-blade air-sending device 100 as taken along line A-A in FIG. 2. FIG. 17 is a schematic view showing a relationship between the blades 12 and a bellmouth 46 as viewed from an angle in parallel with the rotation shaft RS in the impeller 10 in FIG. 16. In FIG. 16, the outline arrow L indicates a direction from which the impeller 10 is viewed from an angle parallel with the rotation shaft RS.

As shown in FIGS. 16 and 17, a circle passing through the inner circumferential ends 14A of the plurality of first blades 12A about the rotation shaft RS at connecting locations between the first blades 12A and the back plate 11 when viewed from an angle parallel with the rotation shaft RS is defined as a circle C1a. Moreover, let it be assumed that the diameter of the circle C1a, that is, the inside diameter of the first blades 12A at the connecting locations between the first blades 12A and the back plate 11, is an inside diameter ID1a.

Further, a circle passing through the inner circumferential ends 14B of the plurality of second blades 12B about the rotation shaft RS at connecting locations between the second blades 12B and the back plate 11 when viewed from an angle parallel with the rotation shaft RS is defined as a circle C2a. Moreover, let it be assumed that the diameter of the circle C2a, that is, the inside diameter of the second blades 12B at the connecting locations between the first blades 12A and the back plate 11, is an inside diameter ID2a. The inside diameter ID2a is larger than the inside diameter ID1a (Inside Diameter ID2a>Inside Diameter ID1a).

Further, let it be assumed that the diameter of a circle C3a passing through the outer circumferential ends 15A of the plurality of first blades 12A and the outer circumferential ends 15B of the plurality of second blades 12B about the rotation shaft RS when viewed from an angle parallel with the rotation shaft RS, that is, the outside diameter of the plurality of blades 12, is a blade outside diameter OD.

Further, a circle passing through the inner circumferential ends 14A of the plurality of first blades 12A about the rotation shaft RS at connecting locations between the first blades 12A and the rim 13 when viewed from an angle parallel with the rotation shaft RS is defined as a circle C7a. Moreover, let it be assumed that the diameter of the circle C7a, that is, the inside diameter of the first blades 12A at the connecting locations between the first blades 12A and the rim 13, is an inside diameter ID3a.

Further, a circle passing through the inner circumferential ends 14B of the plurality of second blades 12B about the rotation shaft RS at connecting locations between the second blades 12B and the rim 13 when viewed from an angle parallel with the rotation shaft RS is the circle C7a. Moreover, let it be assumed that the diameter of the circle C7a, that is, the inside diameter of the second blades 12B at the connecting locations between the second blades 12B and the rim 13, is an inside diameter ID4a.

As shown in FIGS. 16 and 17, the inside diameter BI of the bellmouth 46 is located in a region of the first turbo blade portions 12A2 and the second turbo blade portions 12B2 between the inside diameter ID1a of the first blades 12A beside the back plate 11 and the inside diameter ID3a of the first blades 12A beside the rim 13 when viewed from an angle parallel with the rotation shaft RS. More specifically, the inside diameter BI of the bellmouth 46 is larger than the inside diameter ID1a of the first blades 12A beside the back plate 11 and smaller than the inside diameter ID3a of the first blades 12A beside the rim 13.

That is, the inside diameter BI of the bellmouth 46 is larger than the blade inside diameter of the plurality of blades 12 beside the back plate 11 and smaller than the blade inside diameter of the plurality of blades 12 beside the rim 13. In other words, an opening 46*a* forming the inside diameter BI of the bellmouth 46 is located in a region of the first turbo blade portions 12A2 and the second turbo blade portions 12B2 between the circle C1a and the circle C7a when viewed from an angle parallel with the rotation shaft RS.

Further, as shown in FIGS. 16 and 17, the inside diameter BI of the bellmouth 46 is located in a region of the first turbo blade portions 12A2 and the second turbo blade portions 12B2 between the inside diameter ID2a of the second blades 12B beside the back plate 11 and the inside diameter ID4a of the second blades 12B beside the rim 13 when viewed from an angle parallel with the rotation shaft RS. More specifically, the inside diameter BI of the bellmouth 46 is larger than the inside diameter ID2a of the second blades 12B beside the back plate 11 and smaller than the inside diameter ID4a of the second blades 12B beside the rim 13.

That is, the inside diameter BI of the bellmouth 46 is larger than the blade inside diameter of the plurality of blades 12 beside the back plate 11 and smaller than the blade inside diameter of the plurality of blades 12 beside the rim 13. More specifically, the inside diameter BI of the bellmouth 46 is larger than a blade inside diameter constituted by the inner circumferential end of each of the plurality of blades 12 in the first region and smaller than a blade inside diameter constituted by the inner circumferential end of each of the plurality of blades 12 in the second region. In other words, the opening 46*a* forming the inside diameter BI of the bellmouth 46 is located in a region of the first turbo blade portions 12A2 and the second turbo blade portions 12B2 between the circle C2a and the circle C7a when viewed from an angle parallel with the rotation shaft RS.

Let it be assumed that as shown in FIGS. 16 and 17, in the radial direction of the impeller 10, a radial length of each of the first and second sirocco blade portions 12A1 and 12B1 is a distance SL. Further, let it be assumed that in the multi-blade air-sending device 100, the shortest distance between the plurality of blades 12 of the impeller 10 and the peripheral wall 44*c* of the scroll casing 40 is a distance MS. In this case, the multi-blade air-sending device 100 is configured such that the distance MS is more than twice as long as the distance SL (Distance MS>Distance SL×2). Although the distance MS is shown in the A-A section of the multi-blade air-sending device 100 in FIG. 16, the distance MS is the shortest distance from the peripheral wall 44*c* of the scroll casing 40 and is not necessarily shown on the A-A section.

[Working Effects of Impeller 10 and Multi-Blade Air-Sending Device 100]

The back plate 11 includes a first surface portion 11*a* on which the plurality of blades 12 are formed and a second surface portion 11*c* provided at a region between the boss 11*b* and the first surface portion 11*a* and depressed from the first surface portion 11*a* in an axial direction of the rotation shaft RS. Further, the back plate 11 also includes a plurality of projections 20 provided at the second surface portion 11*c* and extending in the axial direction of the rotation shaft RS. While the impeller 10 is rotating, the projections 20 draw in a flow of gas by generating negative pressure on a surface of the impeller 10 facing in a direction opposite to a direction of rotation R of the impeller 10, making it possible to increase the amount of air that is suctioned into the impeller 10. Further, the impeller 10 includes the second surface portion 11*c* depressed from the first surface portion 11*a*, on which the plurality of blades 12 are formed, in the axial direction of the rotation shaft RS, and the projections 20 are provided at the second surface portion 11*c*. This inhibits a flow of gas produced by the projections 20 from flowing from the second surface portion 11*c* into the first surface portion 11*a*. Moreover, the flow of gas produced by the projections 20 has its centrifugally-outward force of wind broken by a step 11*f* between the first surface portion 11*a* and the second surface portion 11*c*, so that the impeller 10 does not suffer from turbulence in the flow of gas on the inner circumference of the blades 12. This allows the impeller 10 to have higher air-sending efficiency than in a case in which the impeller 10 does not include the projections 20 or the second surface portion 11*c*.

Further, the flow of gas produced by the projections 20 has its centrifugally-outward force of wind broken by the step 11*f* between the first surface portion 11*a* and the second surface portion 11*c*, so that the impeller 10 does not suffer from turbulence in the flow of gas on the inner circumference of the blades 12. This allows the impeller 10 to reduce noise caused by turbulence in the flow of gas.

Further, the second surface portion 11*c* is formed in a circular ring shape about the boss 11*b*. This inhibits a flow of gas produced by the projections 20 from flowing from the second surface portion 11*c* into the first surface portion 11*a*. Moreover, the flow of gas produced by the projections 20 has its centrifugally-outward force of wind broken by the step 11*f* between the first surface portion 11*a* and the second surface portion 11*c*, so that the impeller 10 does not suffer from turbulence in the flow of gas on the inner circumference of the blades 12. This allows the impeller 10 to have improved air-sending efficiency. Further, with the second surface portion 11*c* formed in a circular ring shape about the boss 11*b*, the impeller 10 makes it possible to break the centrifugally-outward force of wind at any place along the circumferential direction about the boss 11*b*. Further, since the second surface portion 11*c* is formed in a circular ring shape about the boss 11*b*, the impeller 10 is more easily manufactured than in a case in which the second surface portion 11*c* is complex in structure. Further, since the second surface portion 11*c* is formed in a circular ring shape about the boss 11*b*, the impeller 10 more easily keeps its balance and is more easily manufactured than in a case in which the second surface portion 11*c* is complex in structure.

Further, the length of a depression outside diameter PO constituted by the outer circumferential edge 11*c*1 of the second surface portion 11*c* is greater than the magnitude of a difference PS between an inside diameter ID1 of the blades 12 constituted by an inner circumferential end 14A of each of the plurality of blades 12 and the depression outside diameter PO. Therefore, the impeller 10 can be configured such that the projections 20, which draw in a flow of gas, are formed to extend from the boss 11*b* to the vicinity of the inside diameter of the blades 12 in a radial direction. This results in allowing the impeller 10 to suction a larger amount of air with the projections 20 than in a case in which the impeller 10 does not include the projections 20 and to have improved air-sending efficiency.

The plurality of projections 20 are provided in a radial fashion about the rotation shaft RS, and each of the plurality of projections 20 extends in a radial direction about the rotation shaft RS. While the impeller 10 is rotating, the projections 20 draw in a flow of gas by generating negative pressure on the surface of the impeller 10 facing in a direction opposite to the direction of rotation R of the impeller 10, making it possible to increase the amount of air that is suctioned into the impeller 10. By being formed in this configuration, the plurality of projections 20 make it easier to manufacture the impeller 10 than in a case in which the projections 20 are complex in structure. Further, by being formed in this configuration, the plurality of projections 20 make it easier to keep the balance of the impeller 10 and make it easier to manufacture the impeller 10 than in a case in which the projections 20 are complex in structure.

Further, each of the plurality of projections 20 is formed in the shape of a plate rising from the second surface portion 11*c*. While the impeller 10 is rotating, the projections 20 make it easy to generate negative pressure on the surface of the impeller 10 facing in a direction opposite to the direction of rotation R of the impeller 10 and make it even easier to draw in a flow of gas, thereby making it possible to further increase the amount of air that is suctioned into the impeller 10.

Further, each of the plurality of projections 20 is connected to an outer circumferential wall 11*b*2 of the boss 11*b*.

Since the impeller 10 is configured such that the projections 20 are connected to the boss 11*b*, the strength of the projections 20 can be improved. Further, since the impeller 10 is configured such that the projections 20 are connected to the boss 11*b*, the strength of the impeller 10 can be improved.

Further, a projection outer circumferential end 21 of each of the projections 20 does not project from the first surface portion 11*a* in the axial direction of the rotation shaft RS. Therefore, even when the projections 20 are connected to the step 11*f*, the flow of gas produced by the projections 20 has its centrifugally-outward force of wind broken by the step 11*f* between the first surface portion 11*a* and the second surface portion 11*c*, so that the impeller 10 does not suffer from turbulence in the flow of gas on the inner circumference of the blades 12. This allows the impeller 10 to have higher air-sending efficiency than in a case in which the impeller 10 does not include the projections 20 or the second surface portion 11*c*.

Further, the length of a projection outside diameter QO constituted by the projection outer circumferential end 21 of each of the plurality of projections 20 is greater than the magnitude of a difference QS between the inside diameter ID1 of the blades 12 constituted by the inner circumferential end 14A of each of the plurality of blades 12 and the projection outside diameter QO. Therefore, the impeller 10 can be configured such that the projections 20, which draw in a flow of gas, are formed to extend from the boss 11*b* to the vicinity of the inside diameter of the blades 12 in a radial direction. This results in allowing the impeller 10 to suction a larger amount of air with the projections 20 than in a case in which the impeller 10 does not include the projections 20 and to have improved air-sending efficiency.

Further, each of the plurality of projections 20 includes an inclined portion 26*a* whose ridge line is inclined such that the height of the inclined portion 26*a* in the axial direction of the rotation shaft RS decreases from the inner circumference toward the outer circumference. While the impeller 10 is rotating, the projections 20 draw in a flow of gas by generating negative pressure on the surface of the impeller 10 facing in a direction opposite to the direction of rotation R of the impeller 10, making it possible to increase the amount of air that is suctioned into the impeller 10. In so doing, the impeller 10 is higher in wind speed on the outer circumference than on the inner circumference, and an increase in height of projections 20 on the outer circumference leads to an increase in the amount of a flow of gas that is generated on the outer circumference of the projections 20, which may cause turbulence in the flow of gas on the inner circumference of the blades 12. On the other hand, since the impeller 10 is lower in wind speed on the inner circumference than on the outer circumference, an increase in the amount of a flow of gas that is generated on the inner circumference of the projections 20 does not cause turbulence in the flow of gas by the blades 12. This allows the impeller 10 to suction a further increased amount of a flow of gas and to have improved air-sending efficiency by reducing turbulence in the flow of gas. Further, in a case in which the projections 20 are connected to the boss 11*b*, making the projections 20 higher on the inner circumference than on the outer circumference makes it possible to increase an area of integration of the projections 20 and the boss 11*b*, making it possible to further improve the strength of the impeller 10.

Further, the back plate 11 includes a reinforcing portion 30 provided at the second surface portion 11*c* and extending in the axial direction of the rotation shaft RS, and the reinforcing portion 30 connects the plurality of projections 20 to each other along the circumferential direction. Since the impeller 10 is configured such that the reinforcing portion 30 and the projections 20 are connected to each other, the strength of the projections 20 can be improved. Further, since the impeller 10 is configured such that the reinforcing portion 30 and the projections 20 are connected to each other, the strength of the impeller 10 can be improved. Further, the reinforcing portion 30 makes it possible to reduce wind currents produced by the projections 20 and flowing in the radial direction and break the force of the wind blowing from the boss 11*b* toward the blades 12.

Further, a plurality of the reinforcing portions 30 are provided in the radial direction about the rotation shaft RS. Since the impeller 10 is configured such that the projections 20 and the plurality of reinforcing portions 30 are connected to each other, the strengths of the projections 20 and the impeller 10 can be further improved. Further, the plurality of reinforcing portions 30 make it possible to further reduce wind currents produced by the projections 20 and flowing in the radial direction and further break the force of the wind blowing from the boss 11*b* toward the blades 12. With the second surface portion 11*c* having a wide area in the radial direction, the impeller 10 increases in volume of air that is suctioned into the impeller 10. Narrowing the area of the second surface portion 11*c* in the radial direction by providing the plurality of reinforcing portions 30 allows the impeller 10 to adjust the volume of air that is suctioned into the impeller 10.

Further, the second surface portion 11*c* is constituted by a plate whose thickness is thinner than the thickness of a plate constituting the first surface portion 11*a*. Varying plate thicknesses of the back plate 11 of the impeller 10 make it possible to form the first surface portion 11*a* and the second surface portion 11*c*, making it easier to manufacture the impeller 10 than in a case in which a relationship between the first surface portion 11*a* and the second surface portion 11*c* is complex in structure.

Further, the back plate 11 has its first and second surface portions 11*a* and 11*c* on both plate sides of the back plate 11, and each of the second surface portions 11*c* formed on both plate sides of the back plate 11 includes the plurality of projections 20. This allows the impeller 10 to exert the aforementioned effects not only as a single-suction impeller 10 having a plurality of blades 12 formed only on one side of a back plate 11 but also as a double-suction impeller 10 having a plurality of blades 12 formed on both sides of a back plate 11.

The impeller 10 is configured such that in the first and second regions of the impeller 10, a ratio of the turbo blade portion in the radial direction is larger than a ratio of the sirocco blade portion in the radial direction. Since the impeller 10 is configured such that the ratio of the turbo blade portion is high in any region between the back plate 11 and the rim 13, sufficient pressure recovery can be achieved through the plurality of blades 12. This allows the impeller 10 to better improve pressure recovery than an impeller that does not include such a configuration. This results in allowing the impeller 10 to improve the efficiency of the multi-blade air-sending device 100. Furthermore, by including the foregoing configuration, the impeller 10 can reduce leading edge separation of a flow of gas beside the rim 13.

Further, a multi-blade air-sending device 100 includes the impeller 10 thus configured. The multi-blade air-sending device 100 includes a scroll casing 40 housing the impeller 10 and having a peripheral wall 44*c* formed into a volute shape and a side wall 44*a* having a bellmouth 46 forming an air inlet 45 communicating with a space formed by the back plate 11 and the plurality of blades 12. The multi-blade air-sending device 100 can bring about effects similar to those of the aforementioned impeller 10.

Embodiment 2

[Multi-Blade Air-Sending Device 100B]

Figure 18:
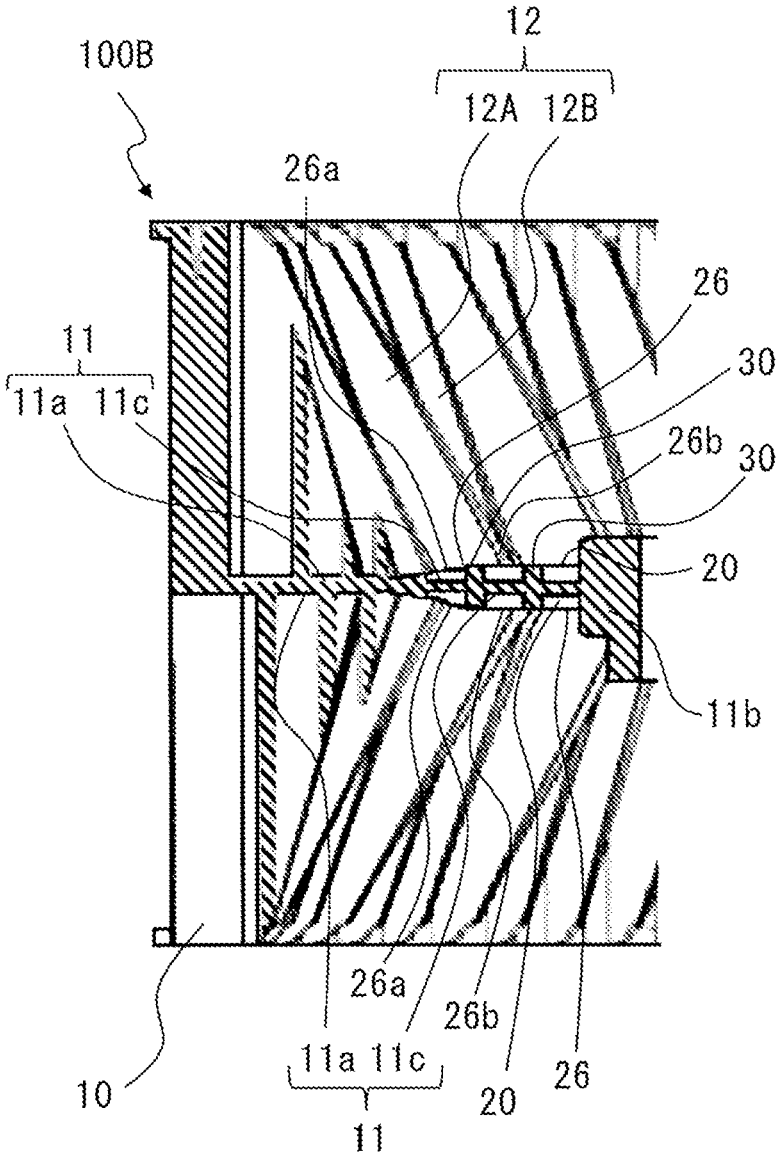
FIG. 18 is a partially-enlarged view of an impeller of a multi-blade air-sending device according to Embodiment 2.
Figure 19:
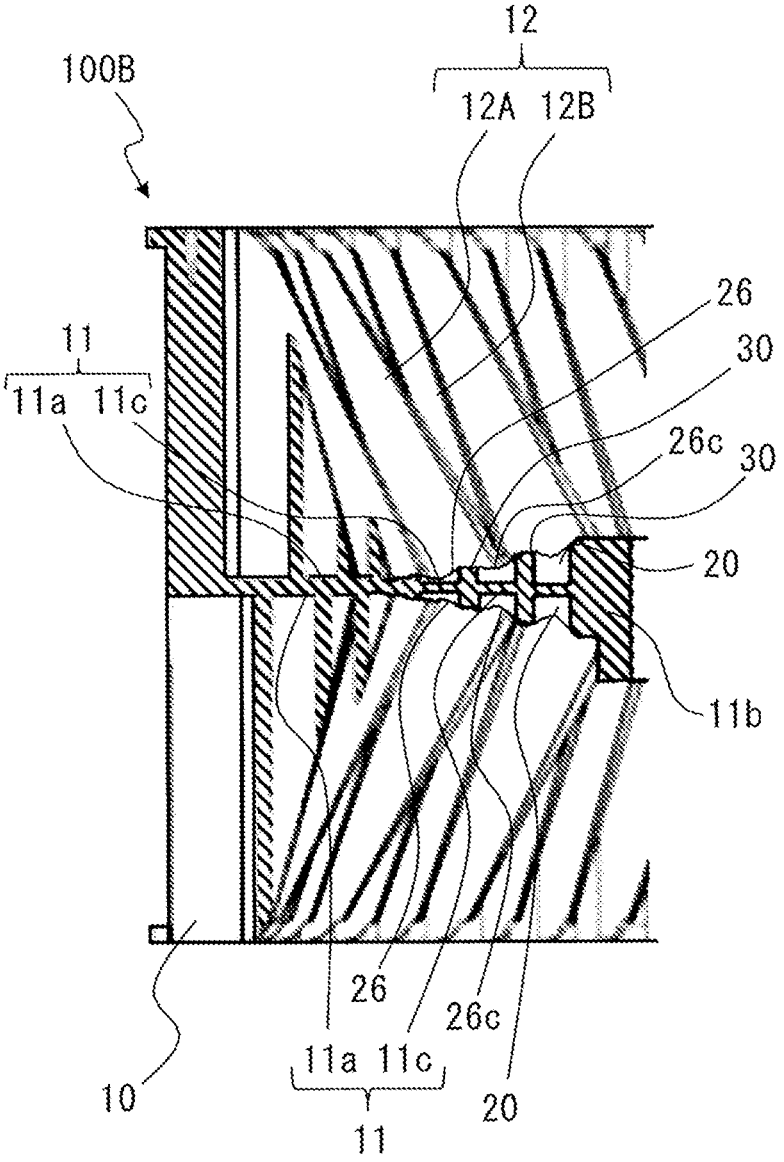
FIG. 19 is a partially-enlarged view of the impeller of the multi-blade air-sending device according to Embodiment 2.

FIG. 18 is a partially-enlarged view of an impeller 10 of a multi-blade air-sending device 100B according to Embodiment 2. FIG. 19 is a partially-enlarged view of the impeller 10 of the multi-blade air-sending device 100B according to Embodiment 2. FIGS. 18 and 19 are different partially-enlarged view of the impeller 10 in a region indicated by part F of FIG. 7. The multi-blade air-sending device 100B according to Embodiment 2 is described with reference to FIGS. 18 and 19. It should be noted that elements having identical configurations as those of the multi-blade air-sending device 100 or other devices of FIGS. 1 to 17 are given identical signs and a description of such elements is omitted. The impeller 10 of the multi-blade air-sending device 100B according to Embodiment 2 is intended to further specify the configuration of the ridge 26. Accordingly, the following description is given with reference to FIGS. 18 and 19 with a focus on the configuration of the ridge 26 of the impeller 10.

While the ridge 26 of each of the projections 20 of the impeller 10 according to Embodiment 1 includes an inclined portion 26*a*, the ridge 26 of each of the projections 20 of the impeller 10 according to Embodiment 2 includes a horizontal portion 26*b* as shown in FIG. 18. The horizontal portion 26*b* is a portion of the ridge 26 whose ridge line is formed parallel with a plane perpendicular to the rotation shaft RS.

Each of the plurality of projections 20 includes a horizontal portion 26*b* having a ridge line constituted by a leading end portion in a direction of projection and extending in a direction perpendicular to the axial direction of the rotation shaft RS in a side view as viewed from the direction perpendicular to the axial direction of the rotation shaft RS. The ridge 26 of each of the projections 20 of the impeller 10 according to Embodiment 2 may be constituted solely by a horizontal portion 26*b* or, as shown in FIG. 18, may include a horizontal portion 26*b* and an inclined portion 26*a*.

The ridge 26 of each of the projections 20 of the impeller 10 according to Embodiment 1 has a ridge line constituted by a leading end portion in a direction of projection and formed in a linear fashion in a side view as viewed from the direction perpendicular to the axial direction of the rotation shaft RS. On the other hand, as shown in FIG. 19, the ridge 26 of each of the projections 20 of the impeller 10 according to Embodiment 2 may include a wavy portion 26*c* having a ridge line constituted by a leading end portion in a direction of projection and formed in a wavelike fashion in a side view as viewed from the direction perpendicular to the axial direction of the rotation shaft RS.

As shown in FIG. 19, each of the plurality of projections 20 includes a wavy portion 26*c*, and is formed such that the height of the projection 20 in the axial direction of the rotation shaft RS decreases from the inner circumference toward the outer circumference. The ridge 26 of the projection 20 may be constituted solely by the wavy portion 26*c* or may have the wavy portion 26*c* as part thereof in a radial direction about the rotation shaft RS. Further, each of the plurality of projections 20 is not limited to being configured to be formed such that the height of the projection 20 in the axial direction of the rotation shaft RS decreases from the inner circumference toward the outer circumference.

[Working Effects of Impeller 10 and Multi-Blade Air-Sending Device 100B]

As mentioned above, while the impeller 10 is rotating, the projections 20 draw in a flow of gas by generating negative pressure on a surface of the impeller 10 facing in a direction opposite to the direction of rotation R of the impeller 10, making it possible to increase the amount of air that is suctioned into the impeller 10. By having a horizontal portion 26*b*, each of the plurality of projections 20 can adjust the area of the projection 20 in a cross-section taken along the radial direction of the impeller 10, and can adjust the volume of air that is suctioned into the impeller 10. This allows the impeller 10 and the multi-blade air-sending device 100B to have improved air-sending efficiency. Further, the plurality of projections 20 include wavy portions 26*c*. The impeller 10 and the multi-blade air-sending device 100B can attenuate vibration, as they can have their strengths increased by the wavy portions 26*c* of the projections 20.

Further, by having a wavy portion 26*c*, each of the plurality of projections 20 can adjust an area to be formed by the projection 20 in a cross-section taken along the radial direction of the impeller 10, and can adjust the volume of air that is suctioned into the impeller 10. This allows the impeller 10 and the multi-blade air-sending device 100B to have improved air-sending efficiency.

Embodiment 3

[Multi-Blade Air-Sending Device 100C]

Figure 20:
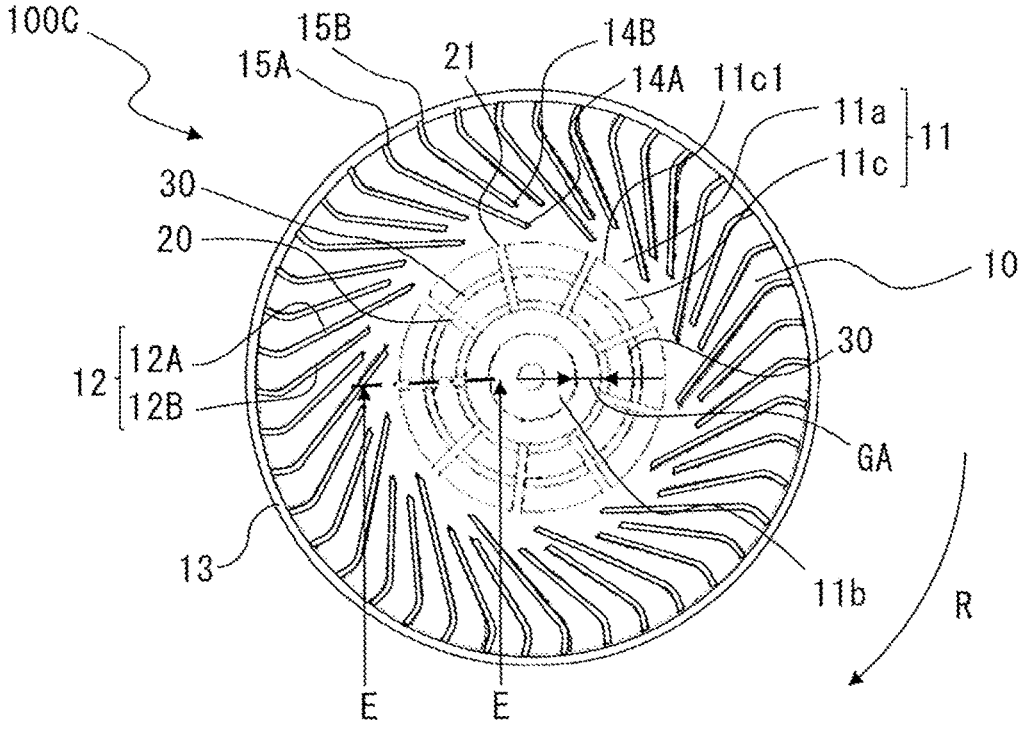
FIG. 20 is a plan view of an impeller of a multi-blade air-sending device according to Embodiment 3.
Figure 21:
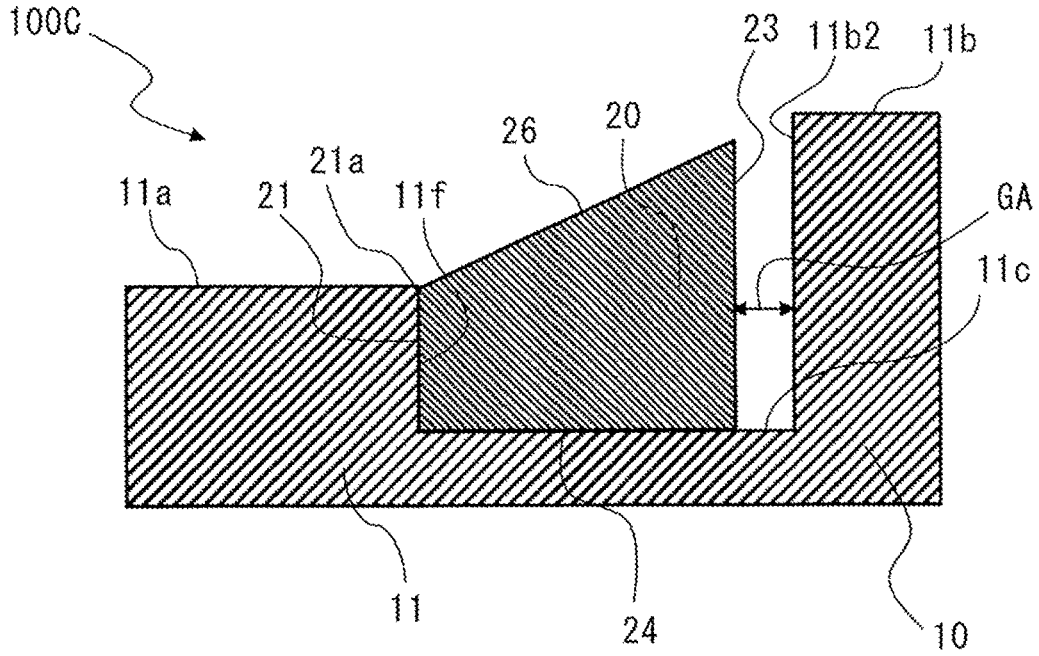
FIG. 21 is a cross-sectional view of the impeller as taken along line E-E in FIG. 20.

FIG. 20 is a plan view of an impeller 10 of a multi-blade air-sending device 100C according to Embodiment 3. FIG. 21 is a cross-sectional view of the impeller 10 as taken along line E-E in FIG. 20. The multi-blade air-sending device 100C according to Embodiment 3 is described with reference to FIGS. 20 and 21. It should be noted that elements having identical configurations as those of the multi-blade air-sending device 100 or other devices of FIGS. 1 to 19 are given identical signs and a description of such elements is omitted. The impeller 10 of the multi-blade air-sending device 100C according to Embodiment 3 is intended to further specify the relationship between the projections 20 and the boss 11*b*. Accordingly, the following description is given with reference to FIGS. 20 and 21 with a focus on the relationship between the projections 20 and the boss 11*b*.

In the impeller 10 according to Embodiment 1, as shown in FIG. 8, each of the plurality of projections 20 is connected to the outer circumferential wall 11*b*2 of the boss 11*b*. On the other hand, in the multi-blade air-sending device 100C according to Embodiment 3, the impeller 10 has a space GA formed between each of the plurality of projections 20 and the outer circumferential wall 11*b*2 of the boss 11*b*. That is, the impeller 10 of the multi-blade air-sending device 100C according to Embodiment 3 has a gap formed between the projection inner circumferential end 23 of the projection 20 and the boss 11*b*. It should be noted that the projection 20 and the boss 11*b* are connected to each other via the back plate 11.

[Working Effects of Impeller 10 and Multi-Blade Air-Sending Device 100C]

The back plate 11 includes a plurality of projections 20 provided at the second surface portion 11*c* and extending in the axial direction of the rotation shaft RS. By including the projections 20, the impeller 10 and the multi-blade air-sending device 100C make it possible to, while the impeller 10 is rotating, draw in a flow of gas by generating negative pressure on a surface of the impeller 10 facing in a direction opposite to a direction of rotation R of the impeller 10 and increase the amount of air that is suctioned into the impeller 10. Since the projections 20 are lower in wind speed on the inner circumference than on the outer circumference, the projections 20 less contributes to the increase in the amount of air that is suctioned into the impeller 10 than on the outer circumference. This allows the impeller 10 and the multi-blade air-sending device 100C to reduce the number of inner circumferential walls of the projections 20, and reducing the number of inner circumferential walls of the projections 20 makes it possible to inhibit the deformation of a shaft portion during molding. Further, by reducing the number of inner circumferential walls of the projections 20, the impeller 10 and the multi-blade air-sending device 100C can reduce necessary cost through material reductions or other reductions.

Embodiment 4

[Multi-Blade Air-Sending Device 100D]

Figure 22:
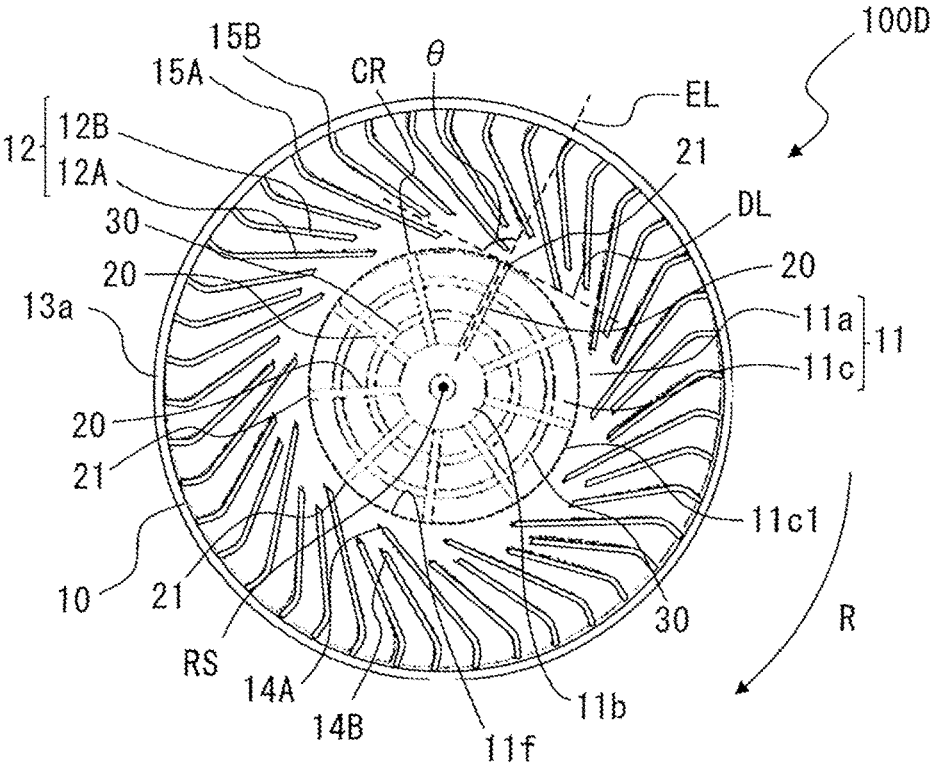
FIG. 22 is a plan view schematically showing an impeller of a multi-blade air-sending device according to Embodiment 4.
Figure 23:
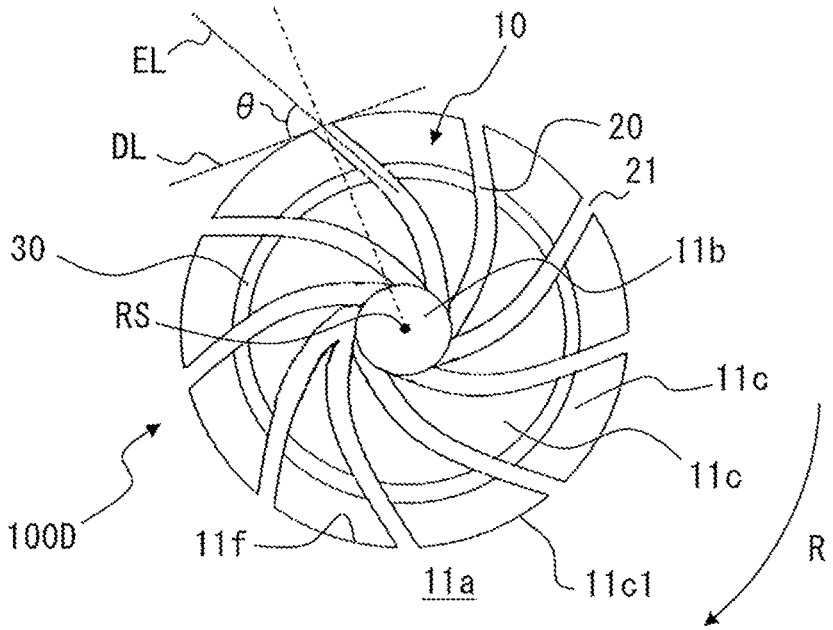
FIG. 23 is a schematic view showing an example of the shape of projections of the impeller of FIG. 22.

FIG. 22 is a plan view schematically showing an impeller 10 of a multi-blade air-sending device 100D according to Embodiment 4. FIG. 23 is a schematic view showing an example of the shape of projections 20 of the impeller 10 of FIG. 22. The multi-blade air-sending device 100D according to Embodiment 4 is described with reference to FIGS. 22 and 23. It should be noted that elements having identical configurations as those of the multi-blade air-sending device 100 or other devices of FIGS. 1 to 21 are given identical signs and a description of such elements is omitted. The multi-blade air-sending device 100D according to Embodiment 4 is intended to further specify the configuration of the projections 20. Accordingly, the following description is given with reference to FIGS. 22 and 23 with a focus on the configuration of the projections 20.

The step 11*f* of the back plate 11 forms the outer circumferential edge 11*c*1 of the second surface portion 11*c*. As shown in FIG. 22, a circle constituted by the outer circumferential edge 11*c*1 of the second surface portion 11*c* about the rotation shaft RS is defined as a circle CR. Moreover, as shown in FIG. 22, an outlet angle of each of the projections 20 is defined as a projection outlet angle θ. The projection outlet angle θ is defined as an angle formed by a tangent line DL and a center line EL of the projection 20 at the projection outer circumferential end 21 at an intersection between a segment of the circle CR about the rotation shaft RS and the projection outer circumferential end 21. Each of the plurality of projections 20 is formed such that a projection outlet angle θ at an outer circumferential end portion is an angle smaller than or equal to 90 degrees. As shown in FIG. 23, the projection 20 extends backward in the direction of rotation R. The projection 20 is formed in an arc to curve out in the direction of rotation R in a plan view as viewed from an angle parallel with the axial direction of the rotation shaft RS.

[Working Effects of Impeller 10 and Multi-Blade Air-Sending Device 100D]

By including the projections 20, the impeller 10 and the multi-blade air-sending device 100D make it possible to, while the impeller 10 is rotating, draw in a flow of gas by generating negative pressure on a surface of the impeller 10 facing in a direction opposite to a direction of rotation R of the impeller 10 and increase the amount of air that is suctioned into the impeller 10. Further, each of the plurality of projections 20 is formed such that a projection outlet angle θ at an outer circumferential end portion is an angle smaller than or equal to 90 degrees. This allows the impeller 10 and the multi-blade air-sending device 100D to have improved air-sending efficiency, as the load on the projections 20 during rotation is reduced.

Embodiment 5

[Multi-Blade Air-Sending Device 100E]

Figure 24:
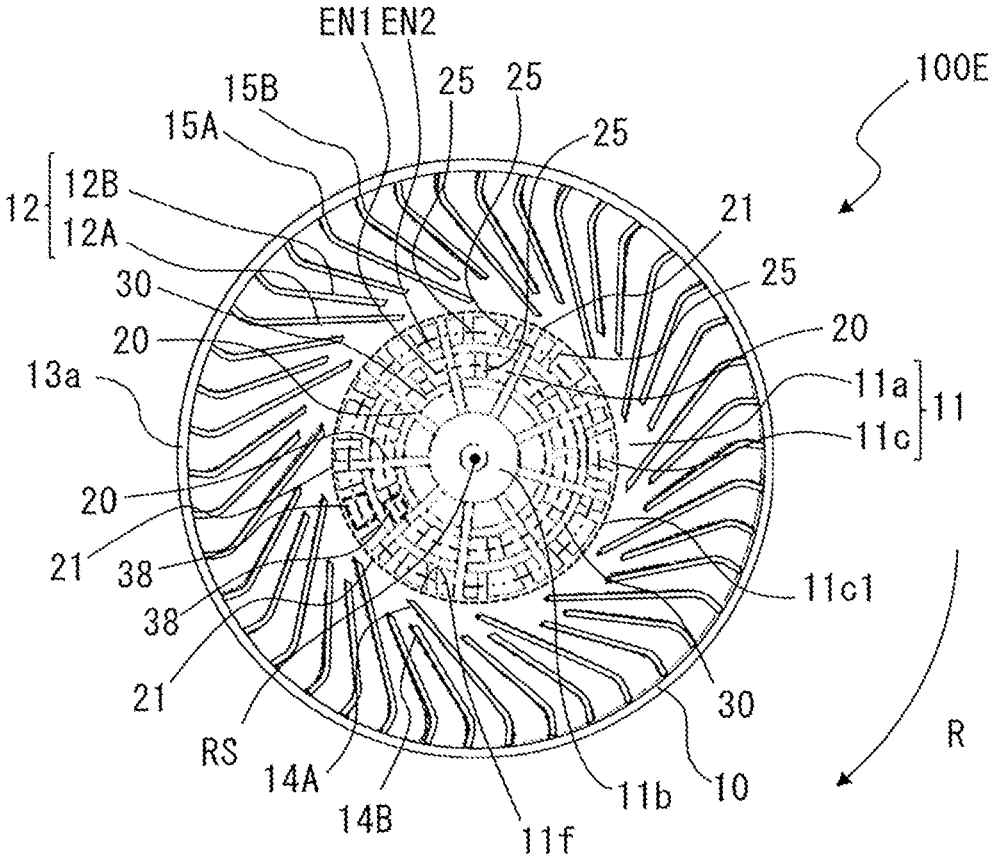
FIG. 24 is a plan view schematically showing an impeller of a multi-blade air-sending device according to Embodiment 5.

FIG. 24 is a plan view of an impeller 10 of the multi-blade air-sending device 100E according to Embodiment 5. The multi-blade air-sending device 100E according to Embodiment 5 is described with reference to FIG. 24. It should be noted that elements having identical configurations as those of the multi-blade air-sending device 100 or other devices of FIGS. 1 to 23 are given identical signs and a description of such elements is omitted. The multi-blade air-sending device 100E according to Embodiment 5 includes other projecting portions other than the projections 20 at the second surface portion 11*c*. Accordingly, the following description is given with reference to FIG. 24 with a focus on a configuration of the other projecting portions formed at the second surface portion 11*c*.

As shown in FIG. 24, the second surface portion 11*c* includes a plurality of second projections 25 projecting from the back plate 11. Each of the second projections 25 is provided between ones of the projections 20 adjacent to each other along the circumferential direction, and is formed such that the length of the second projection 25 in a radial direction about the rotation shaft RS is shorter than the length of each of the projections 20.

The plurality of second projections 25 are provided in a radial fashion about the rotation shaft RS, and each of the plurality of second projections 25 extends in a radial direction about the rotation shaft RS. As shown in FIG. 24, the back plate 11 includes twenty-seven second projections 25. However, the number of second projections 25 that are formed is not limited to 27.

The plurality of second projections 25 are arranged on circumferences with different diameters about the rotation shaft RS, and the number of the plurality of second projections 25 that are arranged on the circumferences increases from the boss 11*b* toward the plurality of blades 12. For example, in the impeller 10 shown in FIG. 24, nine second projections 25 are formed on a first circle EN1 located on the inner circumference, and eighteen second projections 25 are formed on a second circle EN2 located on the outer circumference of the first circle EN1.

Each of the plurality of second projections 25 is a rib formed in the shape of a plate rising from the second surface portion 11*c*. More specifically, the second projection 25 is formed in the shape of a four-cornered plate. Note, however, that the second projection 25 needs only be a structure projecting from the second surface portion 11*c* and is not limited to the four-cornered plate-like configuration.

In a case in which a height direction is a direction parallel with the axial direction of the rotation shaft RS and a direction of projection from the second surface portion 11*c*, the plurality of second projections 25 have their heights formed at the same height. Note, however, that the back plate 11 is not limited to being configured such that the plurality of second projections 25 have their heights formed at the same height. The plurality of second projections 25 may be formed at different heights, or may form a group of the same height based on certain regularity.

In a case in which the height direction is the direction parallel with the axial direction of the rotation shaft RS and the direction of projection from the second surface portion 11*c*, a second projection 25 provided at an outermost circumferential portion within the second surface portion 11*c* is formed to correspond in height to the first surface portion 11*a* at an outer circumferential end portion serving as an outermost circumferential portion. Alternatively, the second projection 25 provided at the outermost circumferential portion within the second surface portion 11*c* is formed to be lower in height than the first surface portion 11*a* at the outer circumferential end portion serving as the outermost circumferential portion. In other words, the second projection 25 provided at the outermost circumferential portion within the second surface portion 11*c* is formed such that the outer circumferential end portion of the second projection 25 does not project from the first surface portion 11*a* in the direction parallel with the axial direction of the rotation shaft RS.

The impeller 10 includes a plurality of depressions 38. Each of the depressions 38 is formed by being surrounded by any one or more of the second surface portion 11*c*, the projections 20, the second projections 25, and the reinforcing portion 30. The plurality of depressions 38 are formed along the circumferential direction about the rotation shaft RS of the back plate 11. The number of depressions 38 that are formed along the circumferential direction increases from the boss 11*b* toward the plurality of blades 12.

[Working Effects of Impeller 10 and Multi-Blade Air-Sending Device 100E]

The impeller 10 and the multi-blade air-sending device 100E include a second projection 25 provided between ones of the projections 20 adjacent to each other along the circumferential direction and formed such that the length of the second projection 25 in a radial direction about the rotation shaft RS is shorter than the length of each of the projections 20. The second projection 25 makes it possible, while the impeller 10 is rotating, draw in a flow of gas by generating negative pressure on a surface of the impeller 10 facing in a direction opposite to a direction of rotation R of the impeller 10 and increase the amount of air that is suctioned into the impeller 10.

Further, the number of a plurality of the second projections 25 that are arranged on the circumferences increases from the boss 11*b* toward the plurality of blades 12. With the second surface portion 11*c* having a wide area in the radial direction, the impeller 10 increases in volume of air that is suctioned into the impeller 10, making it easy to cause turbulence in the flow of air. Since the number of the plurality of second projections 25 that are arranged on the circumferences increases toward the outer circumference, the impeller 10 can be configured such that the second surface portion 11*c* has a narrow area in the radial direction. Moreover, with the second surface portion 11*c* having a narrow area in the radial direction, the impeller 10 makes it possible to break the force of the wind flowing in the radial direction and adjust the volume of air that is suctioned into the impeller 10.

Further, the number of depressions 38 that are formed along the circumferential direction increases from the boss 11*b* toward the plurality of blades 12. With the second surface portion 11*c* having a wide area in the radial direction, the impeller 10 increases in volume of air that is suctioned into the impeller 10, making it easy to cause turbulence in the flow of air. Since the number of depressions 38 that are formed on the same circumference increases toward the outer circumference, the impeller 10 can be configured such that the second surface portion 11*c* has a narrow area in the radial direction. Moreover, with the second surface portion 11*c* having a narrow area in the radial direction, the impeller 10 makes it possible to break the force of the wind flowing in the radial direction and adjust the volume of air that is suctioned into the impeller 10.

Embodiment 6

[Multi-Blade Air-Sending Device 100F]

Figure 25:
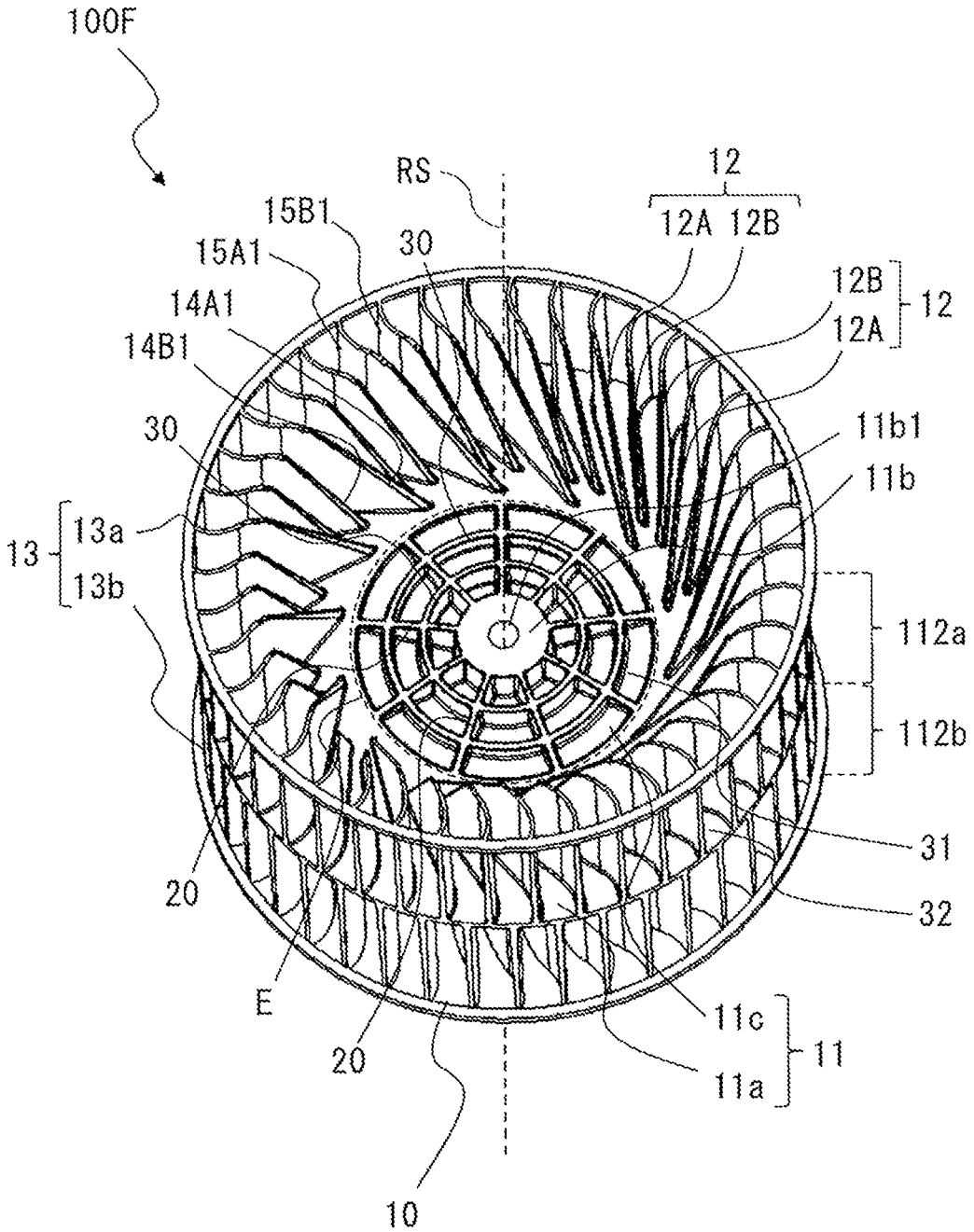
FIG. 25 is a perspective view of an impeller of a multi-blade air-sending device according to Embodiment 6 as seen from one side.
Figure 26:
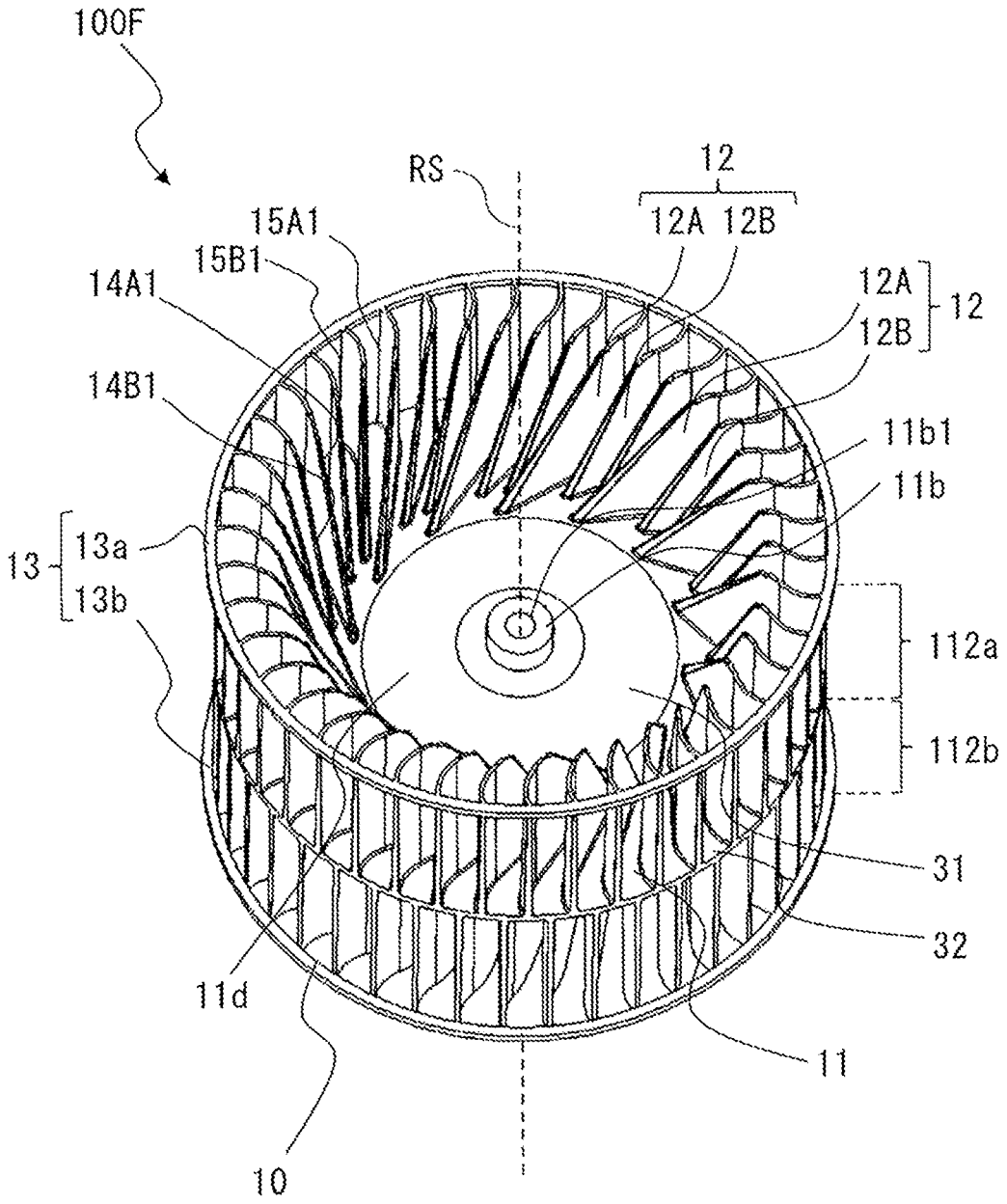
FIG. 26 is a perspective view of the impeller of the multi-blade air-sending device according to Embodiment 6 as seen from the other side.
Figure 27:
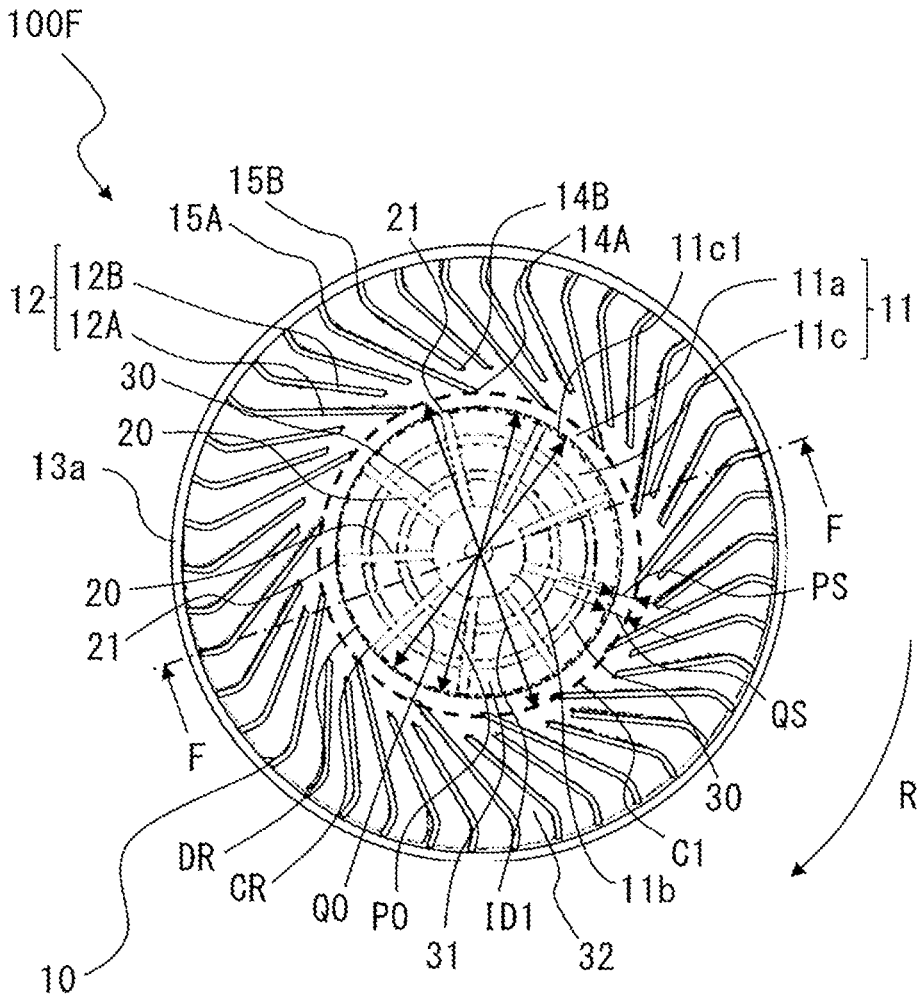
FIG. 27 is a plan view of the impeller shown in FIG. 25 as seen from one side.
Figure 28:
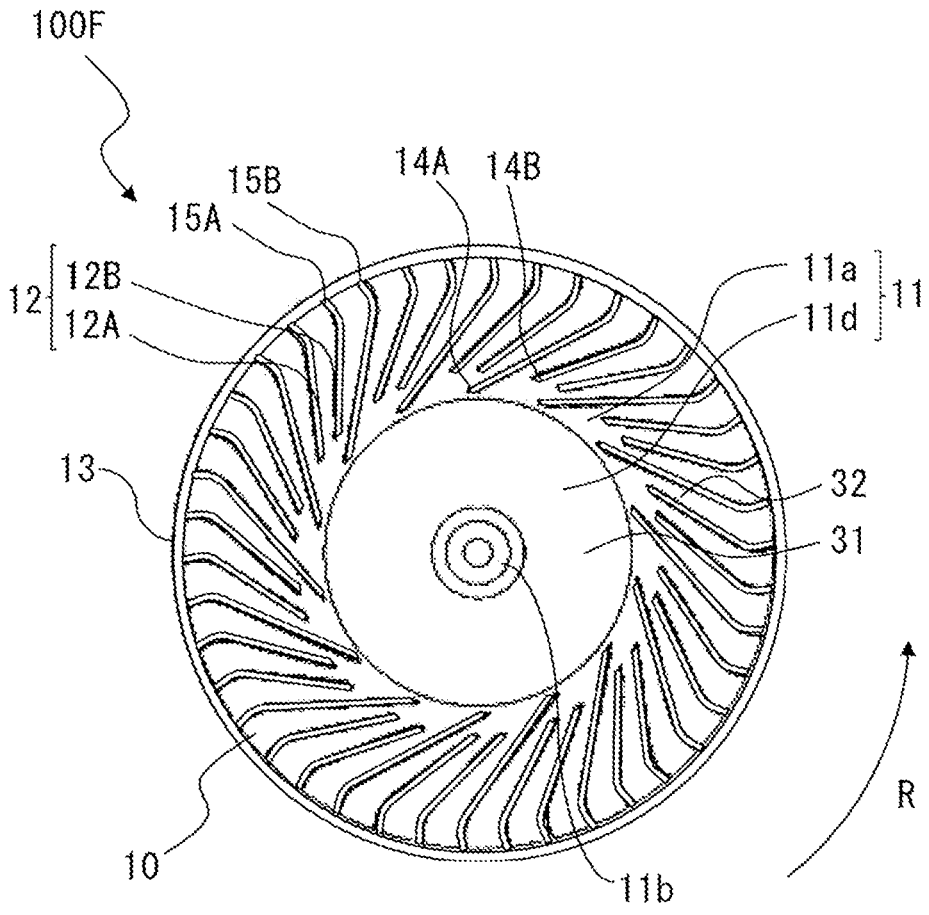
FIG. 28 is a plan view of the impeller shown in FIG. 26 as seen from the other side.
Figure 29:
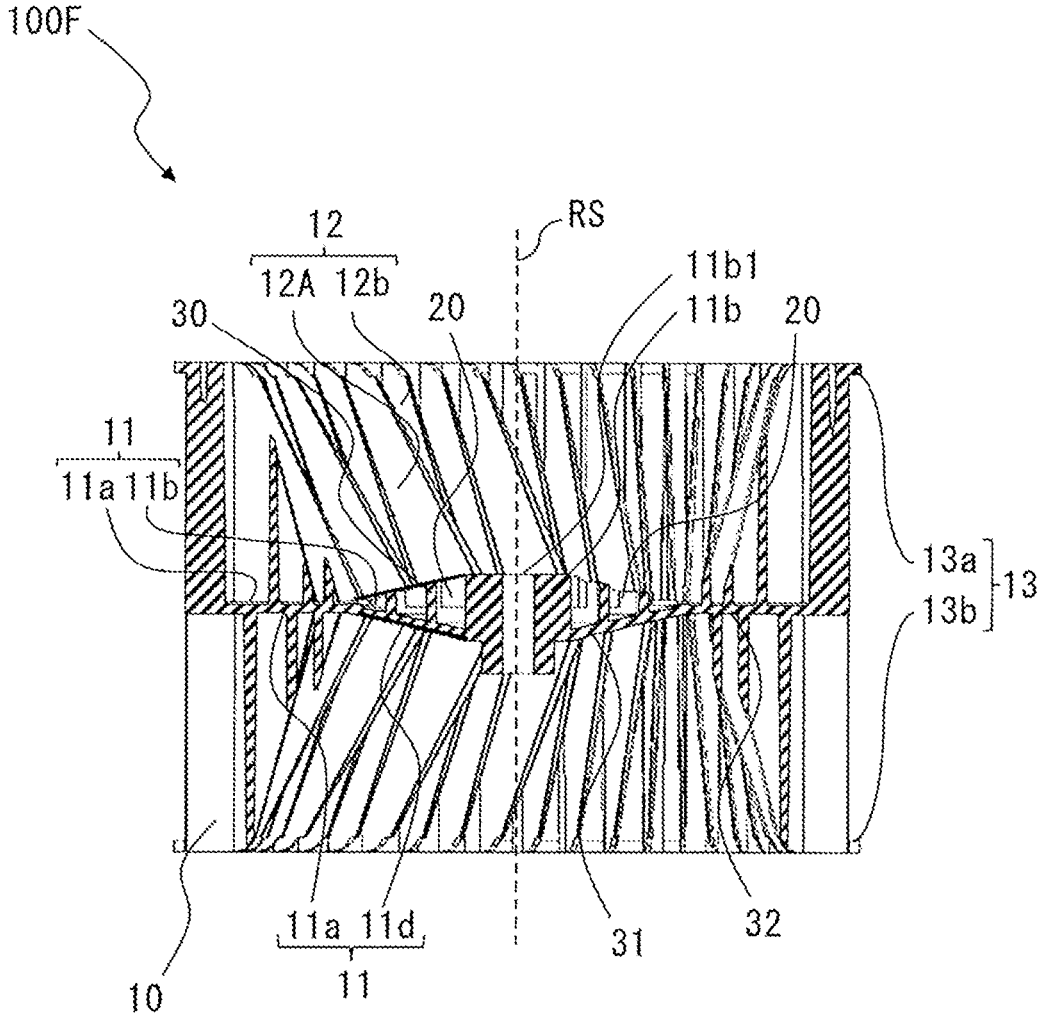
FIG. 29 is a cross-sectional view of the impeller as taken along line F-F in FIG. 27.

FIG. 25 is a perspective view of an impeller 10 of a multi-blade air-sending device 100F according to Embodiment 6 as seen from one side. FIG. 26 is a perspective view of the impeller 10 of the multi-blade air-sending device 100F according to Embodiment 6 as seen from the other side. FIG. 27 is a plan view of the impeller 10 shown in FIG. 25 as seen from one side. FIG. 28 is a plan view of the impeller 10 shown in FIG. 26 as seen from the other side. FIG. 29 is a cross-sectional view of the impeller 10 as taken along line F-F in FIG. 27. The multi-blade air-sending device 100F according to Embodiment 6 is described with reference to FIGS. 25 to 29. It should be noted that elements having identical configurations as those of the multi-blade air-sending device 100 or other devices of FIGS. 1 to 24 are given identical signs and a description of such elements is omitted. The multi-blade air-sending device 100F according to Embodiment 6 differs in configuration of the back plate 11 of the impeller 10 from that of Embodiment 1. Accordingly, the following description is given with reference to FIGS. 25 to 29 with a focus on the configuration of the back plate 11.

The back plate 11 includes an inner circumferential portion 31 inclined with respect to the rotation shaft RS and an outer circumferential portion 32 formed in a ring shape along an outer edge of the inner circumferential portion 31.

The inner circumferential portion 31 is formed in a conical shape. In a case in which one surface of the inner circumferential portion 31 formed in a conical shape is an inner surface and the other surface is an outer surface, the inner surface is formed in a concave shape, and the outer surface is formed in a convex shape.

The inner surface of the inner circumferential portion 31 faces the rotation shaft RS. The inner surface of the inner circumferential portion 31 is formed in such a bowl shape that the depth of the concave shape increases from the outer circumference toward the inner circumference in the radial direction about the rotation shaft RS. This inner surface of the inner circumferential portion 31 constitutes the second surface portion 11*c*. That is, one surface of the inner circumferential portion 31 in the axial direction of the rotation shaft RS constitutes the second surface portion 11*c*.

The inner surface of the inner circumferential portion 31 constitutes the second surface portion 11*c*, and at the inner surface of the inner circumferential portion 31 constituting the second surface portion 11*c*, projections 20 are formed. Further, at the inner surface of the inner circumferential portion 31 constituting the second surface portion 11*c*, a reinforcing portion 30 is formed. Furthermore, at the inner surface of the inner circumferential portion 31 constituting the second surface portion 11*c*, second projections 25 may be formed. The outer surface of the inner circumferential portion 31 is formed in a convex shape, and at the outer surface of the inner circumferential portion 31, the second surface portion 11*c*, the projections 20, the second projections 25, and the reinforcing portion 30 are not formed.

In the impeller 10 according to Embodiment 1, the second surface portion 11*c* is depressed from the first surface portion 11*a* by using a difference in thickness of the back plate 11, and in the impeller 10 according to Embodiment 6, the second surface portion 11*c* is formed by using the shape of the inner circumferential portion 31 formed in a conical shape.

The outer circumferential portion 32 is formed in a ring shape in a plan view as viewed from the direction parallel with the axial direction of the rotation shaft RS. The outer circumferential portion 32 is formed, for example, in a circular ring shape. On the inner circumference of the outer circumferential portion 32, the inner circumferential portion 31 is formed. The outer circumferential portion 32 located on the outer circumference of the second surface portion 11*c* constitutes the first surface portion 11*a*.

[Working Effects of Impeller 10 and Multi-Blade Air-Sending Device 100F]

The back plate 11 includes a second surface portion 11*c* depressed from the first surface portion 11*a* in an axial direction of the rotation shaft RS and a plurality of projections 20 provided at the second surface portion 11*c* and extending in the axial direction of the rotation shaft RS. While the impeller 10 is rotating, the projections 20 draw in a flow of gas by generating negative pressure on a surface of the impeller 10 facing in a direction opposite to a direction of rotation R of the impeller 10, making it possible to increase the amount of air that is suctioned into the impeller 10. Further, the impeller 10 includes the second surface portion 11*c* depressed from the first surface portion 11*a*, on which the plurality of blades 12 are formed, in the axial direction of the rotation shaft RS, and the projections 20 are provided at the second surface portion 11*c*. This inhibits a flow of gas produced by the projections 20 from flowing from the second surface portion 11*c* into the first surface portion 11*a*. Moreover, the flow of gas produced by the projections 20 has its centrifugally-outward force of wind broken by a step 11*f* between the first surface portion 11*a* and the second surface portion 11*c*, so that the impeller 10 does not suffer from turbulence in the flow of gas on the inner circumference of the blades 12. This allows the impeller 10 and the multi-blade air-sending device 100F to have higher air-sending efficiency than in a case in which the impeller 10 and the multi-blade air-sending device 100F do not include the projections 20 or the second surface portion 11*c*.

The back plate 11 includes an inner circumferential portion 31 inclined with respect to the rotation shaft RS and an outer circumferential portion 32 formed in a ring shape along an outer edge of the inner circumferential portion 31, and one surface of the inner circumferential portion 31 in the axial direction of the rotation shaft RS constitutes the second surface portion 11*c*. Causing the inner circumferential portion 31 to have a long inclined surface in the axial direction of the rotation shaft RS allows the impeller 10 to secure the depth of the inner circumferential portion 31 on the inner surface. Therefore, the impeller 10 and the multi-blade air-sending device 100F make it possible to increase the heights of the projections 20, the reinforcing portion 30, and the second projections 25 by using the depth of the inner circumferential portion 31 on the inner surface and improve the strength of the impeller 10. Further, the impeller 10 and the multi-blade air-sending device 100F make it possible to increase the heights of the projections 20, the reinforcing portion 30, and the second projections 25 by using the depth of the inner circumferential portion 31 on the inner surface and further increase the amount of air that is suctioned into the impeller 10.

Further, consideration is given to a case in which when a double-suction impeller 10 is incorporated into a product, an obstacle that prevents the flow of air is placed on one suction side of the impeller 10 and a suction load is unevenly put on one side of the impeller 10. In such a case, the impeller 10 and the multi-blade air-sending device 100F make it possible to achieve a balance of amounts of suction between the two suction sides by placing the projections 20 and the second surface portion 11*c* so that the projections 20 and the second surface portion 11*c* face the obstacle and to bring about improvement in air-sending efficiency.

Embodiment 7

[Multi-Blade Air-Sending Device 100G]

Figure 30:
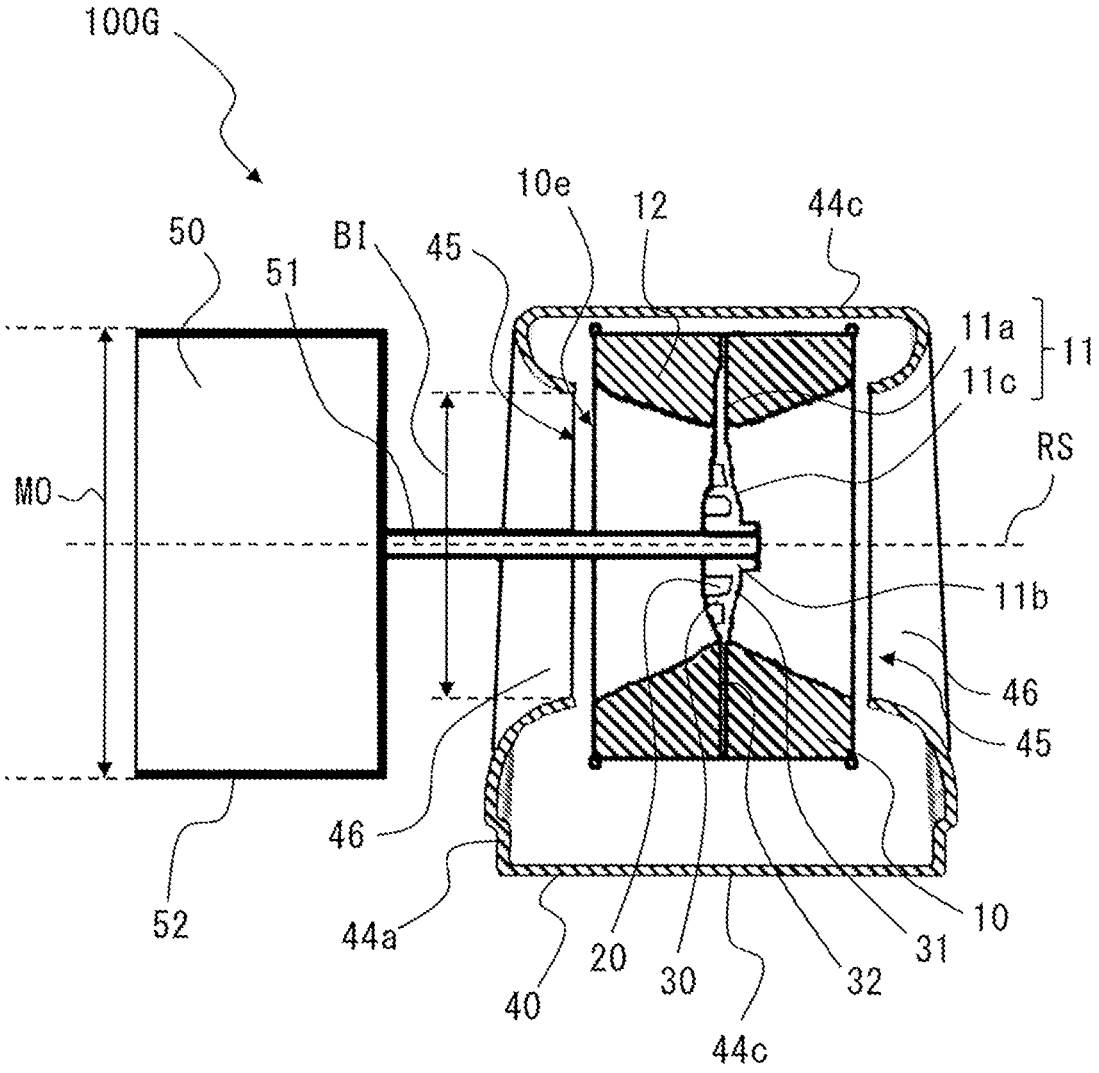
FIG. 30 is a conceptual diagram explaining a relationship between the impeller and a motor in a multi-blade air-sending device according to Embodiment 7.

FIG. 30 is a conceptual diagram explaining a relationship between the impeller 10 and a motor 50 in a multi-blade air-sending device 100G according to Embodiment 7. The multi-blade air-sending device 100G according to Embodiment 7 is described with reference to FIG. 30. It should be noted that elements having identical configurations as those of the multi-blade air-sending device 100 or other devices of FIGS. 1 to 29 are given identical signs and a description of such elements is omitted. The multi-blade air-sending device 100G according to Embodiment 7 is intended to further describe an example of a relationship between the impeller 10 of the multi-blade air-sending device 100F according to Embodiment 6 and an obstacle that prevents air from flowing into the impeller 10.

As shown in FIG. 30, the multi-blade air-sending device 100G may have, in addition to the impeller 10 and the scroll casing 40, a motor 50 configured to rotate the back plate 11 of the impeller 10. That is, the multi-blade air-sending device 100G has an impeller 10, a scroll casing 40 housing the impeller 10, and a motor 50 configured to drive the impeller 10.

The motor 50 is disposed adjacent to the side wall 44*a* of the scroll casing 40. A motor shaft 51 serving as a rotation shaft of the motor 50 is inserted in the scroll casing 40 through a side surface of the scroll casing 40.

The back plate 11 is disposed to be perpendicular to the rotation shaft RS along the side wall 44*a* of the scroll casing 40 facing the motor 50. The back plate 11 has provided in a central part thereof a boss 11*b* to which the motor shaft 51 is connected, and the motor shaft 51 is fixed to the boss 11*b* of the back plate 11 while being inserted in the scroll casing 40. The motor shaft 51 of the motor 50 is connected and fixed to the back plate 11 of the impeller 10.

The multi-blade air-sending device 100G is configured such that the motor 50 is disposed at and the motor shaft 51 is connected to a side of the back plate 11 at which the projections 20 and the second surface portion 11*c* are formed. Moreover, the multi-blade air-sending device 100G is configured such that the motor 50 is not disposed at and the motor shaft 51 is not connected to a side of the back plate 11 at which the projections 20 and the second surface portion 11*c* are not formed. In other words, the projections 20 and the second surface portion 11*c* of the multi-blade air-sending device 100G are disposed to face the motor 50.

Let it be assumed that in the multi-blade air-sending device 100G, the motor diameter of the motor 50 is a motor diameter MO and the inside diameter of the bellmouth 46 is an inside diameter BI. The motor diameter MO of the motor 50 is larger than the inside diameter BI of the bellmouth 46. The multi-blade air-sending device 100G is configured to satisfy the relationship "Motor Diameter MO>Inside Diameter BI".

The impeller 10 of the multi-blade air-sending device 100G may be the impeller 10 of the multi-blade air-sending device 100 or other devices according to Embodiments 1 to 5, or may be the impeller 10 of the multi-blade air-sending device 100F according to Embodiment 6. In a case in which the impeller 10 of the multi-blade air-sending device 100G is the impeller 10 of the multi-blade air-sending device 100F according to Embodiment 6, the back plate 11 of the impeller 10 includes an inner circumferential portion 31 and an outer circumferential portion 32 as shown in FIG. 30.

Once the motor 50 is brought into operation, the plurality of blades 12 rotate about the rotation shaft RS via the motor shaft 51 and the back plate 11. This causes outside air to be suctioned into the impeller 10 through the air inlet 45 and blown out into the scroll casing 40 by a booster action of the impeller 10. The air blown out into the scroll casing 40 recovers its static pressure by having its speed reduced in an expanded air trunk formed by the peripheral wall 44*c* of the scroll casing 40, and is blown out to the outside through the discharge port 42*a* shown in FIG. 1.

[Working Effects of Impeller 10 and Multi-Blade Air-Sending Device 100G]

At a side of the scroll casing 40 at which the motor 50 is disposed, the motor 50 becomes an obstacle to the flow of gas to narrow the air inlet 45 of the scroll casing 40 and the air inlet 10*e* of the impeller 10, with the result that the amount of a flow of gas that is suctioned decreases in general.

On the other hand, the multi-blade air-sending device 100G is configured such that the projections 20 and the second surface portion 11*c* are disposed to face the motor 50. As mentioned above, the projections 20 and the second surface portion 11*c* increase the amount of a flow of gas that is suctioned and reduce turbulence in the flow of gas, thereby making it possible to achieve higher air-sending efficiency than in a case in which the multi-blade air-sending device 100G do not include the projections 20 or the second surface portion 11*c*. Therefore, even at the side of the scroll casing 40 at which the motor 50 is disposed, where the amount of a flow of gas that is suctioned decreases in general, the multi-blade air-sending device 100G can have improved air-sending efficiency by increasing the amount of a flow of gas that is suctioned and reducing turbulence in the flow of gas.

In a case in which the multi-blade air-sending device 100G includes an inner circumferential portion 31 and an outer circumferential portion 32, the inner surface of the inner circumferential portion 31 makes it possible by having including the projections 20 and the second surface portion 11*c* to improve air-sending efficiency by increasing the amount of a flow of gas that is suctioned and reducing turbulence in the flow of gas. Moreover, the multi-blade air-sending device 100G is configured such that the projections 20 and the second surface portion 11*c* are disposed to face the motor 50. Therefore, even at the side of the scroll casing 40 at which the motor 50 is disposed, where the amount of a flow of gas that is suctioned decreases in general, the multi-blade air-sending device 100G can have improved air-sending efficiency by increasing the amount of a flow of gas that is suctioned and reducing turbulence in the flow of gas. On the other hand, the outer surface of the inner circumferential portion 31 does not include the projections 20 or the second surface portion 11*c*. Therefore, the multi-blade air-sending device 100G makes it possible to achieve a balance between the amounts of air that are suctioned through both sides of a double-suction impeller 10 and to bring about improvement in air-sending efficiency.

Further, the motor diameter MO of the motor 50 is larger than the inside diameter BI of the bellmouth 46. As mentioned above, the multi-blade air-sending device 100G is configured such that the projections 20 and the second surface portion 11*c* are disposed to face the motor 50. Therefore, even in a case in which the presence of the motor 50, which becomes an obstacle to the flow of gas, causes a decrease in the amount of a flow of gas that is suctioned and a great loss in suction of the impeller 10, the multi-blade air-sending device 100G can have improved air-sending efficiency by increasing the amount of a flow of gas that is suctioned and reducing turbulence in the flow of gas.

Embodiments 1 to 7 have been described by taking as an example a multi-blade air-sending device 100 including a double-suction impeller 10 having a plurality of blades 12 formed on both sides of a back plate 11. However, the present disclosure is also applicable to a multi-blade air-sending device 100 including a single-suction impeller 10 having a plurality of blades 12 formed only on one side of a back plate 11.

Embodiment 8

[Air-Conditioning Apparatus 140]

Figure 31:
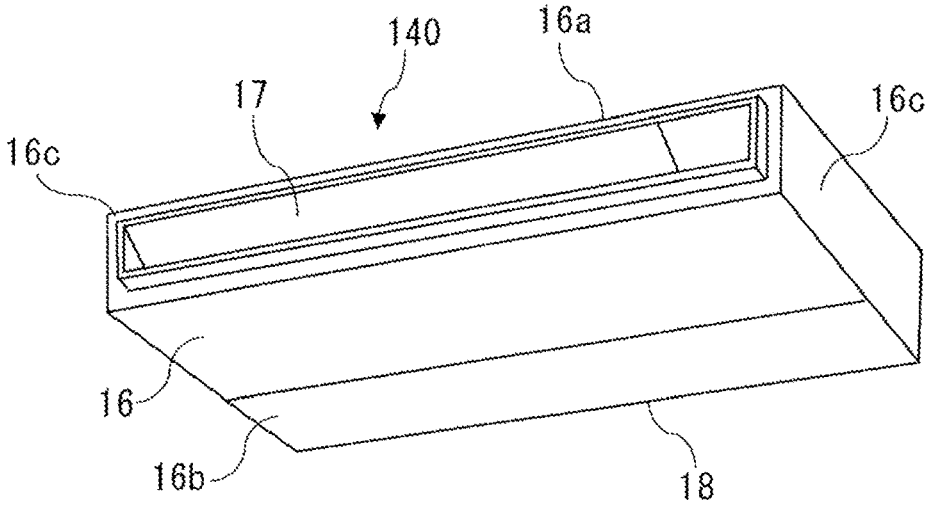
FIG. 31 is a perspective view of an air-conditioning apparatus according to Embodiment 8.
Figure 32:
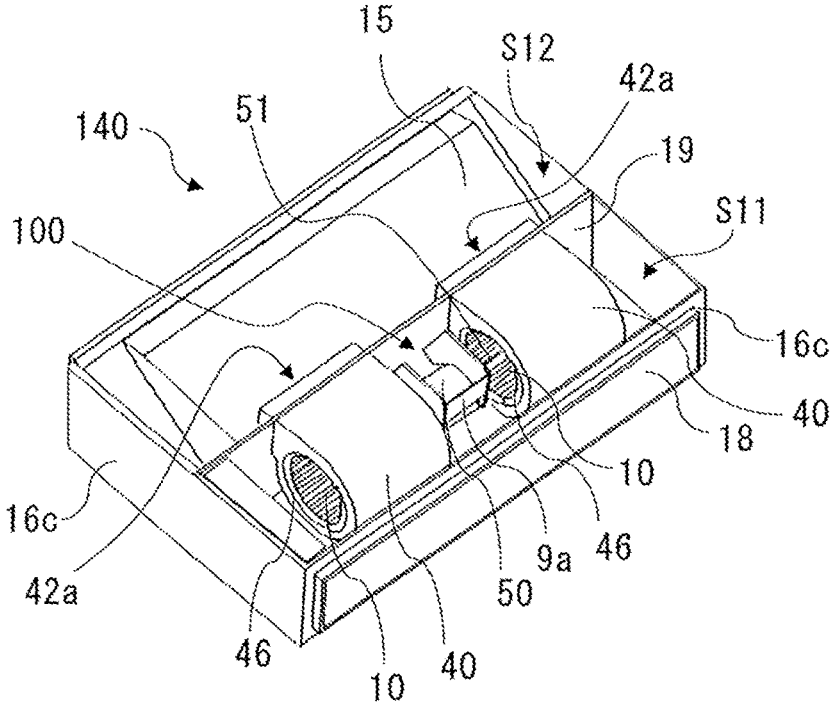
FIG. 32 is a diagram showing an internal configuration of the air-conditioning apparatus according to Embodiment 8.

FIG. 31 is a perspective view of an air-conditioning apparatus 140 according to Embodiment 8. FIG. 32 is a diagram showing an internal configuration of the air-conditioning apparatus 140 according to Embodiment 8. As for a multi-blade air-sending device 100 used in the air-conditioning apparatus 140 according to Embodiment 8, elements having identical configurations as those of the multi-blade air-sending device 100 or other devices of FIGS. 1 to 30 are given identical signs, and a description of such elements is omitted. To show the internal configuration of the air-conditioning apparatus 140, FIG. 32 omits to illustrate an upper surface portion 16*a*.

The air-conditioning apparatus 140 according to Embodiment 8 includes any one or more of the multi-blade air-sending devices 100 to 100G according to Embodiments 1 to 7 and a heat exchanger 15 disposed in such a location as to face a discharge port 42*a* of the multi-blade air-sending device 100. Further, the air-conditioning apparatus 140 according to Embodiment 8 includes a case 16 installed above a ceiling of a room to be air-conditioned. In the following description, the term "multi-blade air-sending device 100" indicates the use of any one of the multi-blade air-sending devices 100 to 100G according to Embodiments 1 to 7. Further, although, in FIGS. 31 and 32, a multi-blade air-sending device 100 having a scroll casing 40 in the case 16 is shown, an impeller 10 having no scroll casing 40 may be installed in the case 16.

(Case 16)

As shown in FIG. 31, the case 16 is formed in a cuboidal shape including an upper surface portion 16*a*, a lower surface portion 16*b*, and side surface portions 16*c*. The shape of the case 16 is not limited to the cuboidal shape but may for example be another shape such as a circular columnar shape, a prismatic shape, a conical shape, a shape having a plurality of corner portions, or a shape having a plurality of curved surface portions.

One of the side surface portions 16*c* of the case 16 is a side surface portion 16*c* having a case discharge port 17 formed therein. The case discharge port 17 is formed in a rectangular shape as shown in FIG. 31. The shape of the case discharge port 17 is not limited to the rectangular shape but may for example be another shape such as a circular shape or an oval shape.

Another one of the side surface portions 16*c* of the case 16 is a side surface portion 16*c* having a case air inlet 18 formed therein and being opposite the side surface portion 16*c* having the case discharge port 17 formed therein. The case air inlet 18 is formed in a rectangular shape as shown in FIG. 32. The shape of the case air inlet 18 is not limited to the rectangular shape but may for example be another shape such as a circular shape or an oval shape. A filter configured to remove dust in the air may be disposed at the case air inlet 18.

Inside the case 16, the multi-blade air-sending device 100 and the heat exchanger 15 are housed. The multi-blade air-sending device 100 includes an impeller 10, a scroll casing 40 having a bellmouth 46 formed therein, and a motor 50.

The motor 50 is supported by a motor support 9*a* fixed to the upper surface portion 16*a* of the case 16. The motor 50 has a motor shaft 51. The motor shaft 51 is disposed to extend parallel to the side surface portion 16*c* having the case air inlet 18 formed therein and the side surface portion 16*c* having the case discharge port 17 formed therein. As shown in FIG. 32, the air-conditioning apparatus 140 has two impellers 10 attached to the motor shaft 51.

The impellers 10 of the multi-blade air-sending device 100 forms a flow of air that is suctioned into the case 16 through the case air inlet 18 and blown out into an air-conditioned space through the case discharge port 17. The number of impellers 10 that are disposed in the case 16 is not limited to 2 but may be 1 or larger than or equal to 3.

As shown in FIG. 32, the multi-blade air-sending device 100 is attached to a divider 19 configured to divide an internal space of the case 16 into a space S11 facing a suction side of the scroll casing 40 and a space S12 facing a blowout side of the scroll casing 40.

The heat exchanger 15 is disposed in such a location as to face the discharge port 42*a* of the multi-blade air-sending device 100, and is disposed in the case 16 to be on an air trunk of air to be discharged by the multi-blade air-sending device 100. The heat exchanger 15 adjusts the temperature of air that is suctioned into the case 16 through the case air inlet 18 and blown out into the air-conditioned space through the case discharge port 17. As the heat exchanger 15, a heat exchanger of a publicly-known structure can be applied. The case air inlet 18 needs only be formed in a location perpendicular to the axial direction of the rotation shaft RS of the multi-blade air-sending device 100. For example, the case air inlet 18 may be formed in the lower surface portion 16*b*.

Rotation of the impeller 10 of the multi-blade air-sending device 100 causes the air in the air-conditioned space to be suctioned into the case 16 through the case air inlet 18. The air suctioned into the case 16 is guided toward the bellmouth 46 and suctioned into the impeller 10. The air suctioned into the impeller 10 is blown out outward in the radial direction of the impeller 10.

The air blown out from the impeller 10 passes through the inside of the scroll casing 40, blown out of the scroll casing 40 through the discharge port 42*a*, and then supplied to the heat exchanger 15. The air supplied to the heat exchanger 15 is subjected to temperature and humidity control by, during passage through the heat exchanger 15, exchanging heat with refrigerant flowing through the inside of the heat exchanger 15. The air having passed through the heat exchanger 15 is blown out to the air-conditioned space through the case discharge port 17.

The air-conditioning apparatus 140 according to Embodiment 8 includes any one of the multi-blade air-sending devices 100 to 100G according to Embodiments 1 to 7. Therefore, the air-conditioning apparatus 140 can bring about effects similar to those of any of Embodiments 1 to 7.

Each of Embodiment 1 to 8 may be implemented in combination with the other. Further, the configurations shown in the foregoing embodiments show examples and may be combined with another publicly-known technology, and parts of the configurations may be omitted or changed, provided such omissions and changes do not depart from the scope. For example, an embodiment describes an impeller 10 or other devices constituted by the back-plate-side blade region 122*a* serving as the first region and the rim-side blade region 122*b* serving as the second region. The impeller 10 is not limited to an impeller constituted solely by the first region and the second region. The impeller 10 may further have another region as well as the first region and the second region.

The invention claimed is:

1. An impeller connected to a motor having a drive shaft, the impeller comprising:

a back plate having a boss having a shaft hole through which the drive shaft is inserted;

a ring-shaped rim provided to face the back plate; and a plurality of blades connected to the back plate and the rim, and arranged along a circumferential direction of the back plate about the rotation shaft, the back plate including a first surface portion on which the plurality of blades are formed, a second surface portion provided at a region between the boss and the first surface portion, and depressed from the first surface portion in an axial direction of the rotation shaft, a plurality of projections projecting from the second surface portion and having a plate shape to extend in the axial direction, and wherein the second surface portion is constituted by a back plate body whose thickness is thinner than a thickness of a back plate body constituting the first surface portion.

2. The impeller of claim 1, wherein the second surface portion is formed in a circular ring shape about the boss.

3. The impeller of claim 1, wherein a length of a depression outside diameter constituted by an outer circumferential edge of the second surface portion is greater than a magnitude of a difference between a blade inside diameter constituted by an inner circumferential end of each of the plurality of blades and the depression outside diameter.

4. The impeller of claim 1, wherein each of the plurality of projections extends in a radial direction about the rotation shaft.

5. The impeller of claim 1 wherein each of the plurality of projections is connected to an outer circumferential wall of the boss.

6. The impeller of claim 1, wherein a space is formed between each of the plurality of projections and an outer circumferential wall of the boss.

7. The impeller of claim 1, wherein each of the plurality of projections includes a projection inner circumferential end portion serving as an inner circumferential end portion in a radial direction about the rotation shaft, and a projection outer circumferential end serving as an outer circumferential end portion in the radial direction, and the projection outer circumferential end does not project from the first surface portion in the axial direction.

8. The impeller of claim 7, wherein a length of a projection outside diameter constituted by the projection outer circumferential end of each of the plurality of projections is greater than a magnitude of a difference between a blade inside diameter constituted by the inner circumferential end of each of the plurality of blades and the projection outside diameter.

9. The impeller of claim 1, wherein each of the projections includes an inclined portion inclined such that a height of the inclined portion in the axial direction decreases from an inner circumference toward an outer circumference.

10. The impeller of claim 1, wherein each of the plurality of projections includes a horizontal portion having a ridge line constituted by a leading end portion in a direction of projection and extending in a direction perpendicular to the axial direction in a side view as viewed from the direction perpendicular to the axial direction.

11. The impeller of claim 1, wherein each of the plurality of projections is formed such that a height of the projection in the axial direction decreases from an inner circumference toward an outer circumference, and includes a wavy portion having a ridge line constituted by a leading end portion in a direction of projection and formed in a wavelike fashion in a side view as viewed from a direction perpendicular to the axial direction.

12. The impeller of claim 1, wherein each of the plurality of projections is formed such that a projection outlet angle at an outer circumferential end portion is an angle smaller than or equal to 90 degrees.

13. The impeller of claim 1, wherein the back plate includes a reinforcing portion provided at the second surface portion and extending in the axial direction, and the reinforcing portion connects the plurality of projections to each other along the circumferential direction.

14. The impeller of claim 13, wherein a plurality of the reinforcing portions are provided in a radial direction about the rotation shaft.

15. The impeller of claim 1, the second surface portion includes a plurality of second projections projecting from the back plate, and each of the second projections is provided between ones of the projections adjacent to each other along the circumferential direction, and is formed such that a length of the second projection in a radial direction about the rotation shaft is shorter than a length of each of the projections.

16. The impeller of claim 15, wherein the plurality of second projections are arranged on circumferences with different diameters about the rotation shaft, and a number of the plurality of second projections that are arranged on the circumferences increases from the boss toward the plurality of blades.

17. The impeller of claim 13, wherein the second surface portion includes a plurality of second projections projecting from the back plate, each of the second projections is provided between adjacent ones of the projections and formed such that a length of the second projection in a radial direction about the rotation shaft is shorter than a length of each of the projections, and a number of depressions that are formed by being surrounded by the second surface portion, the projections, the second projections, and the reinforcing portion increases from the boss toward the plurality of blades.

18. The impeller of claim 1, wherein the back plate has its first and second surface portions on both plate sides of the back plate, and each of the second surface portions formed on both plate sides of the back plate includes the plurality of projections.

19. The impeller of claim 1, wherein the back plate includes an inner circumferential portion inclined with respect to the rotation shaft, and an outer circumferential portion formed in a ring shape along an outer edge of the inner circumferential portion, one surface of the inner circumferential portion in the axial direction constitutes the second surface portion, and the outer circumferential portion located on an outer circumference of the second surface portion constitutes the first surface portion.

20. The impeller of claim 1, wherein each of the plurality of blades includes an inner circumferential end located close to the rotation shaft in a radial direction about the rotation shaft, an outer circumferential end located closer to an outer circumference than the inner circumferential end in the radial direction about the rotation shaft, a sirocco blade portion being forward-swept and including the outer circumferential end and having a blade outlet angle of larger than 90 degrees, and a turbo blade portion being swept-back and including the inner circumferential end.

21. A multi-blade air-sending device comprising:

the impeller of claim 1, and a scroll casing housing the impeller and having a peripheral wall formed into a volute shape and a side wall having a bellmouth forming an air inlet communicating with a space formed by the back plate and the plurality of blades.

22. The multi-blade air-sending device of claim 21, further comprising a motor having a motor shaft connected to the back plate and being disposed outside the scroll casing, the second surface portion and the plurality of projections being disposed to face the motor.

23. The multi-blade air-sending device of claim 22, wherein a motor diameter of the motor is larger than an inside diameter of the bellmouth.

24. An air-conditioning apparatus comprising the multi-blade air-sending device of claim 21.

25. The impeller of claim 20, wherein a first region located closer to the back plate than a middle point in the axial direction, and a second region located closer to the rim than the first region, are defined, and in a case in which the plurality of blades are constituted by blades having blade lengths being lengths of the blades in the radial direction about the rotation shaft, a blade length in the first region is longer than a blade length in the second region, and in the first region and the second region, a ratio of the turbo blade portion in the radial direction about the rotation shaft is larger than a ratio of the sirocco blade portion in the radial direction about the rotation shaft.

* * * * *